US011833582B2

(12) United States Patent
Funagane et al.

(10) Patent No.: US 11,833,582 B2
(45) **Date of Patent: *Dec. 5, 2023**

(54) METHOD FOR PRODUCING METAL INGOT

(71) Applicant: NIPPON STEEL CORPORATION, Tokyo (JP)

(72) Inventors: Hitoshi Funagane, Tokyo (JP); Kenji Hamaogi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/604,906

(22) PCT Filed: Apr. 13, 2018

(86) PCT No.: PCT/JP2018/015555
§ 371 (c)(1),
(2) Date: Oct. 11, 2019

(87) PCT Pub. No.: WO2018/190424
PCT Pub. Date: Oct. 18, 2018

(65) Prior Publication Data

US 2020/0164432 A1 May 28, 2020

(30) Foreign Application Priority Data

Apr. 13, 2017 (JP) ..... 2017-079732
Apr. 13, 2017 (JP) ..... 2017-079733
(Continued)

(51) Int. Cl.
*C22B 9/22* (2006.01)
*B22D 21/06* (2006.01)
(Continued)

(52) U.S. Cl.
CPC ..... *B22D 7/005* (2013.01); *B22D 11/116* (2013.01); *B22D 21/06* (2013.01); *B22D 27/02* (2013.01);
(Continued)

(58) Field of Classification Search
CPC ..... B22D 11/103; B22D 11/11; B22D 11/116; C22B 9/228; C22B 34/1295
See application file for complete search history.

(56) References Cited

U.S. PATENT DOCUMENTS 4,838,340 A 6/1989 Entrekin et al.

FOREIGN PATENT DOCUMENTS

JP 4-124229 A 4/1992
JP 2004-232066 A 8/2004
(Continued)

OTHER PUBLICATIONS

Machine Translation of JP 5152994 B2 (published Feb. 27, 13). (Year: 2013).*
(Continued)

*Primary Examiner* — Kevin E Yoon
*Assistant Examiner* — Jacky Yuen
(74) *Attorney, Agent, or Firm* — Birch, Stewart, Kolasch & Birch, LLP

(57) ABSTRACT

A method for producing a metal ingot by using an electron-beam melting furnace including an electron gun and a hearth that accumulates a molten metal of a metal raw material, in which, in a downstream region between an upstream region in which the metal raw material is supplied onto the surface of the molten metal and a first side wall, an irradiation line is disposed so as to block a lip portion and so that two end portions are positioned in the vicinity of the side wall of the hearth. A first electron beam is radiated onto the surface of the molten metal along the irradiation line, such that the
(Continued)

surface temperature (T2) of the molten metal along the irradiation line is made higher than the average surface temperature (T0) of the entire surface of the molten metal in the hearth.

6 Claims, 36 Drawing Sheets

(30) Foreign Application Priority Data

Apr. 13, 2017 (JP) ..... 2017-079734
Apr. 13, 2017 (JP) ..... 2017-079735

(51) Int. Cl.

| | |
|---|---|
| ***B22D 27/02*** | (2006.01) |
| ***B22D 11/116*** | (2006.01) |
| ***F27B 3/08*** | (2006.01) |
| ***B22D 7/00*** | (2006.01) |
| ***C22B 34/12*** | (2006.01) |
| ***C22C 14/00*** | (2006.01) |
| ***B22D 35/04*** | (2006.01) |
| ***C21D 9/70*** | (2006.01) |

(52) U.S. Cl.
CPC ..... *B22D 35/04* (2013.01); *C21D 9/70* (2013.01); *C22B 9/22* (2013.01); *C22B 34/1295* (2013.01); *C22C 14/00* (2013.01); *F27B 3/08* (2013.01)

(56) References Cited

FOREIGN PATENT DOCUMENTS

| | | | |
|---|---|---|---|
| JP | 2004-276039 | A | 10/2004 |
| JP | 2011-127148 | A | 6/2011 |
| JP | 2013-1975 | A | 1/2013 |
| JP | 2013-245398 | A | 12/2013 |
| WO | WO 90/00627 | A1 | 1/1990 |
| WO | WO2008/078402 | A1 | 7/2008 |
| WO | WO 2008/0784702 | A1 | 7/2008 |

OTHER PUBLICATIONS

International Preliminary Report on Patentability dated Oct. 24, 2019 and Written Opinion of the International Searching Authority(Forms PCT/iB/326, PCT/IB/373 and PCT/ISA/237), dated May 22, 2018, for International Application No. PCT/JP2018/01555, with an English Translation.

International Preliminary Report on Patentability, dated Oct. 24, 2019, and Written Opinion of the International Searching Authority(Forms PCT/IB/326, PCT/IB/373 and PCT/IB/237), dated May 22, 2018, for International Application No. PCT/JP2018/015536, with an English Translation.

International Search Report (Form PCT/ISA/210), dated May 22, 2018, for International Application No. PCT/JP2018/015536, with an English translation.

International Search Report (Form PCT/ISA/210), dated May 22, 2018, for International Application No. PCT/JP2018/015555, with an English translation.

Meng, Tao, "Factors Influencing the Fluid Flow and Heat Transfer in Electron Beam Melting of TI-6AL-4V", B.Eng., Huazhong University of Science and Technology, Nov. 2009, 114 pages.

English machine translation for JP-2004-232066-A dated Aug. 19, 2004.

English machine translation for JP-2004-276039-A dated Oct. 7, 2004.

English machine translation for JP-2013-1975-A dated Jan. 7, 2013.

U.S. Appl. No. 16/604,916, filed Oct. 11, 2019, Not Yet Assigned.

* cited by examiner

| No. | TEMPERATURE OF MOLTEN METAL | MOVEMENT OF LDI |
|---|---|---|
| 5-1 | 2500 [K] 300 | |
| 5-2 | | |
| 5-3 | | |

| | EXAMPLE 3 | EXAMPLE 1 |
|---|---|---|
| IRRADIATION LINE | T-SHAPED | V-SHAPED |
| VELOCITY DISTRIBUTION OF MOLTEM METAL |  |  |
| MAXIMUM FLOW VELOCITY [m/s] | 0.13 | 0.11 |
| RATIO OF TOTAL FLOW RATE | 1.2 | 1.0 |

METHOD FOR PRODUCING METAL INGOT

TECHNICAL FIELD

The present invention relates to a method for producing a metal ingot that melts a metal raw material by an electron beam melting process.

BACKGROUND ART

An ingot of commercially pure titanium or a titanium alloy or the like is produced by melting a titanium raw material such as titanium sponge or scrap. Examples of techniques for melting a metal raw material (hereunder, may be referred to simply as "raw material") such as a titanium raw material include a vacuum arc remelting process, a plasma arc melting process, and an electron beam melting process. Among these, in the electron beam melting process, the raw material is melted by radiating an electron beam onto a solid raw material in an electron-beam melting furnace (hereunder, also referred to as "EB furnace"). To prevent dissipation of the energy of the electron beam, melting of the raw material by radiation of the electron beam in the EB furnace is performed inside a vacuum chamber. Molten titanium (hereunder, may also be referred to as "molten metal") that is the melted raw material is refined in a hearth, and thereafter is solidified in a mold to form a titanium ingot. According to the electron beam melting process, because the radiation position of the electron beam that is the heat source can be accurately controlled by an electromagnetic force, heat can also be sufficiently supplied to molten metal in the vicinity of the mold. Therefore, it is possible to produce an ingot without deteriorating the surface quality thereof.

An EB furnace generally includes a raw material supplying portion that supplies a raw material such as titanium sponge, one or a plurality of electron guns for melting the supplied raw material, a hearth (for example, a water-cooled copper hearth) for accumulating the melted raw material, and a mold for forming an ingot by cooling molten titanium that was poured therein from the hearth. EB furnaces are broadly classified into two types according to differences between the configurations of the hearths. Specifically, an EB furnace 1A that includes a melting hearth 31 and a refining hearth 33 as illustrated in FIG. 1, and an EB furnace 1B that includes only a refining hearth 30 as illustrated in FIG. 2 are available as two types of EB furnace.

The EB furnace 1A illustrated in FIG. 1 includes a raw material supplying portion 10, electron guns 20*a* to 20*e*, a melting hearth 31 and refining hearth 33, and a mold 40. The solid raw material 5 that is introduced into the melting hearth 31 from the raw material supplying portion 10 is irradiated with electron beams by the electron guns 20*a* and 20*b* to thereby melt the raw material to obtain a molten metal 5*c*. The melted raw material (molten metal 5*c*) in the melting hearth 31 flows into the refining hearth 33 that communicates with the melting hearth 31. In the refining hearth 33, the temperature of the molten metal 5*c* is maintained or increased by radiation of electron beams onto the molten metal 5*c* by the electron guns 20*c* and 20*d*. By this means, impurities contained in the molten metal 5*c* are removed or the like, and the molten metal 5*c* is refined. Thereafter, the refined molten metal 5*c* flows into the mold 40 from a lip portion 33*a* provided at an end portion of the refining hearth 33. The molten metal 5*c* solidifies inside the mold 40, thereby producing an ingot 50. A hearth composed of the melting hearth 31 and the refining hearth 33 as illustrated in FIG. 1 is also referred to as a "long hearth".

On the other hand, the EB furnace 1B shown in FIG. 2 includes raw material supplying portions 10A and 10B, electron guns 20A to 20D, a refining hearth 30 and a mold 40. A hearth that is composed of only the refining hearth 30 in this way is also referred to as a "short hearth", relative to the "long hearth" illustrated in FIG. 1. In the EB furnace 1B that uses the short hearth, the solid raw material 5 that is placed on the raw material supplying portions 10A and 10B is melted by electron beams that are directly radiated from the electron guns 20A and 20B, and the melted raw material 5 is dripped into the molten metal 5*c* in the refining hearth 30 from the raw material supplying portions 10A and 10B. Thus, the melting hearth 31 illustrated in FIG. 1 can be omitted from the EB furnace 1B illustrated in FIG. 2. In addition, in the refining hearth 30, the temperature of the molten metal 5*c* is maintained or increased by radiating electron beams from the electron gun 20C over a wide range on the entire surface of the molten metal 5*c*. By this means, impurities contained in the molten metal 5*c* are removed or the like, and thus the molten metal 5*c* is refined. Thereafter, the refined molten metal 5*c* flows into the mold 40 from a lip portion 36 provided at an end portion of the refining hearth 30, and an ingot 50 is produced.

In the case of producing an ingot using a hearth and a mold by means of an electron beam melting process as described above, if impurities are mixed in with the ingot, the impurities will be the cause of cracks in the ingot. Therefore, there is a need for the development of electron beam melting technology that can ensure that impurities do not become mixed into molten metal that flows into a mold from a hearth. Impurities are mainly included in the raw material, and are classified into two kinds, namely, a HDI (High Density Inclusion) and a LDI (Low Density Inclusion). A HDI is, for example, an impurity in which tungsten is the principal component, and the density of the HDI is larger than the density of molten titanium. On the other hand, a LDI is an impurity in which the principal component is nitrided titanium or the like. The inside of the LDI is in a porous state, and therefore the density of the LDI is less than the density of molten titanium.

On the inner surface of a water-cooled copper hearth, a solidified layer is formed at which molten titanium that came in contact with the hearth solidified. The solidified layer is referred to as a "skull". Among the aforementioned impurities, because the HDIs have a high relative density, the HDIs settle in the molten metal (molten titanium) in the hearth, and adhere to the surface of the skull and are thereby trapped, and hence the possibility of HDIs becoming mixed into the ingot is low. On the other hand, because the density of the LDIs is less than the density of molten titanium, a major portion of the LDIs float on the molten metal surface within the hearth. While the LDIs are floating on the molten metal surface, the nitrogen diffuses and is dissolved into the molten metal. In the case of using the long hearth illustrated in FIG. 1, because the residence time of the molten metal in the long hearth can be prolonged, it is easier to cause impurities such as LDIs to dissolve into the molten metal in comparison to a case of using a short hearth. On the other hand, in the case of using a short hearth as illustrated in FIG. 2, because the residence time of the molten metal in the short hearth is short compared to the long hearth, the possibility that impurities will not dissolve into the molten metal is high compared to when using the long hearth. Further, in the case of LDIs that have a high nitrogen content, because the dissolving point thereof is high, the possibility of the LDIs dissolving into the molten metal during the residence time of normal operations is extremely low.

Therefore, for example, Patent Document 1 discloses a method of electron beam melting for metallic titanium in which the surface of molten metal in a hearth is scanned with an electron beam in the opposite direction to the direction in which the molten metal flows into a mold, and the average temperature of molten metal in a region adjacent to a molten metal discharging opening in the hearth is made equal to or higher than the melting point of impurities. According to the technique disclosed in Patent Document 1, by scanning an electron beam in a zig-zag manner in the opposite direction to the flow direction of the molten metal, it is attempted to push back impurities that float on the molten metal surface to the upstream side so that the impurities do not flow into a mold on the downstream side.

LIST OF PRIOR ART DOCUMENTS

Patent Document

Patent Document 1: JP2004-232066A

Non Patent Document

Non-Patent Document 1: Tao Meng, "Factors influencing the fluid flow and heat transfer in electron beam melting of Ti-6Al-4V", (2009)

SUMMARY OF INVENTION

Technical Problem

However, according to the method disclosed in the aforementioned Patent Document 1, because an electron beam is scanned in the opposite direction to the flow direction of the molten metal, there is a possibility that, on the downstream side of the molten metal flow relative to the electron beam radiation position, impurities will pass through into the mold. In addition, on the downstream side relative to the electron beam radiation position, the flow of molten metal accelerates toward the mold and thus the residence time of the molten metal in the hearth becomes shorter, and there is the possibility that the rate of removal of impurities will decrease. Further, when impurities are present on the downstream side of the molten metal flow relative to the radiation position of the electron beam, the risk of those impurities riding on the flow of molten metal and flowing out into the mold increases. For these reasons, there is a possibility that impurities contained in molten metal within the hearth, particularly LDIs floating on the surface of the molten metal 5*c*, will flow out into the mold from the hearth and become mixed in the ingot that is formed in the mold. Therefore, there is a need for a method for producing a metal ingot that, by inhibiting the outflow of impurities such as LDIs from a hearth into a mold, can inhibit impurities from being mixed into an ingot.

An objective of the present invention, which has been made in consideration of the aforementioned problem, is to provide a novel and improved method for producing a metal ingot, which makes it possible to inhibit impurities contained in molten metal in a hearth from being mixed into an ingot.

Solution to Problem

To solve the aforementioned problem, according to a certain viewpoint of the present invention there is provided a method for producing a metal ingot by using an electron-beam melting furnace having an electron gun capable of controlling a radiation position of an electron beam and a hearth that accumulates a molten metal of a metal raw material, the metal ingot containing 50% by mass or more in total of at least one metallic element selected from a group consisting of titanium, tantalum, niobium, vanadium, molybdenum and zirconium, wherein: among a plurality of side walls of the hearth that accumulates the molten metal of the metal raw material, a first side wall is a side wall provided with a lip portion for causing the molten metal in the hearth to flow out into a mold; an irradiation line is disposed in a downstream region between an upstream region in which the metal raw material is supplied onto a surface of the molten metal and the first side wall, such that the irradiation line blocks the lip portion and two end portions of the irradiation line are positioned in a vicinity of the side wall of the hearth; a first electron beam is radiated onto the surface of the molten metal along the irradiation line; and the radiation of the first electron beam along the irradiation line increases a surface temperature (T2) of the molten metal at the irradiation line above an average surface temperature (T0) of the entire surface of the molten metal in the hearth, and forms, in an outer layer of the molten metal, a molten metal flow toward upstream that is a direction on an opposite side to the first side wall from the irradiation line.

According to the present invention, by radiating an electron beam along an irradiation line as described above with respect to the surface of molten metal in a hearth, an outflow of impurities from the hearth to a mold is prevented, and impurities can be prevented from becoming mixed into an ingot.

The two end portions of the irradiation line are positioned in the vicinity of the first side wall.

The two end portions of the irradiation line are positioned at an inside face of the side wall or in a region in which a separation distance from the inside face of the side wall is 5 mm or less.

The molten metal flow may be a flow from the irradiation line that arrives at a side wall that extends substantially perpendicularly toward the upstream from the first side wall among the side walls of the hearth.

The irradiation line may be in a convex shape that projects from the lip portion side toward the upstream.

The irradiation line may be in a V-shape, or a circular arc shape having a diameter that is equal to or larger than an opening width of the lip portion.

The irradiation line may be in a T-shape that includes a first straight line portion along the first side wall between the two end portions, and a second straight line portion that extends substantially perpendicularly from the first straight line portion toward the upstream.

The irradiation line may be in a straight line shape along the first side wall between the two end portions.

The molten metal flow may be a flow that is from the irradiation line toward the upstream and is toward a center from a pair of side walls that face each other and that extend substantially perpendicularly toward the upstream from the first side wall among the side walls of the hearth.

The irradiation line may be in a convex shape that projects from the upstream toward the lip portion.

The irradiation line may be in a U-shape that includes a first straight line portion along the first side wall between the two end portions, and a second straight line portion and a third straight line portion from the two end portions of the first straight line portion that extend, respectively, along side walls which face each other and extend substantially perpendicularly toward upstream from the first side wall among the side walls of the hearth.

A second electron beam may be radiated onto a stagnation position of the molten metal flow that arises due to radiation of the first electron beam along the irradiation line.

A plurality of the first electron beams may be radiated along the irradiation line using a plurality of electron guns, so that radiation paths of the first electron beams intersect or overlap on the surface of the molten metal.

The hearth may be configured so as to include only one refining hearth, and to melt the metal raw material in a raw material supplying portion, cause the melted metal raw material to drip from the raw material supplying portion into the hearth, and refine the metal raw material in the molten metal within the refining hearth.

The hearth may be a hearth with multiple stages in which a plurality of divided hearths are combined and successively disposed, wherein, in each of the divided hearths, a first electron beam is radiated onto the surface of the molten metal along the irradiation line that is disposed such that the irradiation line blocks the lip portion in the downstream region and the two end portions of the irradiation line are positioned in a vicinity of the side wall of the divided hearth.

Further, the metal raw material may contain 50% by mass or more of a titanium element.

Advantageous Effects of Invention

According to the present invention as described above, the mixing of impurities contained in molten metal in a hearth into an ingot can be inhibited.

DESCRIPTION OF EMBODIMENTS

Figure 1:
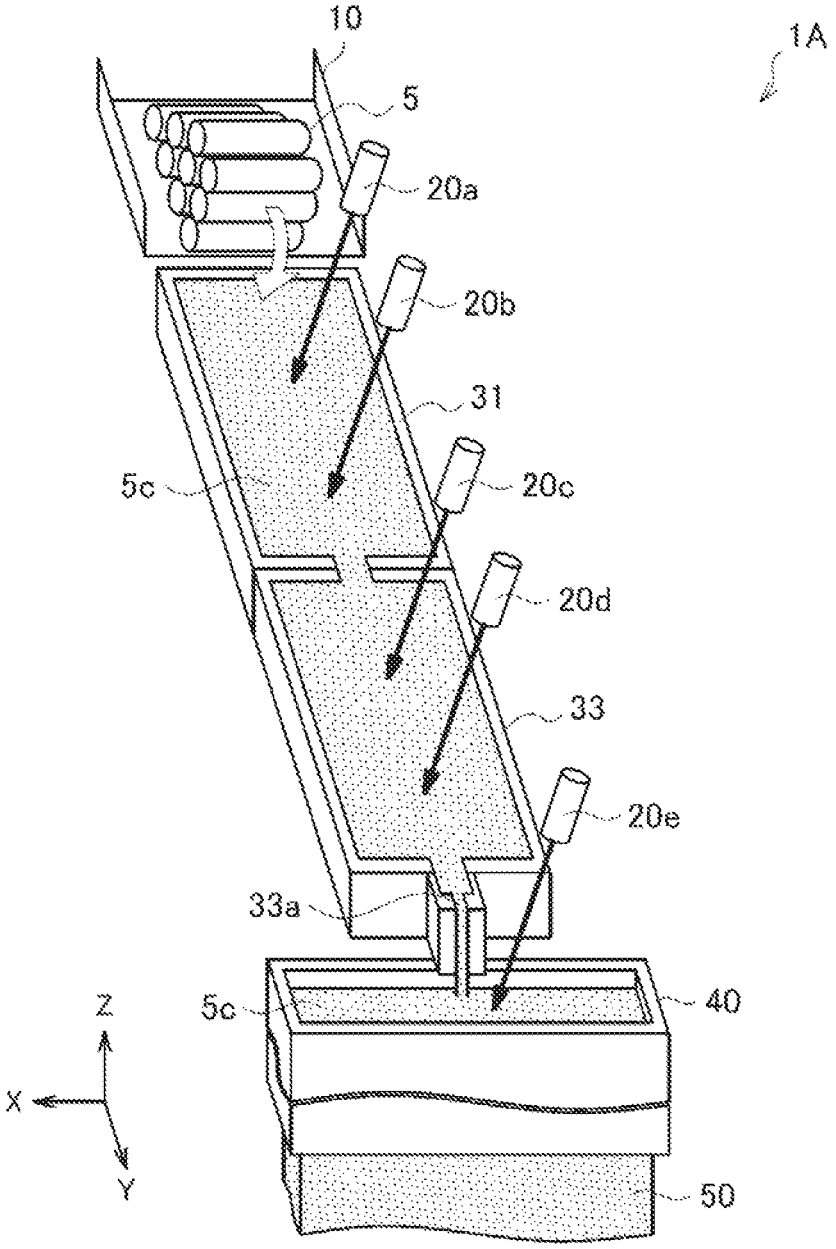
PRIOR ART FIG. 1
FIG. 1 is a schematic diagram illustrating an electron-beam melting furnace that includes a long hearth.
Figure 2:
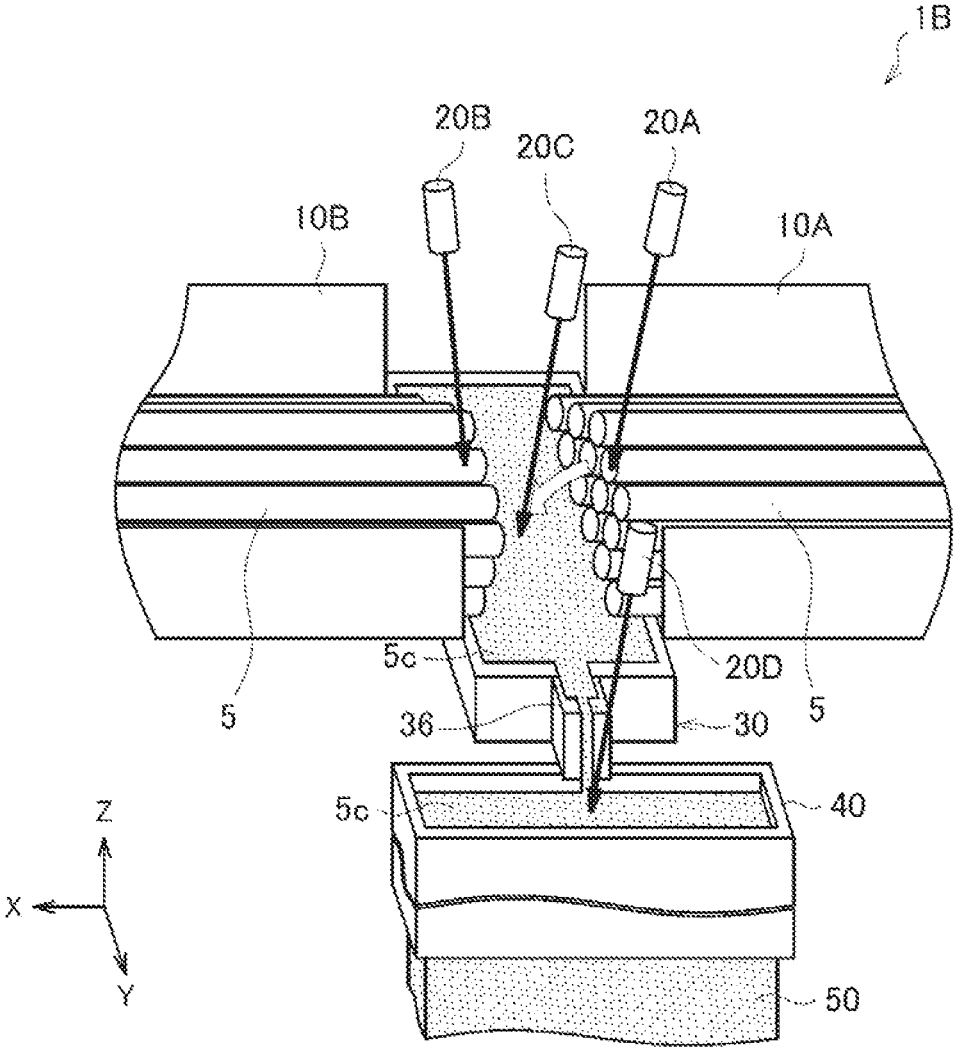
PRIOR ART FIG. 2
FIG. 2 is a schematic diagram illustrating an electron-beam melting furnace that includes a short hearth.

Hereunder, preferred embodiments of the present invention are described in detail while referring to the accompanying drawings. Note that, in the present specification and the accompanying drawings, constituent elements having substantially the same functional configuration are denoted by the same reference characters and a duplicate description thereof is omitted.

1. First Embodiment

First, a method for producing a metal ingot according to a first embodiment of the present invention will be described.

[1.1. Configuration of Electron-Beam Melting Furnace]

Figure 3:
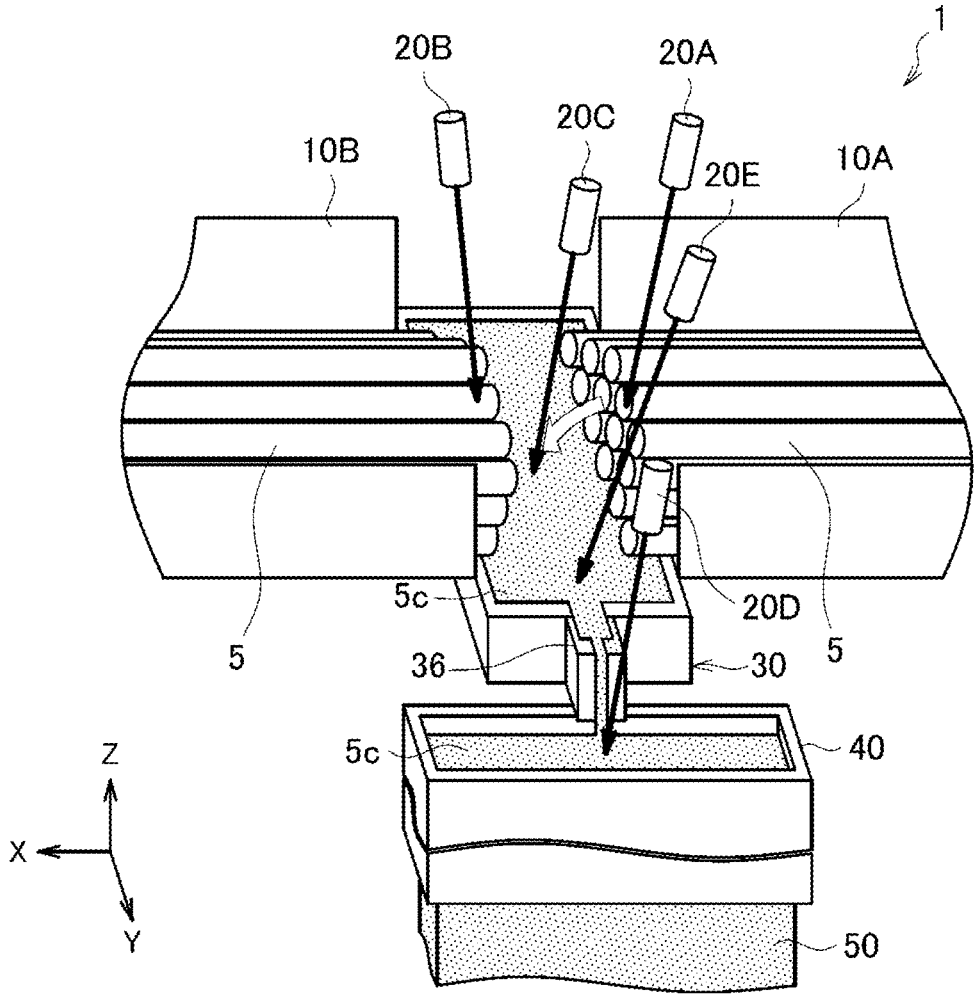
FIG. 3 is a schematic diagram illustrating an electron-beam melting furnace (short hearth) that implements a method for producing a metal ingot according to a first embodiment of the present invention.

First, referring to FIG. 3, the configuration of an electron-beam melting furnace for implementing the method for producing a metal ingot according to the present embodiment will be described. FIG. 3 is a schematic diagram illustrating the configuration of an electron-beam melting furnace 1 (hereunder, referred to as "EB furnace 1") according to the present embodiment.

As illustrated in FIG. 3, the EB furnace 1 includes a pair of raw material supplying portions 10A and 10B (hereunder, may be referred to generically as "raw material supplying portion 10"), a plurality of electron guns 20A to 20E (hereunder, may be referred to generically as "electron guns 20"), a refining hearth 30 and a mold 40. Thus, the EB furnace 1 according to the present embodiment includes only a single refining hearth 30 as a hearth, and the hearth structure in question is referred to as a "short hearth". Note that, although the method for producing a metal ingot of the present invention can be favorably applied to the EB furnace 1 with a short hearth as illustrated in FIG. 3, the method for producing a metal ingot of the present invention is also applicable to the EB furnace 1A that has a long hearth as illustrated in FIG. 1.

The refining hearth 30 (hereunder, referred to as "hearth 30") is an apparatus for refining a molten metal 5*c* of a metal raw material 5 (hereunder, referred to as "raw material 5") while accumulating the molten metal 5*c*, to thereby remove impurities contained in the molten metal 5*c*. The hearth 30 according to the present embodiment is constituted by, for example, a water-cooled copper hearth having a rectangular shape. A lip portion 36 is provided in a side wall at an end on one side in the longitudinal direction (Y direction) of the hearth 30. The lip portion 36 is an outlet for causing the molten metal 5*c* inside the hearth 30 to flow out into the mold 40.

The mold 40 is an apparatus for cooling and solidifying the molten metal 5*c* of the raw material 5, to thereby produce a metal ingot 50 (for example, a titanium ingot or titanium alloy ingot). The mold 40 is, for example, constituted by a water-cooled copper mold that has a rectangular tube shape. The mold 40 is disposed underneath the lip portion 36 of the hearth 30, and cools the molten metal 5*c* that is poured therein from the hearth 30 that is above the mold 40. As a result, the molten metal 5*c* within the mold 40 solidifies progressively toward the lower part of the mold 40, and a solid ingot 50 is formed.

The raw material supplying portion 10 is an apparatus for supplying the raw material 5 into the hearth 30. The raw material 5 is, for example, a titanium raw material such as titanium sponge or scrap. In the present embodiment, for example, as illustrated in FIG. 3, the pair of raw material supplying portions 10A and 10B are provided above a pair of side walls on the long sides of the hearth 30. The solid raw material 5 that has been conveyed from outside is placed in the raw material supplying portions 10A and 10B, and electron beams from the electron guns 20A and 20B are radiated onto the raw material 5.

Thus, in the present embodiment, in order to supply the raw material 5 into the hearth 30, the solid raw material 5 is melted by radiating electron beams onto the raw material 5 in the raw material supplying portion 10, and the melted raw material 5 (melted metal) is dripped into the molten metal 5*c* in the hearth 30 from inner edge portions of the raw material supplying portion 10. In other words, the raw material 5 is supplied into the hearth 30 by first melting the raw material 5 beforehand outside of the hearth 30, and then allowing the melted metal to drip into the molten metal 5*c* in the hearth 30. Drip lines that represent the positions at which the melted metal drips from the raw material supplying portion 10 onto the surface of the molten metal 5*c* in the hearth 30 in this way correspond to supply lines 26 that are described later (see FIG. 4).

Note that a method for supplying the raw material 5 is not limited to dripping as described in the aforementioned example. For example, the solid raw material 5 may be introduced as it is into the molten metal 5*c* in the hearth 30 from the raw material supplying portion 10. The introduced solid raw material 5 is then melted in the high-temperature molten metal 5*c* and thereby added to the molten metal 5*c*. In this case, introduction lines that represent the positions at which the solid raw material 5 is introduced into the molten metal 5*c* in the hearth 30 correspond to the supply lines 26 that are described later (see FIG. 4).

To implement an electron beam melting process, the electron guns 20 radiate electron beams onto the raw material 5 or the molten metal 5*c*. As illustrated in FIG. 3, the EB furnace 1 according to the present embodiment includes, for example, the electron guns 20A and 20B for melting the solid raw material 5 that was supplied to the raw material supplying portion 10, the electron gun 20C for maintaining the temperature of the molten metal 5*c* in the hearth 30, the electron gun 20D for heating the molten metal 5*c* at an upper part within the mold 40, and the electron gun 20E for inhibiting the outflow of impurities from the hearth 30. Each of the electron guns 20A to 20E is capable of controlling the radiation position of the electron beam. Therefore, the electron guns 20C and 20E are capable of radiating electron beams onto desired positions on the surface of the molten metal 5*c* in the hearth 30.

The electron guns 20A and 20B radiate electron beams onto the solid raw material 5 placed on the raw material supplying portion 10 to thereby heat and melt the raw material 5. The electron gun 20C heats the molten metal 5*c* and maintains the molten metal 5*c* at a predetermined temperature by radiating an electron beam over a wide range with respect to the surface of the molten metal 5*c* in the hearth 30. The electron gun 20D radiates an electron beam onto the surface of the molten metal 5*c* in the mold 40 to thereby heat the molten metal 5*c* at the upper part thereof and maintain the molten metal 5*c* that is at the upper part at a predetermined temperature so that the molten metal 5*c* at the upper part in the mold 40 does not solidify. The electron gun 20E radiates an electron beam in a concentrated manner along an irradiation line 25 (see FIG. 4) at the surface of the molten metal 5*c* in the hearth 30 in order to prevent an outflow of impurities from the hearth 30 to the mold 40.

Thus, the present embodiment is characterized in that the present embodiment prevents an outflow of impurities by, for example, radiating (line radiation) an electron beam in a concentrated manner along the irradiation line 25 at the surface of the molten metal 5*c* using the electron gun 20E. This characteristic will be described in detail later. Note that, in the EB furnace 1 according to the present embodiment, the electron gun 20E for line radiation as illustrated in FIG. 3 is provided separately from the other electron guns 20A to 20D. By this means, while utilizing the other electron guns 20A to 20D to melt the raw material 5 and maintain the temperature of the molten metal 5*c*, line radiation by the electron gun 20E can be continued concurrently and in parallel therewith, and therefore a decrease in the surface temperature of the molten metal 5*c* at the line radiation position can be prevented. However, the present invention is not limited to this example. For example, an electron beam may be radiated along the irradiation line 25 using one or a plurality of electron guns among the existing electron guns 20A and 20B for melting the raw material or the electron guns 20C and 20D for maintaining the temperature of the molten metal, and without additionally installing the electron gun 20E for line radiation. By this means, the number of electron guns installed in the EB furnace 1 can be decreased and the equipment cost can be reduced, and the existing electron guns can be effectively utilized.

[1.2. Outline of Method for Producing Metal Ingot]

Figure 4:
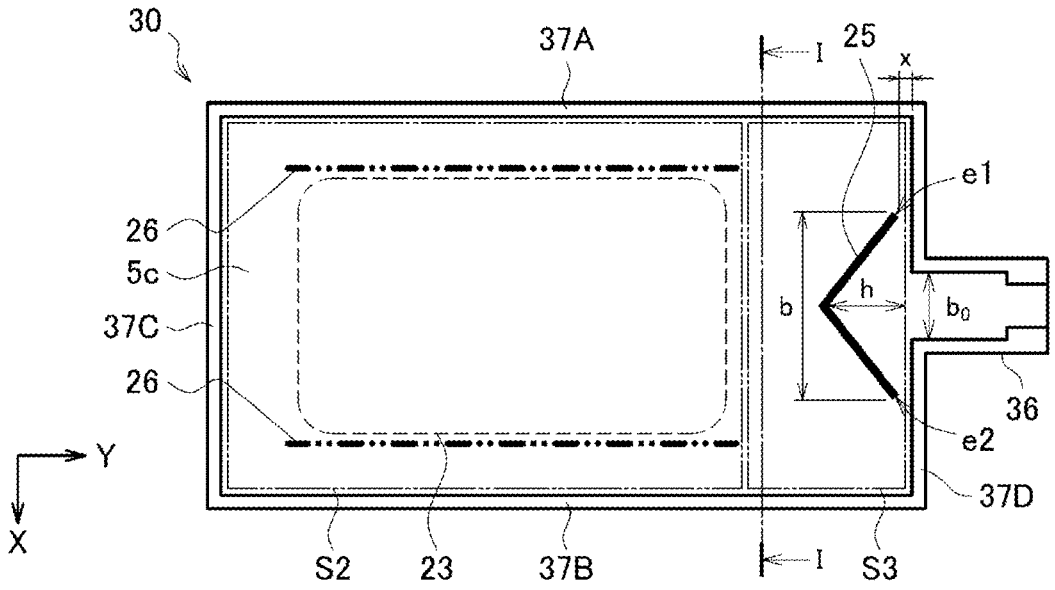
FIG. 4 is a plan view illustrating an example of an irradiation line and supply lines in a hearth according to the first embodiment of the present invention.
Figure 5:
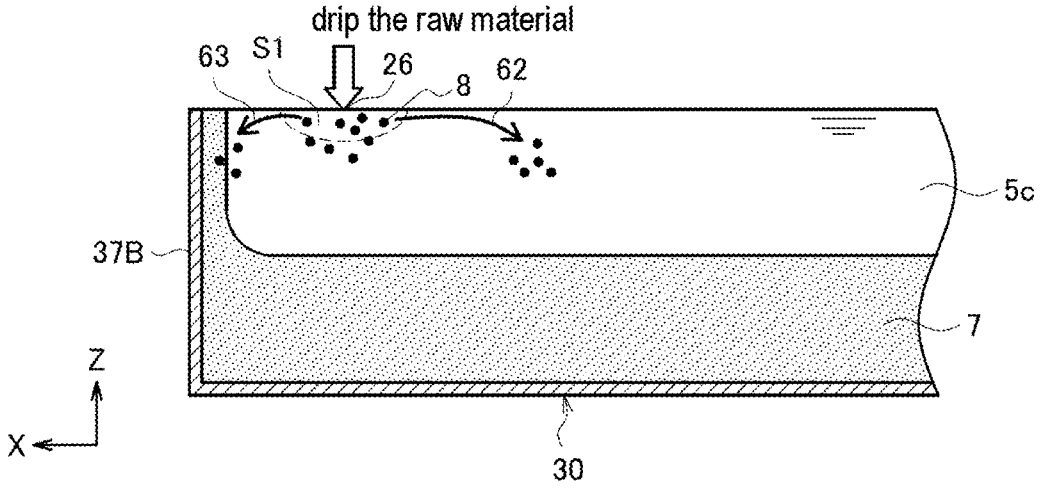
FIG. 5 is a partial cross-sectional view along a cutting-plane line I-I in FIG. 4.
Figure 6:
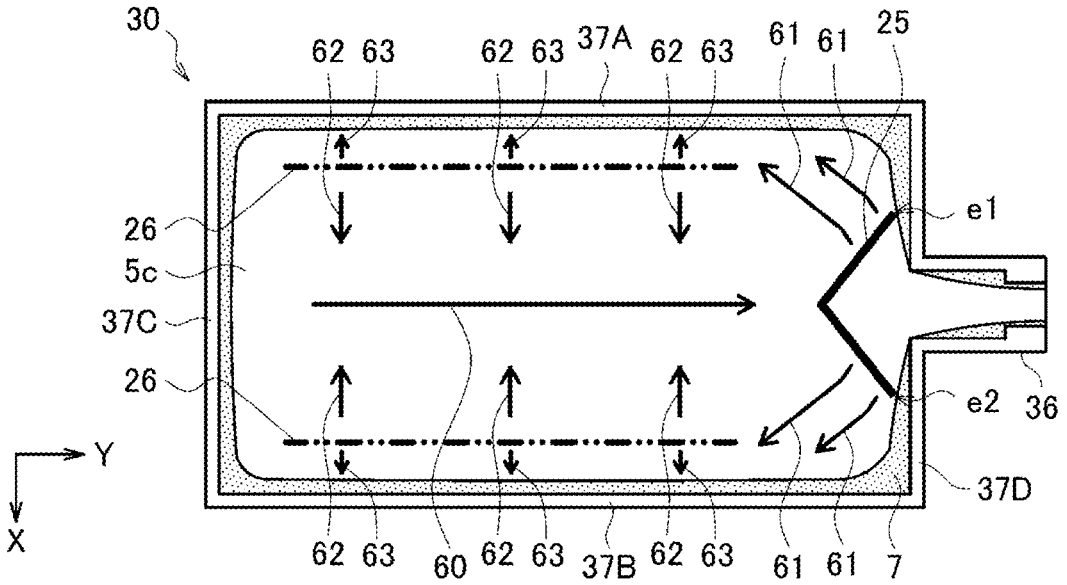
FIG. 6 is a plan view illustrating an example of a molten metal flow that is formed when an electron beam is radiated along an irradiation line according to the method for producing a metal ingot of the first embodiment of the present invention.

Next, an outline of the method for producing a metal ingot by an electron beam melting process according to the first embodiment of the present invention will be described based on FIG. 3 to FIG. 6. FIG. 4 is a plan view illustrating an example of the irradiation line 25 and the supply lines 26 in the hearth 30 according to the present embodiment. FIG. 5 is a partial cross-sectional view along a cutting-plane line I-I in FIG. 4. FIG. 6 is a plan view illustrating an example of a molten metal flow that is formed when an electron beam is radiated along the irradiation line according to the method for producing a metal ingot of the present embodiment. Note that, the plan views of FIG. 4 and FIG. 6 correspond to the hearth 30 of the electron-beam melting furnace 1 that is illustrated in FIG. 3.

An objective of the method for producing a metal ingot according to the present embodiment is to inhibit impurities contained in melted metal (the molten metal 5*c*) which was made by melting the solid raw material 5 from flowing into the mold 40 from the hearth 30, when producing a metal ingot 50 of commercially pure titanium or a titanium alloy or the like. According to the method for producing a metal ingot of the present embodiment, in particular, a titanium raw material as a metal raw material is taken as an object, and the method for producing a metal ingot solves the problem of inhibiting the occurrence of a situation in which LDIs that, among the impurities contained in the titanium raw material, have a density that is smaller than the relative of molten metal of titanium (molten titanium) become mixed into the ingot 50 of titanium or a titanium alloy. Note that, although a case in which the electron-beam melting furnace 1 with a short-hearth type illustrated in FIG. 3 is used is described hereunder, the present invention is not limited to this example, and can also be applied to the electron-beam melting furnace 1A of a long-hearth type that is illustrated in FIG. 1.

To achieve the aforementioned objective, in the method for producing a metal ingot according to the present embodiment, as illustrated in FIG. 4, the raw material 5 is supplied into the molten metal 5*c* in the hearth 30 at the supply lines 26 that are adjacent to side walls 37A and 37B on the long sides of the hearth 30. Further, an electron beam is radiated along the irradiation line 25 that is disposed so as to block the lip portion 36, with respect to the surface of the molten metal 5*c* that is being stored in the hearth 30.

The supply lines 26 are imaginary lines representing positions at which the raw material 5 is supplied from outside of the hearth 30 into the molten metal 5*c* in the hearth 30. The supply lines 26 are disposed on the surface of the molten metal 5*c* at positions along the respective inside faces of the side walls 37A and 37B of the hearth 30.

In the present embodiment, the melted raw material 5 is dripped into the hearth 30 from inner edge portions of the raw material supplying portion 10 disposed at an upper part of the side walls 37A and 37B on the long sides of the hearth 30 as illustrated in FIG. 3. Therefore, the respective supply lines 26 are positioned at the surface of the molten metal 5*c* in the hearth 30 below the inner edge portions of the raw material supplying portion 10, and have a linear shape which extends along the inside face of the respective side walls 37A and 37B. Note that, the supply lines 26 need not be in a strictly straight-line shape along the inside faces of the side walls 37A, 37B and 37C of the hearth 30, and for example, may be in a broken-line shape, a dotted-line shape, a curve shape, a wavy line shape, a zigzag shape, a double line shape, a belt shape, a polygonal line shape or the like.

The irradiation line 25 (corresponds to "irradiation line" of the present invention) is an imaginary line that represents the path of positions at which an electron beam (corresponds to "first electron beam" of the present invention) is radiated in a concentrated manner onto the surface of the molten metal 5*c* in the hearth 30. The irradiation line 25 is disposed on the surface of the molten metal 5*c* so as to block the lip portion 36. Two end portions e1 and e2 of the irradiation line 25 are positioned in the vicinity of a side wall 37A, 37B, 37C or 37D (hereunder, may also be referred to generically as "side wall(s) 37") of the hearth 30. The irradiation line 25 need not be in a strictly straight-line shape, and, for example, may be in a broken-line shape, a dotted-line shape, a curve shape, a wavy line shape, a zigzag shape, a double line shape, a belt shape, a polygonal line shape or the like.

The disposition of the irradiation line 25 and the supply lines 26 will now be described in further detail. As illustrated in FIG. 4, the rectangular hearth 30 according to the present embodiment has four side walls 37A, 37B, 37C and 37D. The pair of side walls 37A and 37B that face each other in the X direction constitute a pair of long sides of the hearth 30, and are parallel to the longitudinal direction (Y direction) of the hearth 30. In other words, among the side walls 37, the side walls 37A and 37B extend substantially perpendicularly toward upstream from the side wall 37D in which the lip portion 36 is provided. Further, the pair of side walls 37C and 37D that face each other in the Y direction constitute a pair of short sides of the hearth 30, and are parallel to the width direction (X direction) of the hearth 30. Here, the term "substantially perpendicularly" derives from the fact that a hearth that is typically used is rectangular, and a given side wall and a side wall that is adjacent to the given side wall intersect substantially perpendicularly. In other words, the term "substantially perpendicularly" does not indicate a strictly perpendicular state, and an error within a range in which use as a hearth is generally possible is permitted. A permissible angular error from a perpendicular state is, for example, within a range of 5°.

The lip portion 36 for causing the molten metal 5*c* in the hearth 30 to flow out into the mold 40 is provided in the side wall 37D that is one of the short sides. On the other hand, the lip portion 36 is not provided in the three side walls 37A, 37B and 37C that are the side walls other than the side wall 37D. Therefore, the side wall 37D corresponds to a "first side wall" provided with a lip portion, and the side walls 37A, 37B and 37C correspond to "side walls" in which the lip portion 36 is not provided.

In the example illustrated in FIG. 4, the two rectilinear supply lines 26 are disposed along the side walls 37A and 37B, on the surface of the molten metal 5*c* in the hearth 30. In addition, the irradiation line 25 is disposed so as to block the lip portion 36 on the downstream side in the longitudinal direction (Y direction) of the hearth 30 relative to the supply lines 26. In the present invention, in the longitudinal direction (Y direction) of the hearth 30, a region that includes the supply lines 26 and that does not come in contact with the lip portion 36 is referred to as "upstream region S2". Further, in the longitudinal direction (Y direction) of the hearth 30, a region between the upstream region S2 and the side wall 37D in which the lip portion 36 is provided is referred to as "downstream region S3". In the following description, the region inside the hearth 30 is described in a manner in which the region is divided into the upstream region S2 and the downstream region S3 by a straight line that links end points on the lip portion 36 side of the two supply lines 26.

The irradiation line 25 is disposed in the downstream region S3. The two end portions e1 and e2 of the irradiation line 25 are located in the vicinity of the side wall 37A, 37B, 37C or 37D of the hearth 30. In the example illustrated in FIG. 4, the end portions e1 and e2 are located in the vicinity of the side wall 37D. As used here, the phrase "the end portions e1 and e2 are located in the vicinity of the side wall 37" means that the end portions e1 and e2 are located at the inside face of the side wall 37 or in a region in which a separation distance x from the inside face of the side wall 37 is not more than 5 mm. The first electron beam is radiated onto the relevant region. Note that, a solidified layer called a "skull" 7 in which the molten metal 5*c* solidified is formed on the inside face of the side walls 37 of the hearth 30 (see FIG. 5 and FIG. 6). The formation of the skull 7 in the vicinity of the side walls 37 does not constitute a problem, and the first electron beam may be radiated onto the skull 7.

In the present embodiment, a special temperature gradient is formed at the surface of the molten metal 5*c* in the hearth 30 by radiating an electron beam in a concentrated manner along the irradiation line 25 on the surface of the molten metal 5*c* as mentioned above, and flowage of the molten metal 5*c* is thereby controlled. The temperature distribution on the surface of the molten metal 5*c* in the hearth 30 will now be described.

In general, in the electron beam melting process, in order to prevent the molten metal 5*c* in the hearth 30 from solidifying, an electron beam is uniformly radiated by, for example, the electron gun 20C onto a heat-retention radiation region 23 that occupies a wide area of the surface of the molten metal 5*c*, to thereby maintain the temperature of the molten metal 5*c* in the hearth 30. By performing such radiation of an electron beam for heat retention, all of the molten metal 5*c* accumulated in the hearth 30 is heated, and an average surface temperature T0 (hereunder, referred to as "molten metal surface temperature T0") of the entire surface of the molten metal 5*c* is maintained at a predetermined temperature. The molten metal surface temperature T0 is for example, in the range of 1923 (melting point of titanium alloy) to 2323 K, and preferably is in the range of 1973 to 2273 K.

In the present embodiment, at the aforementioned raw material supplying portion 10, electron beams are radiated onto the solid raw material 5 by the electron guns 20A and 20B to melt the raw material 5, and the melted metal of a high temperature that was melted drips onto the positions of the supply lines 26 of the molten metal 5*c* in the hearth 30 to thereby supply the raw material 5 to the hearth 30. Therefore, among the entire molten metal 5*c* in the hearth 30, impurities such as LDIs contained in the raw material 5 are mainly present in the vicinity of the supply lines 26. Further, because the high-temperature melted metal is supplied continuously or discontinuously to the supply lines 26, a high temperature region (see region S1 in FIG. 5) having a surface temperature T1 that is higher than the aforementioned molten metal surface temperature T0 is formed in the vicinity of the supply lines 26. The surface temperature T1 (hereunder, referred to as "raw material supplying temperature T1") of the molten metal 5*c* at the supply lines 26 is approximately the same as the temperature of the melted metal that is dripped from the raw material supplying portion 10 into the hearth 30, and is higher than the aforementioned molten metal surface temperature T0 (T1>T0). The raw material supplying temperature T1 is, for example, within the range of 1923 to 2423 K, and preferably within the range of 1973 to 2373 K.

In addition, according to the method for producing a metal ingot of the present embodiment, separately to radiation of the aforementioned electron beam for heat retention onto the heat-retention radiation region 23 of the molten metal 5*c*, an electron beam is radiated in a concentrated manner by the electron gun 20E onto the molten metal 5*c* along the irradiation line 25. By means of this concentrated radiation of the electron beam, a high temperature region having a surface temperature T2 that is higher than the aforementioned molten metal surface temperature T0 is formed in the downstream region S3 so as to block the lip portion 36. The surface temperature T2 (hereunder, referred to as "line radiation temperature T2") of the molten metal 5*c* at the irradiation line 25 is higher than the aforementioned molten metal surface temperature T0 (T2>T0). In addition, in order to more reliably inhibit an outflow of impurities, preferably the line radiation temperature T2 is higher than the aforementioned raw material supplying temperature T1 (T2>T1>T0). The line radiation temperature T2 is, for example, within a range of 1923 to 2473 K, and preferably is within a range of 1973 to 2423 K.

Thus, according to the method for producing a metal ingot of the present embodiment, by radiating an electron beam along the irradiation line 25 on the surface of the molten metal 5*c*, a high temperature region of the molten metal 5*c* is also formed in the vicinity of the irradiation line 25, and not just the vicinity of the supply lines 26. By this means, as illustrated in FIG. 6, in the outer layer of the molten metal 5*c*, a molten metal flow 61 (corresponds to "molten metal flow" of the present invention) can be forcibly formed from the irradiation line 25 toward upstream (that is, toward the negative side in the Y direction) that is the direction on the opposite side to the side wall 37D. In particular, by maintaining the temperature of the molten metal 5*c* at a temperature higher than T0 at arbitrary positions of the irradiation line 25, the molten metal flow 61 that is formed can be constantly maintained.

The molten metal 5*c* that is accumulated in the hearth 30 is refined while residing in the hearth 30, and thereafter flows out from the lip portion 36 and is discharged into the mold 40. As illustrated in FIG. 6, at a central part in the width direction (X direction) inside the hearth 30, a molten metal flow 60 that flows along the longitudinal direction (Y direction) of the hearth 30 is formed from the vicinity of the side wall 37C that is one of the short sides toward the lip portion 36. By means of this molten metal flow 60, the molten metal 5*c* that is being accumulated inside the hearth 30 flows from the lip portion 36 into the mold 40. Impurities are categorized as HDIs (not illustrated) that have a high relative density compared to the molten metal 5*c*, and LDIs 8 that have a low relative density compared to the molten metal 5*c*. The HDIs that have a high relative density settle in the molten metal 5*c* and adhere to the skull 7 that is formed on the bottom face of the hearth 30, and hence the possibility of HDIs flowing out into the mold 40 from the lip portion 36 is low. On the other hand, a major portion of the LDIs 8 that have a low relative density float on the surface of the molten metal 5*c* and, as illustrated in FIG. 5, move by riding on the flow at the outer layer of the molten metal 5*c*.

According to the method for producing a metal ingot of the present embodiment, an electron beam is radiated onto the surface of the molten metal 5*c* in the hearth 30 along the irradiation line 25 which has the two end portions e1 and e2 located at the side wall 37 of the hearth 30 and which is disposed so as to block the lip portion 36. By this means, the Marangoni convection is generated by a temperature gradient at the surface of the molten metal 5*c*, and as illustrated in FIG. 6, an outer layer flow of the molten metal 5*c* (molten metal flow 61) toward upstream from the irradiation line 25 is formed in the outer layer of the molten metal 5*c*. The molten metal flow 61 prevents the LDIs 8 from flowing out into the mold 40, by causing the LDIs 8 that float on the surface of the molten metal 5*c* in the hearth 30 to move in a direction away from the lip portion 36.

When a temperature gradient arises at the surface of a fluid, a gradient also arises in the surface tension of the fluid, and such a gradient causes the occurrence of convection in the fluid. Such convection in the fluid is called "Marangoni convection". In main metals that are typified by titanium, the Marangoni convection is a flow from a high temperature region toward a low temperature region.

A case will now be considered in which, when the raw material 5 is dripped along the supply lines 26 into the molten metal 5*c* in the hearth 30 as illustrated in FIG. 4, the temperature of the melted metal (the raw material supplying temperature T1) that is dripped along the supply lines 26 is already higher than the temperature T0 of the molten metal which has already accumulated in the hearth 30. In this case, as illustrated in FIG. 5, the region S1 in the vicinity of the supply lines 26 at which the melted raw material 5 (melted metal) is dripped is a high temperature region in which the temperature is higher than the temperature of the molten metal 5*c* in other regions. Therefore, as illustrated in FIG. 5 and FIG. 6, in the outer layer of the molten metal 5*c*, a molten metal flow 63 from the region S1 toward the side wall 37B, and a molten metal flow 62 from the region S1 toward the central part in the width direction (X direction) of the hearth 30 are formed.

Thus, as illustrated in FIG. 6, the LDIs 8 contained in the melted metal that is dripped onto the supply lines 26 ride on the molten metal flow 62 and flow toward the central part in the width direction (X direction) of the hearth 30, and also ride on the molten metal flow 63 and flow toward the side wall 37B of the hearth 30. The molten metal flows 62 that flow toward the central part of the hearth 30 from each of the pair of left and right supply lines 26 collide at the central part in the width direction of the hearth 30, thereby forming the molten metal flow 60 (see FIG. 6) toward the lip portion 36 along the longitudinal direction (Y direction) of the hearth 30. As a result, the LDIs 8 floating in the molten metal 5*c* also ride on the molten metal flow 60 and flow toward the lip portion 36. Therefore, to ensure that impurities such as the LDIs 8 do not flow out from the lip portion 36 to the mold 40, it is preferable that an outer layer flow of the molten metal 5*c* is formed that pushes the LDIs which are riding on the molten metal flow 60 and flowing toward the lip portion 36 back to the upstream side of the hearth 30 and thus keeps the LDIs away from the lip portion 36.

Therefore, according to the method for producing a metal ingot of the present embodiment, as illustrated in FIG. 4 and FIG. 6, an electron beam is radiated onto the surface of the molten metal 5*c* along the V-shaped irradiation line 25 whose two end portions e1 and e2 are positioned in the vicinity of the side wall 37D and which projects to the upstream side so as to block the lip portion 36. By this means, a surface temperature T2 of the molten metal 5*c* in the region in the vicinity of the irradiation line 25 is increased, and a temperature gradient is generated in the surface temperature of the molten metal 5*c* between the region in the vicinity of the irradiation line 25 and the heat-retention radiation region 23. As a result, Marangoni convection occurs, and as illustrated in FIG. 6, in the outer layer of the molten metal 5*c*, the molten metal flow 61 arises toward the upstream side from the irradiation line 25. By means of the molten metal flow 61, the flow of impurities such as LDIs is controlled, and impurities that have flowed to the downstream side toward the lip portion 36 are pushed back to a position that is further on the upstream side relative to the irradiation line 25. By this means, impurities can be inhibited from flowing out from the lip portion 36.

At such a time, for example, by making the irradiation line 25 a shape that projects to the upstream side such as a V-shape as illustrated in FIG. 4 and FIG. 6, Marangoni convection can be generated such that the molten metal flow 61 toward the lip portion 36 flows toward the side walls 37A and 37B of the hearth 30. In other words, in FIG. 6, the molten metal flow 61 is a flow that is toward the upstream (direction away from the lip portion 36) in the Y-axis direction and is also toward a direction away from the lip portion 36 in the X-axis direction. Thus, the molten metal flow 61 moves impurities such as LDIs that are floating on the surface of the molten metal 5*c* in regions in the vicinity of the supply lines 26 in a direction that is toward the upstream side relative to the irradiation line 25 and is also toward the side walls 37A and 37B of the hearth 30.

Some of the LDIs 8 that moved toward the side walls 37A and 37B adhere to the skull 7 formed on the inside faces of the side walls 37 of the hearth 30 and therefore no longer move in the molten metal 5*c* in the hearth 30. Alternatively, the LDIs 8 gradually dissolve while circulating inside the hearth 30. In particular, because the molten metal 5*c* in the vicinity of the irradiation line 25 is at a high temperature, melting of the LDIs 8 is promoted. Thus, by radiating an electron beam along the irradiation line 25, not only impurities are blocked and held back at the irradiation line 25, but the impurities are also caused to be trapped by the skull 7 formed on the inside faces of the side walls 37A and 37B, or dissolving of nitrided titanium or the like that is a principal component of the LDIs 8 is promoted, and thus the occurrence of an outflow of impurities from the lip portion 36 can be inhibited.

Thus, according to the method for producing a metal ingot of the present embodiment, an electron beam is radiated along the irradiation line 25 that is on the downstream side from the supply lines 26. By this means, the molten metal flow 61 is formed toward upstream from the high temperature region of the molten metal 5*c* in the vicinity of the irradiation line 25, and as a result impurities such as LDIs that have flowed toward the lip portion 36 side are pushed back to the upstream side relative to the irradiation line 25. Therefore, the impurities can be inhibited from flowing out from the hearth 30 into the mold 40. As a result, mixing of the impurities into an ingot can be inhibited.

[1.3. Disposition of Irradiation Line]

Next, the disposition of the irradiation line 25 along which an electron beam is radiated in a concentrated manner will be described in detail.

In the method for producing a metal ingot according to the present embodiment, as illustrated in FIG. 4, an electron beam is radiated along the irradiation line 25 that is disposed in the downstream region S3 between the upstream region S2 that includes the supply lines 26 and the side wall 37D. The supply lines 26 are imaginary lines representing positions at which melted metal of the raw material 5 is dripped into the molten metal 5*c* in the hearth 30. The irradiation line 25 is an imaginary line that corresponds to a radiation path of an electron beam that is emitted by the electron gun 20E for line radiation.

In the method for producing a metal ingot according to the present embodiment, as illustrated in FIG. 6, the irradiation line 25 is in a V-shape that has the two end portions e1 and e2 positioned at the side wall 37D and that projects toward the upstream side so as to block the lip portion 36. By radiating the electron beam onto the surface of the molten metal 5*c* along this irradiation line 25, the molten metal flow 61 toward upstream from the irradiation line 25 is generated. As a result, the molten metal flow 60 toward the lip portion 36 is pushed back toward the upstream, and impurities such as LDIs can be inhibited from flowing out from the hearth 30 into the mold 40.

At such time, it is preferable to appropriately set the disposition of the irradiation line 25 so that the molten metal flow 60 from the center of the hearth 30 toward the lip portion 36 does not pass through the irradiation line 25 and flow toward the lip portion 36. Therefore, according to the method for producing a metal ingot of the present embodiment, the irradiation line 25 is used to reliably partition the upstream region S2 in which the supply lines 26 are disposed and the lip portion 36. For this purpose, the two end portions e1 and e2 of the irradiation line 25 are positioned in the vicinity of the side wall 37. The phrase "the end portions e1 and e2 are positioned in the vicinity of the side wall 37" means that the end portions e1 and e2 are positioned at the inside face of the side wall 37 or in a region separated from the inside face of the side wall 37 by a separation distance x that is not more than 5 mm. When the end portions e1 and e2 are within the aforementioned region, impurities such as LDIs do not pass through a space between the side wall 37 and the end portions e1 and e2 of the irradiation line 25, and a flow path from the upstream region S2 to the lip portion 36 can be reliably blocked. Note that, as mentioned above, the formation of the skull 7 in the vicinity of the side walls 37 does not constitute a problem, and the first electron beam may be radiated onto the skull 7.

Further, it is necessary that a width b of the irradiation line 25 in the X direction in FIG. 4 (hereunder, referred to as "irradiation line width") is made at least greater than an opening width b0 of the lip portion 36. If the irradiation line width b is less than the opening width b0 of the lip portion 36, there is a possibility that a flow of the outer layer of the molten metal 5*c* from the upstream region S2 toward the lip portion 36 will arise at a portion at which the electron beam is not radiated, and LDIs will flow out to mold 40 side. Note that, the irradiation line width b may be smaller than the width of the hearth 30, and the time required for scanning the irradiation line 25 one time lengthens as the irradiation line width b increases. When the time required for scanning the irradiation line 25 one time lengthens, the molten metal flow 61 toward the side walls of the hearth 30 produced by radiation of the electron beam weakens, and the possibility of LDIs flowing out to the lip portion 36 increases.

In addition, an irradiation line height h which is the height by which the irradiation line 25 projects toward the upstream is determined by taking into account the molten metal flow 61 formed by radiation of the relevant electron beam and the scanning time. Here, the irradiation line height h is taken as the distance from the vertex of the irradiation line 25 to a point of intersection between a straight line that links the two end portions e1 and e2 of the irradiation line 25 and a straight line extending in the Y direction and passing through the vertex of the irradiation line 25. As the irradiation line height h increases, the greater the degree to which molten metal flow 61 formed by radiation of an electron beam along the irradiation line 25 having a V-shape as illustrated in FIG. 4 becomes a flow toward the side walls 37A and 37B of the hearth 30, while on the other hand, the longer the time required to scan the irradiation line 25 one time becomes. Therefore, it is preferable to set the irradiation line height h so that the time required for scanning becomes as short as possible while also directing the molten metal flow 61 toward the side walls 37A and 37B.

In the method for producing a metal ingot according to the present embodiment, the position of the vertex of the irradiation line 25 is not limited to a position that is set on a straight line that passes through the center of the width of the hearth 30 (hereunder, also referred to as "center line") as illustrated in FIG. 4. However, it is desirable that the vertex of the irradiation line 25 and the center of the width of the opening of the lip portion 36 are on the center line of the hearth 30, as illustrated in FIG. 4. By providing the vertex of the irradiation line 25 on the center line, as illustrated in FIG. 6, the molten metal flow 61 can be made symmetric with respect to the center line. By radiating an electron beam in this manner, the orientation of the flow of the outer layer of the molten metal 5*c* can be oriented toward the side walls 37A and 37B that are at a short distance from the irradiation line 25, and the likelihood of causing impurities such as LDIs to adhere to the skull 7 can be increased.

Figure 7:
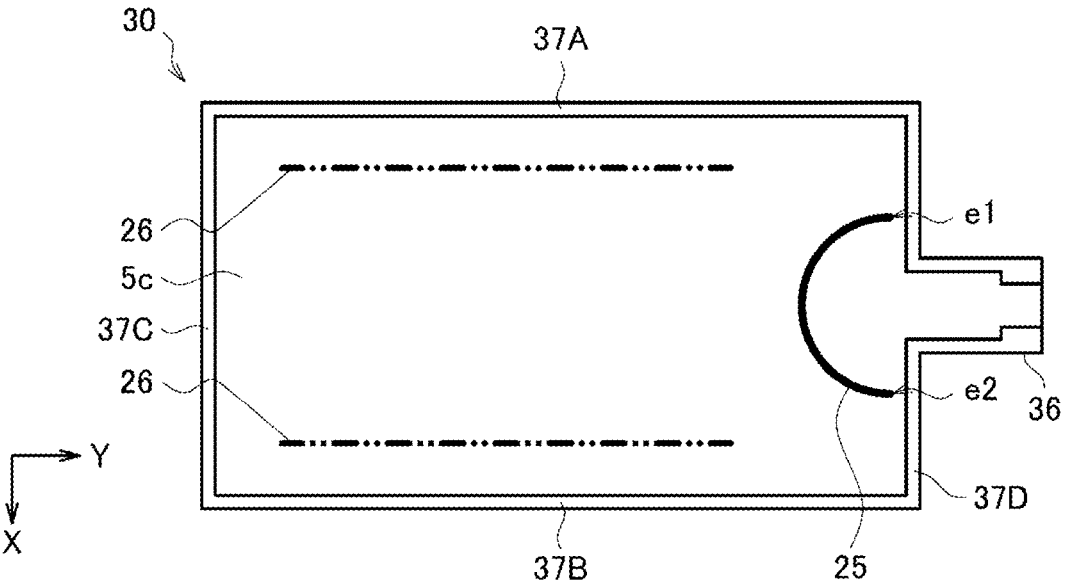
FIG. 7 is a plan view illustrating an example of an irradiation line according to the first embodiment of the present invention.

As long as the irradiation line 25 of the electron beam of the method for producing a metal ingot according to the present embodiment is in a convex shape that projects to the upstream side from the lip portion 36, the irradiation line 25 may be in a shape other than the V-shape illustrated in FIG. 4. For example, the irradiation line 25 may be in a curved shape such as a parabola. Alternatively, the irradiation line 25 may be in a substantially semicircular arc shape as illustrated in FIG. 7, for example. In this case, the arc-shaped irradiation line 25 has a diameter that is equal to or greater than the opening width $b_0$ of the lip portion 36. Specifically, as illustrated in FIG. 7, the arc-shaped irradiation line 25 is set so as to have its center on a straight line that passes through the center of the opening width of the lip portion 36, and so as to be one part of a circle having a diameter that is equal to or larger than the opening width $b_0$ of the lip portion 36.

In this case also, similarly to FIG. 4, in a case where the temperature of the raw material 5 that is dripped at the supply lines 26 is a higher temperature than the temperature of the molten metal 5*c* that is already accumulated in the hearth 30, molten metal flows that correspond to the molten metal flows 60, 61 and 62 illustrated in FIG. 6 are formed. In other words, the molten metal flows of the raw material 5 that is dripped at the respective supply lines 26 each flow toward the center in the width direction (X direction) of the hearth 30, and these molten metal flows 62 collide with each other at the center in the width direction (X direction) of the hearth 30 and thereby form the molten metal flow 60 that flows toward the lip portion 36.

Further, the irradiation line 25 is set so that the two end portions e1 and e2 are positioned in the vicinity of the side wall 37D, and the irradiation line 25 blocks the lip portion 36. An electron beam is radiated onto the surface of the molten metal 5*c* along the irradiation line 25 that is set in this manner. By this means, Marangoni convection is generated, and the molten metal flow 60 that is flowing toward the lip portion 36 is led to the upstream side of the hearth 30 in the directions toward the side walls 37A and 37B. As a result, LDIs are caused to adhere to the skull 7 formed on the side walls 37 of the hearth 30, and the LDIs can thus be prevented from moving through the molten metal 5*c*. Alternatively, the LDIs can also be caused to dissolve while circulating through the molten metal 5*c* that is accumulated in the hearth 30.

Note that, the actual radiation position at which the electron beam is irradiated with respect to the irradiation line 25 need not be strictly on the irradiation line 25. It suffices that the actual radiation position at which the electron beam is radiated is approximately on the irradiation line 25 that is set as the target, and a problem does not arise as long as the actual radiation path of the electron beam is within a control deviation range from the irradiation line 25 that is set as the target. Further, the two end portions e1 and e2 of the irradiation line 25 are positioned in the vicinity of the inside face of the side wall 37 of the hearth 30. The phrase "end portions e1 and e2 are positioned in the vicinity of the side wall 37" means that the end portions e1 and e2 are positioned at the inside face of the side wall 37 or in a region in which a separation distance x from the inside face of the side wall 37 is not more than 5 mm. The end portions e1 and e2 of the irradiation line 25 are set in the region in question, and an electron beam is radiated along the irradiation line 25, and the formation of the skull 7 on the inside face of the side walls 37 of the hearth 30 does not constitute a problem, and the electron beam may be radiated onto the skull 7.

Furthermore, in the method for producing a metal ingot according to the present embodiment, as long as the disposition of the irradiation line 25 of the electron beam is such that, within the downstream region S3, "the two end portions e1 and e2 are in the vicinity of the side wall 37 (any one of 37A, 37B, 37C and 37D)" and "the irradiation line 25 blocks the lip portion 36 (such that the upstream region S2 and the lip portion 36 are reliably partitioned by the irradiation line 25)", any arbitrary form can be adopted with respect to the disposition of the irradiation line 25. The forms illustrated in FIG. 4 and FIG. 7 are merely illustrative examples, and a form in which the irradiation line 25 is separated from the side wall 37D more than in the aforementioned examples is also acceptable.

Figure 8:
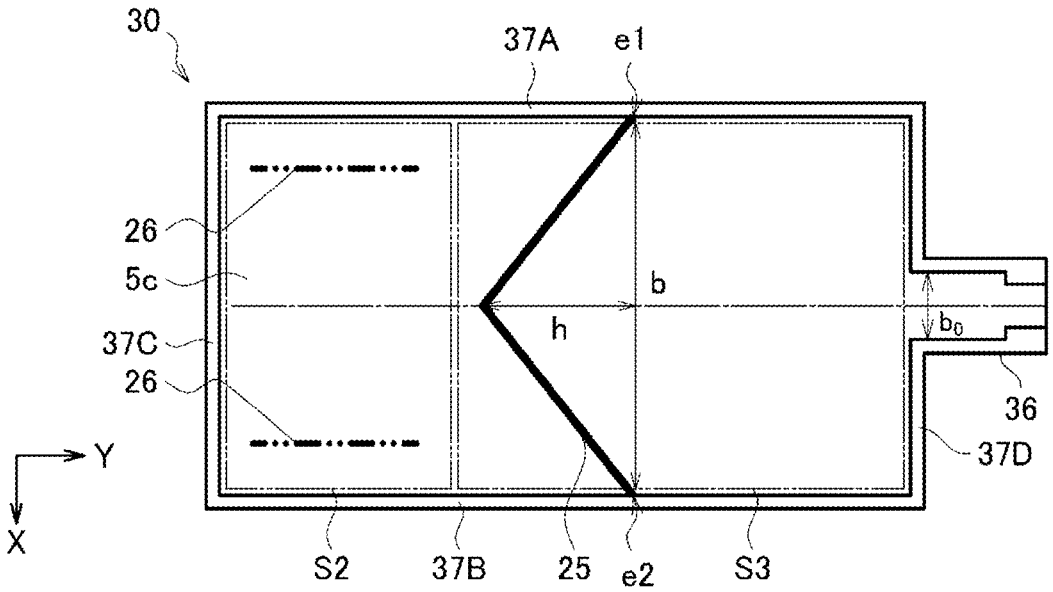
FIG. 8 is an explanatory drawing illustrating another example of an irradiation line according to the first embodiment of the present invention.

For example, as illustrated in FIG. 8, in a case where the upstream region S2 containing the supply lines 26 is disposed on the upstream side in the longitudinal direction of the hearth 30, the downstream region S3 between the upstream region S2 and the side wall 37D is wider than in the case illustrated in FIG. 4. However, since it is possible to dispose the irradiation line 25 at any location as long as the irradiation line 25 is in the downstream region S3, as illustrated in FIG. 8, it is also possible to dispose the irradiation line 25 at the central part in the longitudinal direction of the hearth 30. At this time, the two end portions e1 and e2 of the irradiation line 25 may be positioned at the side walls 37A and 37B. From the viewpoint of more reliably preventing LDIs 8 from flowing out into the mold 40 from the hearth 30, it is preferable to position the two end portions e1 and e2 of the irradiation line 25 at the side wall 37D in which the lip portion 36 is provided, as illustrated in FIG. 4 and the like. By this means, the scanning distance of the electron beam is shortened, and the time required to scan the irradiation line 25 one time can be shortened. As a result, the temperature of the molten metal 5*c* at the irradiation line 25 can be efficiently raised, and the molten metal flow 61 toward upstream from the irradiation line 25 can be formed earlier in the outer layer of the molten metal 5*c*.

[1.4. Settings of Electron Beam for Line Radiation]

Next, the settings with respect to the electron beam for line radiation (first electron beam) that is radiated in a concentrated manner along the aforementioned irradiation line 25 will be described.

In order to push back the molten metal flow 62 from the supply lines 26 (see FIG. 6) toward the upstream of the hearth 30 by means of the molten metal flow 61 from the irradiation line 25 (see FIG. 6) as mentioned above, it is preferable to appropriately set the radiation conditions such as the heat transfer amount, the scanning speed and the heat flux distribution of the electron beam for line radiation.

The heat transfer amount [W] of the electron beam is a parameter that influences an increase in the temperature of the molten metal 5*c* at the irradiation line 25, and the flow velocity of the Marangoni convection (the molten metal flow 61) that occurs due to the temperature increase in question. If the heat transfer amount of the electron beam is small, a molten metal flow 61 that overcomes the bulk flow of the molten metal 5*c* cannot be formed. Accordingly, the larger that the heat transfer amount of the electron beam is, the more preferable it is, and for example, the heat transfer amount is in the range of 0.15 to 0.60 [MW].

The scanning speed [m/s] of the electron beam is a parameter that influences the flow velocity of the aforementioned molten metal flow 61. When radiating an electron beam along the irradiation line 25, the irradiation line 25 on the surface of the molten metal 5*c* is repeatedly scanned with an electron beam emitted from the electron gun 20E. If the scanning speed of the electron beam at such time is slow, positions at which the electron beam is not radiated for a long time will arise on the irradiation line 25. The surface temperature of the molten metal 5*c* will rapidly decrease at a position at which the electron beam is not radiated, and the flow velocity of the molten metal flow 61 that arises from the position in question will decrease. In such a case, it will be difficult to suppress the molten metal flow 60 by means of the molten metal flow 61, and the possibility that the molten metal flow 60 will pass through the irradiation line 25 will increase. Therefore, the scanning speed of the electron beam is preferably as fast as possible, and for example is within a range of 1.0 to 20.0 [m/s].

The heat flux distribution at the surface of the molten metal 5*c* that is produced by the electron beam is a parameter that influences the heat transfer amount imparted to the molten metal 5*c* from the electron beam. The heat flux distribution corresponds to the size of the aperture of the electron beam. The smaller that the aperture of the electron beam is, the greater the degree to which a steep heat flux distribution can be imparted to the molten metal 5*c*. The heat flux distribution at the surface of the molten metal 5*c* is, for example, represented by the following Formula (1) (for example, see Non-Patent Document 1). The following Formula (1) represents that a heat flux is exponentially attenuated in accordance with the distance from the electron beam spot.

[Expression 1]

$$q(t, x, y) = q_0 \exp\left(-\frac{(x - x_o)^2 + (y - y_o)^2}{2\sigma^2}\right) \quad (1)$$

$$\int\int_{all\ surface} q dx dy = Q \quad (2)$$

Where, (x,y) represents a position of the molten metal surface, $(x_0,y_0)$ represents the electron beam spot, and a represents the standard deviation of the heat flux distribution. In addition, $q_0$ represents the heat flux at the electron beam spot. When the heat transfer amount of the electron gun is taken as "Q", as illustrated in the above Formula (2), $q_0$ is set so that the total sum of the heat flux q with respect to the entire molten metal surface within the hearth becomes Q.

With respect to these parameters, for example, by means of a heat flow simulation or the like, values may be determined and set so as to cause the molten metal flow 60 from the central part of the hearth 30 toward the lip portion 36 to be directed toward upstream relative to the irradiation line 25 by Marangoni convection that is generated by radiation of an electron beam along the irradiation line 25. Specifically, the radiation conditions of the electron beam for line radiation may be set so that the temperature (line radiation temperature T2) of a high temperature region in the vicinity of the irradiation line 25 becomes higher than the temperature (molten metal surface temperature T0) of the heat-retention radiation region 23 as illustrated in FIG. 6.

Note that, the aforementioned radiation conditions such as the heat transfer amount, scanning speed and heat flux distribution of the electron beam for line radiation are constrained by the specifications of the equipment that radiates the electron beam. Accordingly, when setting the radiation conditions of the electron beam it is good to make the heat transfer amount as large as possible, the scanning speed as fast as possible, and the heat flux distribution as narrow as possible (make the aperture of the electron beam as small as possible) within the range of the equipment specifications. Further, radiation of an electron beam with respect to the irradiation line 25 may be performed by a single electron gun or may be performed by a plurality of electron guns. In addition, as the electron gun for line radiation described here, the electron gun 20E for exclusive use for line radiation (see FIG. 3) may be used, or alternatively, electron guns for other purposes such as the electron guns 20A and 20B for melting raw material or the electron guns 20C and 20D for maintaining the temperature of the molten metal (see FIG. 3) may also be used for the purpose of line radiation.

[1.5. Summary]

A method for producing a metal ingot according to the first embodiment of the present invention has been described above. According to the present embodiment, with respect to the surface of the molten metal 5*c* in the hearth 30, an electron beam is radiated along the irradiation line 25 whose two end portions e1 and e2 are positioned at the side wall 37 of the hearth 30 and which is disposed so as to block the lip portion 36. By this means, Marangoni convection is generated by a temperature gradient at the surface of the molten metal 5*c*, and as illustrated in FIG. 6, an outer layer flow (molten metal flow 61) of the molten metal 5*c* toward upstream from the irradiation line 25 is formed in the outer layer of the molten metal 5*c*. Accordingly, by means of the molten metal flow 61, the molten metal flow 60 passing through the central part of the hearth 30 toward the lip portion 36 can be pushed back to upstream relative to the irradiation line 25, and impurities such as the LDIs 8 floating in the molten metal 5*c* can be inhibited from flowing out from the hearth 30 to the mold 40. The molten metal 5*c* that are pushed back within the hearth 30 are melted while circulating through the molten metal 5*c* in the hearth 30, or are trapped by the skull 7.

Further, the irradiation line 25 is formed in a convex shape that projects toward upstream, as illustrated in FIG. 4 and FIG. 7. By this means, the molten metal flow 60 toward the lip portion 36 can be directed toward the side walls 37A and 37B of the hearth 30 from the irradiation line 25 by the molten metal flow 61. As a result, the LDIs 8 floating on the outer layer of the molten metal 5*c* can be caused to adhere to the skull 7 on the inside face of the side walls of the hearth 30. Furthermore, it is also possible to dissolve the LDIs 8 while the LDIs 8 circulate through the molten metal 5*c* in the hearth 30. By this means, the occurrence of a situation in which impurities flow out from the hearth 30 into the mold 40 and get mixed into the ingot 50 can be inhibited.

Further, according to the method for producing a metal ingot of the present embodiment, since it is not necessary to change the shape of an existing hearth 30, the method can be easily implemented and special maintenance is also not required.

In the conventional methods for producing a titanium alloy, it is common to remove impurities by causing the molten metal to reside for a long time period in the hearth to thereby dissolve LDIs in the molten metal while also causing HDIs to adhere to a skull formed on the bottom face of the hearth. Consequently, conventionally, a long hearth has generally been used to thereby secure the residence time of the molten metal in the hearth. However, according to the method for producing a metal ingot of the present embodiment, since impurities can be appropriately removed even in a case where the residence time of molten metal in the hearth is comparatively short, it is possible to use a short hearth. Accordingly, by using a short hearth in the EB furnace 1, heating costs such as electricity expenses can be reduced, and the running cost of the EB furnace 1 can be decreased. In addition, by using a short hearth instead of a long hearth, the amount of the skull 7 that is generated in the hearth can be kept to a smaller amount compared to when using a long hearth. Therefore, the yield can be enhanced.

2. Second Embodiment

Next, a method for producing a metal ingot by an electron beam melting process according to a second embodiment of the present invention will be described.

In the method for producing a metal ingot by an electron beam melting process according to the present embodiment, the shape of the irradiation line 25 of the electron beam is different in comparison to the first embodiment. Hereunder, the differences with respect to the method for producing a metal ingot according to the first embodiment are mainly described, and a detailed description regarding similar settings and processing as in the method for producing a metal ingot according to the first embodiment is omitted. Note that, although in the following description also, a case in which the electron-beam melting furnace 1 with a short hearth that is illustrated in FIG. 3 is used is described, the present invention is not limited to this example, and can also be applied to an electron-beam melting furnace with a long hearth as illustrated in FIG. 1.

[2.1. Outline of Method for Producing Metal Ingot]

In the method for producing a metal ingot by an electron beam melting process according to the present embodiment, the irradiation line 25 is made a T-shape that includes a first straight line portion L1 along the side wall 37D between the two end portions e1 and e2, and a second straight line portion L2 that extends substantially perpendicularly toward upstream from the first straight line portion L1. The lip portion 36 is blocked by the first straight line portion L1. By radiating an electron beam along the irradiation line 25 having this shape, LDIs floating in an outer layer of the molten metal 5*c* are prevented from flowing out from the hearth 30 to the mold 40.

Figure 9:
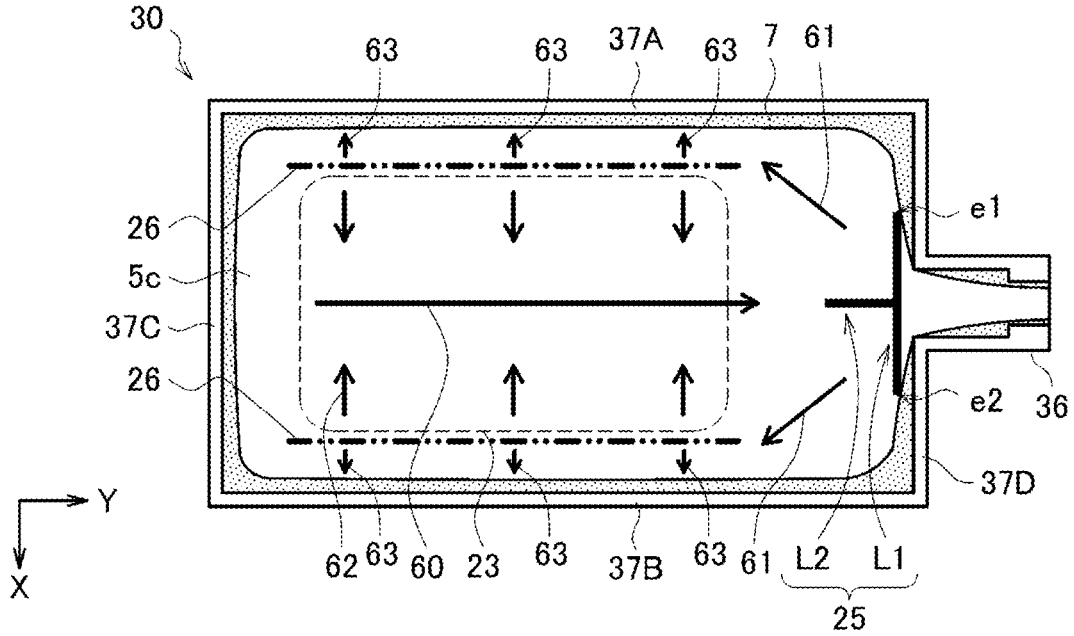
FIG. 9 is a plan view illustrating an example of a molten metal flow that is formed when an electron beam is radiated along an irradiation line according to a method for producing a metal ingot according to a second embodiment of the present invention.
Figure 10:
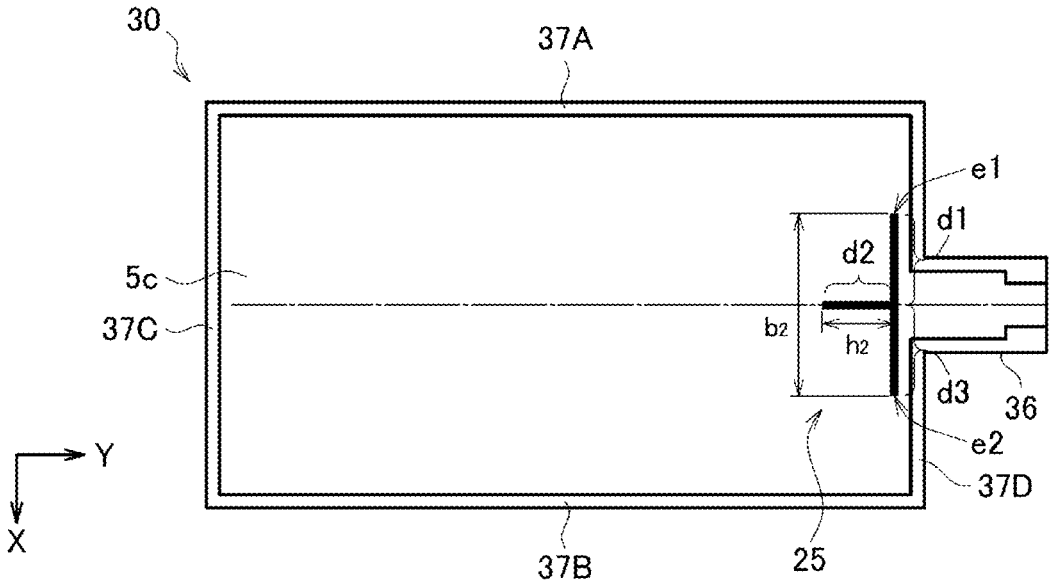
FIG. 10 is a plan view for describing the shape of an irradiation line according to the second embodiment of the present invention.

The present embodiment will now be described in further detail based on FIG. 9 and FIG. 10. FIG. 9 is a plan view illustrating an example of the irradiation line 25 in the method for producing a metal ingot according to the present embodiment, and illustrates molten metal flows at the surface of the molten metal 5*c* in the hearth 30. FIG. 10 is a plan view illustrating an example of the irradiation line 25 in the method for producing a metal ingot according to the present embodiment. Note that, the plan view in FIG. 9 corresponds to the hearth 30 of the electron-beam melting furnace 1 in FIG. 3. Further, in FIG. 10, a description of a skull that is formed on the inside face of the side walls 37 of the hearth 30 will be omitted.

In the present embodiment, as illustrated in FIG. 9 and FIG. 10, the irradiation line 25 is made a T-shape, and an electron beam is radiated along the irradiation line 25. In this case also, similarly to the case in which an electron beam is radiated along the irradiation line 25 illustrated in the first embodiment, a temperature gradient arises between the heat-retention radiation region 23 and the region in the vicinity of the irradiation line 25, and Marangoni convection occurs. As a result of the occurrence of Marangoni convection, the molten metal flow 61 arises from the irradiation line 25 toward the upstream, and LDIs are pushed back toward the upstream.

FIG. 9 illustrates a flow of the molten metal 5*c* in a case where the temperature of the raw material 5 that is dripped into the molten metal 5*c* along the supply lines 26 is a higher temperature than the molten metal 5*c* that is already accumulated in the hearth 30. Marangoni convection is a flow from a high temperature region toward a low temperature region. Therefore, the raw material 5 that was dripped into the molten metal 5*c* along the supply lines 26 rides on the molten metal flow 62 and flows toward the central part in the width direction (X direction) of the hearth 30, and also rides on the molten metal flow 63 and flows toward the side walls 37A and 37B of the hearth 30. The molten metal flows 62 that flow toward the central part of the hearth 30 from each of the pair of left and right supply lines 26 collide at the central part in the width direction of the hearth 30, thereby forming the molten metal flow 60 toward the lip portion 36 along the longitudinal direction (Y direction) of the hearth 30. As a result, the LDIs 8 floating in the molten metal 5*c* also ride on the molten metal flow 60 and flow toward the lip portion 36. By forming an outer layer flow of the molten metal 5*c* that pushes the LDIs that are riding on the molten metal flow 60 and flowing toward the lip portion 36 back to the upstream side of the hearth 30, and thus keeps the LDIs away from the lip portion 36, impurities such as the LDIs 8 can be prevented from flowing out from the lip portion 36 into the mold 40.

In the method for producing a metal ingot according to the present embodiment, as illustrated in FIG. 9, when the molten metal flow 60 toward the lip portion 36 approaches the lip portion 36, the molten metal flow 60 arrives at the region at which the electron beam is being radiated along the T-shaped irradiation line 25 with respect to the surface of the molten metal 5*c*. The irradiation line 25 is composed of the first straight line portion L1 that is substantially parallel to the side wall 37D and that blocks the lip portion 36, and the second straight line portion L2 that extends toward upstream from approximately the center of the first straight line portion L1. The two end portions e1 and e2 of the first straight line portion L1 are positioned at the side wall 37D.

The molten metal temperature T2 in the region in the vicinity of the irradiation line 25 along which an electron beam is radiated increases in comparison to the temperature T0 of the heat-retention radiation region 23. Therefore, Marangoni convection occurs, and the molten metal flow 61 from the irradiation line 25 toward the upstream is formed. Because of the occurrence of Marangoni convection, as illustrated in FIG. 9, the molten metal flow 60 toward the lip portion 36 is pushed back to the upstream by the molten metal flow 61 that arises at the irradiation line 25, and becomes a flow that flows toward and arrives at the side walls 37A and 37B of the hearth 30. By this means, after LDIs that rode on the molten metal flow 60 and flowed toward the lip portion 36 move toward the side walls 37A and 37B sides of the hearth 30, the LDIs adhere to the skull 7 formed on the side walls of the hearth 30 and stop moving. Alternatively, the LDIs that ride on the flow at the surface of the molten metal 5*c* are dissolved while circulating through the hearth 30.

Thus, according to the method for producing a metal ingot of the present embodiment, an electron beam is radiated along a T-shaped irradiation line 25. By this means, a molten metal flow arises from the irradiation line 25 toward the upstream side. As a result, LDIs in the molten metal 5*c* can be inhibited from flowing out from the hearth 30 into the mold 40. Therefore, the occurrence of a situation in which impurities flow out from the hearth 30 to the mold 40 and become mixed into the ingot 50 can be suppressed.

[2.2. Disposition of Irradiation Line]

When the irradiation line 25 is in a T-shape, electron beams may be radiated along the irradiation line 25 using, for example, three electron guns. In other words, as illustrated in FIG. 10, electron beams may be radiated along irradiation lines d1 and d3 constituting the first straight line portion L1, and an irradiation line d2 constituting the second straight line portion L2, respectively.

With regard to the first straight line portion L1 along the side wall 37D that is substantially parallel to the width direction (X direction) of the hearth 30, electron beams are radiated thereon using two electron guns. The irradiation line d1 and the irradiation line d3 share one common end, and are disposed substantially collinearly. The accuracy of controlling the radiation position of an electron beam is decreased by vaporization of a volatile valuable metal such as aluminum, particularly in the case of melting an alloy metal. Accordingly, in order to reliably block the lip portion 36 by radiation of electron beams along the first straight line portion L1, it is preferable to cause one end side of the irradiation line d1 and one end side of the irradiation line d3 to overlap. In particular, by the irradiation line d1 and the irradiation line d3 overlapping in a region having a length of 5 mm or more, even in a case where the accuracy of controlling the radiation positions of the electron beams with respect to the irradiation line 25 decreases, a gap can be prevented from arising between the irradiation line d1 and the irradiation line d3.

An irradiation line length $b_2$ of the first straight line portion L1 (that is, the sum of the lengths of irradiation lines d1 and d3 in FIG. 10) is determined by taking into account an irradiation line height $h_2$ of the second straight line portion L2 that is described later or the heat transfer amounts of electron beams emitted from the electron guns. The irradiation line length $b_2$ is set so as to be at least larger than the opening width of the lip portion 36. If the irradiation line length b2 is less than the opening width of the lip portion 36, there is a possibility that a molten metal flow from the upstream region S2 of the hearth 30 toward the lip portion 36 will arise at a portion at which an electron beam is not radiated, and LDIs will flow out from the hearth 30 to the mold 40. Therefore, it is good to make the irradiation line length $b_2$ at least greater than the opening width of the lip portion 36.

Further, the irradiation line length $b_2$ may be smaller than the width of the hearth 30, and the time required for scanning the first straight line portion L1 illustrated in FIG. 9 one time lengthens as the irradiation line length b2 increases. If the time required for scanning the irradiation line 25 one time lengthens, the molten metal flow 61 toward the side walls of the hearth 30 produced by radiation of an electron beam will weaken, and the possibility of LDIs passing through the lip portion 36 will increase. It is also good for the respective lengths of the irradiation lines d1 and d3 that constitute the first straight line portion L1 to be approximately the same. By this means, the scanning distance of each electron beam can be uniformly shortened, and the temperature of the molten metal 5*c* at the first straight line portion L1 can be uniformly increased. Note that, the number of electron guns which radiate an electron beam at the first straight line portion L1 is not limited to the number in this example, and the number of guns may be one or may be three or more.

Further, with respect to the second straight line portion L2, for example, an electron beam is radiated thereon by a single electron gun. Although the number of electron guns that radiate an electron beam along the second straight line portion L2 may be more than one, normally, because the scanning distance is shorter than the first straight line portion L1, it is possible to adequately radiate an electron beam along the second straight line portion L2 using one electron gun. The irradiation line height $h_2$ of the second straight line portion L2 is also determined by taking into account the irradiation line length $b_2$ of the first straight line portion L1 or the heat transfer amount of an electron beam emitted from the electron gun. The greater the irradiation line height $h_2$ is, the longer the time required for scanning the irradiation line 25 one time will be, and the smaller the extent of the temperature increase in the molten metal 5*c* at the second straight line portion L2 will be. Therefore, the irradiation line height $h_2$ is set so that the time required for scanning can be made as short as possible and the temperature of the molten metal 5*c* can be efficiently increased. Note that, it is desirable that the irradiation line height $h_2$ is within a range of values equivalent to around ⅖ to ⅗ of the irradiation line length $b_2$.

In a case of radiating an electron beam onto the surface of the molten metal 5*c* in the hearth 30 along the aforementioned kind of T-shaped irradiation line 25, it is good to set the center of the opening width of the lip portion 36, the middle point of the first straight line portion L1, and the second straight line portion L2 on the center line of the hearth 30 as illustrated in FIG. 10. By this means, the flow of the molten metal 5*c* in the hearth 30 can be made approximately symmetric with respect to the center line. Further, the orientation of the molten metal flow at the irradiation line 25 of the electron beam can be directed toward the sides of the side walls 37A and 37B that are at a short distance from the irradiation line 25. By this means, the likelihood of causing impurities such as LDIs to adhere to the skull 7 can be increased.

Note that, the actual radiation position at which the electron beam is irradiated with respect to the irradiation line 25 need not be strictly on the irradiation line 25. It suffices that the actual radiation position at which the electron beam is radiated is approximately on the irradiation line 25 that is set as the target, and a problem does not arise as long as the actual radiation path of the electron beam is within a control deviation range from the irradiation line 25 that is set as the target. Further, the two end portions e1 and e2 of the first straight line portion L1 of the radiation path of the electron beam in the present embodiment are positioned in the vicinity of the inside face of the side wall of the hearth 30. The phrase "end portions e1 and e2 are positioned in the vicinity of the side wall 37" means that the end portions e1 and e2 are positioned at the inside face of the side wall 37 or in a region in which a separation distance x from the inside face of the side wall 37 is not more than 5 mm. The end portions e1 and e2 of the irradiation line 25 are set in the region in question, and an electron beam is radiated along the irradiation line 25, and the formation of the skull 7 on the inside face of the side walls 37 of the hearth 30 does not constitute a problem, and the electron beam may be radiated onto the skull 7.

Further, with regard to the electron beams radiated from the respective electron guns, similarly to the first embodiment, radiation conditions such as the heat transfer amount, scanning speed and heat flux distribution of the electron beam are constrained by the specifications of the equipment that radiates the electron beam. Accordingly, when setting the radiation conditions of the electron beam it is preferable to make the heat transfer amount of the electron beam as large as possible, the scanning speed as fast as possible, and the heat flux distribution as narrow as possible (make the aperture of the electron beam as small as possible) within the range of the equipment specifications.

In this case, the irradiation line 25 in the method for producing a metal ingot according to the present embodiment is constituted by the first straight line portion L1 and the second straight line portion L2. The molten metal flow 61 that is formed by radiating electron beams along the T-shaped irradiation line 25 is formed when the flows formed by means of the first straight line portion L1 and the second straight line portion L2 overlap with each other. Therefore, the method for radiating electron beams along the T-shaped irradiation line 25 is determined based on at least one of the irradiation line length b2 and irradiation line height $h_2$, and the heat transfer amount of the electron gun. A vector of the surface flow of the molten metal 5*c* toward the side walls 37 of the hearth 30 from the irradiation line 25 can be determined by means of the settings of the aforementioned values.

Specifically, in a case where the heat amount imparted by an electron beam radiated along the first straight line portion L1 is larger than the heat amount imparted by an electron beam radiated along the second straight line portion L2, the flow toward the side wall 37C side that faces the lip portion 36 of the hearth 30 will be stronger. On the other hand, in a case where the heat amount imparted by an electron beam radiated along the second straight line portion L2 is larger than the heat amount imparted by an electron beam radiated along the first straight line portion L1, the flows toward the side walls 37A and 37B of the hearth 30 will be stronger. Thus, the orientation of the molten metal flow from the radiation position of the electron beam toward the side walls 37 of the hearth 30 can be determined by the relation between the strength of radiation of the electron beam(s) toward the first straight line portion L1 and the strength of radiation of the electron beam toward the second straight line portion L2.

For example, if the heat transfer amounts of the electron guns to be used are approximately the same, the radiation method with respect to the irradiation line 25 may be determined based on only the relation between the irradiation line length $b_2$ and the irradiation line height $h_2$. In this case, for example, the scanning distances of the respective electron guns (that is, the lengths of the irradiation lines d1, d2 and d3) may be made approximately the same, and the respective parameters may be set so that the scanning speeds and the heat flux distributions also become approximately the same. In other words, the irradiation line length $b_2$ is made a length that is equivalent to twice the amount of the irradiation line height $h_2$.

Further, in a case where the heat transfer amounts of the electron guns to be used differ from each other, it suffices to determine the radiation method with respect to the irradiation line 25 by taking into account the irradiation line length $b_2$ and the irradiation line height $h_2$ as well as the heat transfer amounts of the respective electron guns so that the molten metal flow 60 toward the lip portion 36 is pushed back toward upstream by the molten metal flow 61 toward the side walls 37A and 37B of the hearth 30.

Furthermore, according to the method for radiating electron beams of the present embodiment, the molten metal flow 61 is formed by overlapping of the flows formed by the first straight line portion L1 and the second straight line portion L2. Therefore, in comparison to a case where an electron beam is radiated along the irradiation line 25 that is illustrated in the first embodiment, the speed at which LDIs are directed toward the side walls 37 of the hearth 30 can be increased, and the likelihood of the LDIs being adhered to the skull 7 can be further increased. Accordingly, even if at least any one value among the heat transfer amount, the scanning speed and the heat flux distribution of each electron gun is made less than in the settings for the electron gun that radiates an electron beam along the irradiation line 25 that is illustrated in the first embodiment, it is possible to obtain an effect that is equal to or greater than in the first embodiment.

Thus, by radiating electron beams along the irradiation line 25 in the manner described in the method for producing a metal ingot according to the present embodiment, a flow at the surface of the molten metal 5*c* toward the lip portion 36 can be pushed back in a direction that is toward the upstream relative to the irradiation line 25 and is toward the side walls 37A and 37B of the hearth 30. By this means, LDIs that have flowed toward the lip portion 36 can be directed toward the side walls 37 of the hearth 30 and caused to adhere to the skull 7 of the side walls 37 of the hearth 30. Alternatively, the LDIs can also be caused to dissolve while circulating through the molten metal 5*c* in the hearth 30. By this means, the occurrence of a situation in which LDIs flow out from the hearth 30 to the mold 40 and mix into an ingot can be inhibited.

Note that, the irradiation line 25 is not particularly limited, and any arbitrary form can be adopted as long as the irradiation line 25 is such that, within the downstream region S3, "the two end portions e1 and e2 are in the vicinity of the side wall 37 (any one of 37A, 37B, 37C and 37D)" and "the irradiation line 25 blocks the lip portion 36 (such that the upstream region S2 and the lip portion 36 are reliably partitioned by the irradiation line 25)". For example, the irradiation line 25 may be disposed at a central part in the longitudinal direction of the hearth 30 or may be disposed in the vicinity of the lip portion 36. From the viewpoint of more reliably preventing LDIs from flowing out from the hearth 30 to the mold 40, preferably the irradiation line 25 is disposed as near as possible to the lip portion 36.

[2.3. Summary]

The method for producing a metal ingot according to the second embodiment of the present invention has been described above. According to the present embodiment, the irradiation line 25 is made a T-shape that includes the first straight line portion L1 along the side wall 37D between the two end portions e1 and e2, and the second straight line portion L2 that extends substantially perpendicularly toward upstream from the first straight line portion L1. By radiating electron beams along the irradiation line 25 having this shape, a molten metal flow toward the lip portion 36 can be pushed back toward upstream at the irradiation line 25 and directed toward the side walls 37 of the hearth 30. As a result, LDIs floating on the surface of the molten metal 5*c* can be caused to adhere to the skull 7 of the side walls 37 of the hearth 30. Alternatively, the LDIs can also be caused to dissolve while circulating through the molten metal 5*c* in the hearth 30. By this means, the occurrence of a situation in which LDIs flow out from the hearth 30 to the mold 40 and mix into an ingot can be inhibited.

In addition, according to the method for producing a metal ingot of the present embodiment, because the molten metal flow 61 that is formed by radiating electron beams along the irradiation line 25 is formed by overlapping of flows formed by radiation of electron beams along the respective positions of the first straight line portion L1 and the second straight line portion L2, the molten metal flow 61 is a strong flow. Therefore, LDIs can be surely caused to adhere to the skull. Further, it is also possible to lower the setting for a heat transfer amount, a scanning speed or a heat flux distribution of an electron gun.

Further, according to the method for producing a metal ingot of the present embodiment, since it is not necessary to change the shape of an existing hearth 30, the method can be easily implemented and special maintenance is also not required.

In the conventional methods for producing a titanium alloy, it is common to remove impurities by causing the molten metal to reside for a long time period in the hearth to thereby dissolve LDIs in the molten metal while also causing HDIs to adhere to a skull formed on the bottom face of the hearth. Consequently, conventionally, a long hearth has generally been used to thereby secure the residence time of the molten metal in the hearth. However, according to the method for producing a metal ingot of the present embodiment, since impurities can be appropriately removed even in a case where the residence time of molten metal in the hearth is comparatively short, it is possible to use a short hearth. Accordingly, by using a short hearth in the EB furnace 1, heating costs such as electricity expenses can be reduced, and the running cost of the EB furnace 1 can be decreased. In addition, by using a short hearth instead of a long hearth, the amount of the skull 7 that is generated in the hearth can be kept to a smaller amount compared to when using a long hearth. Therefore, the yield can be enhanced.

3. Third Embodiment

Next, a method for producing a metal ingot according to a third embodiment of the present invention will be described.

In the method for producing a metal ingot according to the present embodiment, although the shape of the irradiation line 25 is approximately the same as in the method for producing a metal ingot according to the first embodiment, the number of electron guns that radiate an electron beam is different from the first embodiment. Hereunder, the differences with respect to the method for producing a metal ingot according to the first embodiment are mainly described, and a detailed description regarding similar settings and processing as in the method for producing a metal ingot according to the first embodiment is omitted. Note that, although in the following description also, a case in which the electron-beam melting furnace 1 with a short hearth that is illustrated in FIG. 3 is used is described, the present invention is not limited to this example, and can also be applied to the electron-beam melting furnace 1A with a long hearth that is illustrated in FIG. 1.

Figure 11:
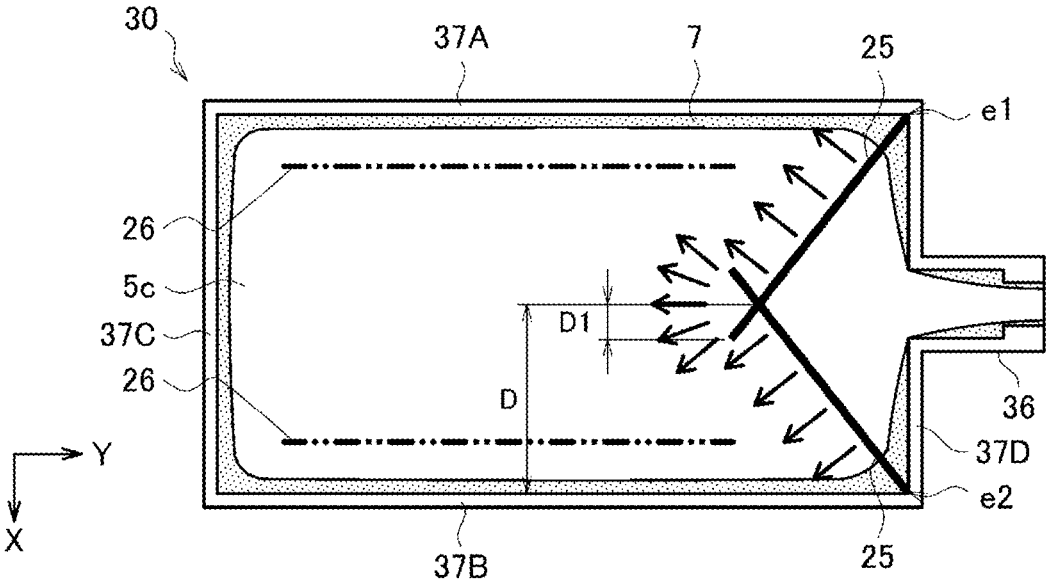
FIG. 11 is a plan view illustrating an example of a molten metal flow that is formed when an electron beam is radiated along an irradiation line according to a method for producing a metal ingot according to a third embodiment of the present invention.

The method for radiating electron beams in the method for producing a metal ingot according to the present embodiment will now be described based on FIG. 11. FIG. 11 is a plan view illustrating an example of the irradiation line 25 in the method for producing a metal ingot according to the present embodiment.

In the method for producing a metal ingot according to the present embodiment, as illustrated in FIG. 11, similarly to the first embodiment illustrated in FIG. 4, the irradiation line 25 is in a convex shape that projects toward upstream from the lip portion 36. Specifically, the irradiation line 25 is, for example, V-shaped. The V-shaped irradiation line 25 illustrated in FIG. 11 is constituted by a first straight line portion and a second straight line portion that extend toward the center of the hearth 30 from, among the four corner portions of the hearth 30, the corner portions at the two ends of the side wall 37D in which the lip portion 36 is provided, respectively. The end portion e1 of the first straight line portion is positioned at one end of the side wall 37D, and the end portion e2 of the second straight line portion is positioned at the other end of the side wall 37D.

Radiation of electron beams along the first straight line portion and the second straight line portion is performed by different electron guns. In other words, electron beams are radiated along the V-shaped irradiation line 25 by two electron guns. For example, in a case where the radiation range of an electron beam is limited due to a constraint such as the equipment space and consequently radiation along the V-shaped irradiation line 25 illustrated in FIG. 4 cannot be performed using a single electron gun as in the first embodiment, electron beams may be radiated using a plurality of electron guns as in the present embodiment.

At such time, electron beams are radiated along the irradiation line 25 using two electron guns so that the respective radiation paths of the electron beams intersect or overlap on the surface of the molten metal 5*c*. For example, at a portion (V-shaped vertex portion) at which the first straight line portion and the second straight line portion are connected as illustrated in FIG. 11, the electron beams may be radiated so that these straight line portions intersect. In other words, the first straight line portion and the second straight line portion are connected so that the first straight line portion and the second straight line portion intersect, and are not connected at end portions on the opposite sides to the end portions e1 and e2 at the side wall 37D.

In the case of melting an alloy metal, the accuracy of controlling the radiation position of an electron beam is decreased by vaporization of a volatile valuable metal such as aluminum. Melting of raw material by radiation of an electron beam in an EB furnace is performed inside a vacuum chamber, and if a volatile valuable metal vaporizes, the degree of vacuum within the vacuum chamber will worsen, and the straightness of the electron beam will decrease. As a result, it will be difficult to control the radiation position of the electron beam with high accuracy. In such a situation, it will be difficult to accurately perform radiation using two electron guns along the V-shaped irradiation line 25 in which two straight line portions are connected together at one end portion of each straight line portion as illustrated in FIG. 4. Further, if a gap arises between the two straight line portions, the possibility that a flow will be formed at the surface of the molten metal 5*c* from the gap toward the lip portion 36, and that LDIs will flow out to the lip portion 36 will increase.

Therefore, in the case of radiating electron beams using two electron guns, the two end portions e1 and e2 are positioned at the side wall 37 and the irradiation line 25 is disposed so as to block the lip portion 36. In addition, in order to reliably prevent LDIs in the molten metal 5*c* in the hearth 30 from flowing out from the lip portion 36, the radiation paths of the electron beams that are output from the two electron guns are caused to intersect. By this means, even if the accuracy of the control of the radiation positions of the electron beams worsen to a certain extent, because the first straight line portion and the second straight line portion intersect, a gap does not arise between these straight line portions, and LDIs in the molten metal 5*c* in the hearth 30 do not flow out from the lip portion 36. In particular, the possibility of LDIs flowing out to the lip portion 36 can be further reduced by making the length from the point of intersection to the end portion 5 mm or more in both the first straight line portion and the second straight line portion.

The first straight line portion and the second straight line portion may be connected at a position other than at the respective end portions thereof. For example, in a state in which the straightness of the electron beams is maintained, as illustrated in FIG. 11, the first straight line portion and the second straight line portion may be connected at a position that is separated by ¼ of a half-width D (that is, a position at which D1=D/4) of the hearth 30 in the width direction of the hearth 30 from an end portion on the opposite side to the corner portion of the hearth 30. Note that, if it is possible to perform control of the radiation positions of the electron beam with high accuracy, the respective lengths of the first straight line portion and the second straight line portion may be made the length from the corresponding corner portion of the hearth 30 to the point of intersection, and the V-shaped irradiation line 25 in which the two straight line portions are connected together at an end portion of each of the straight line portions as illustrated in FIG. 4 may be disposed.

It is also possible to use two electron guns in a case where the irradiation line 25 is in a shape other than a V-shape. For example, the irradiation line 25 having a curved shape such as a parabola as a convex shape in which the vertex is on the center line of the hearth 30 may be disposed. Alternatively, the irradiation line 25 having a substantially semicircular shape as illustrated in FIG. 7 may be disposed. In such cases also, it suffices to block the flow path of the molten metal 5*c* between the upstream region S2 and the lip portion 36 by causing the radiation paths of electron beam to intersect at a portion at which irradiation lines are connected. Furthermore, in the case of using three or more electron guns also, it suffices that the radiation paths of electron beams radiated by mutually different electron guns intersect at a portion at which the radiation paths are connected.

4. Fourth Embodiment

Next, a method for producing a metal ingot according to a fourth embodiment of the present invention will be described.

[4.1. Outline of Method for Producing Metal Ingot]

In the method for producing a metal ingot according to the present embodiment, an irradiation line that is disposed on the surface of molten metal in a hearth is made a straight line shape that is substantially parallel to the width direction of the hearth. A flow path of molten metal to a lip portion at which molten metal inside the hearth is allowed to flow out to a mold is blocked by radiating an electron beam along the aforementioned irradiation line. By this means, LDIs that are impurities floating on the molten metal surface are pushed back into the hearth so that the LDIs do not flow out to the mold from the lip portion. The LDIs that are pushed back into the hearth dissolve while residing in the hearth. As a result, LDIs can be inhibited from flowing out into the mold.

Figure 12:
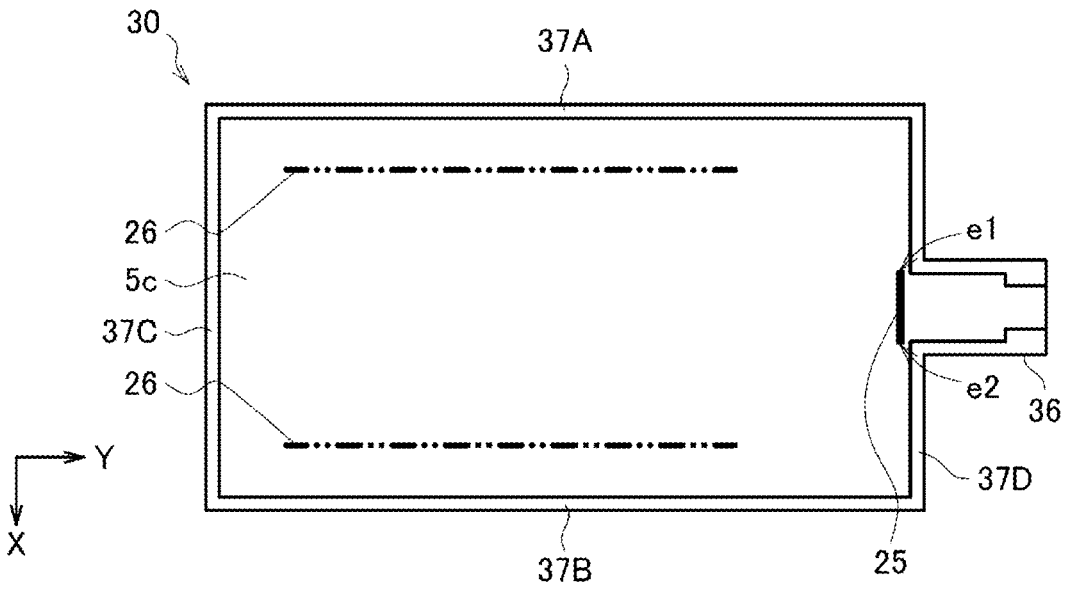
FIG. 12 is a plan view illustrating an example of an irradiation line and supply lines in a hearth according to a fourth embodiment of the present invention.
Figure 13:
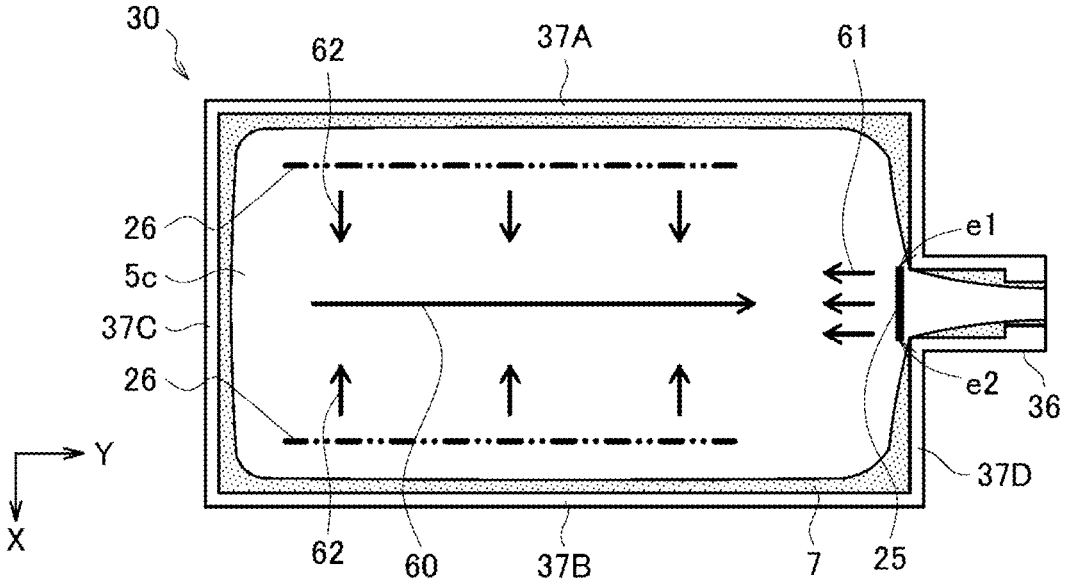
FIG. 13 is a plan view illustrating an example of a molten metal flow that is formed when an electron beam is radiated along an irradiation line according to a method for producing a metal ingot according to the fourth embodiment of the present invention.

The method for producing a metal ingot according to the present embodiment will now be described in further detail based on FIG. 12 and FIG. 13. FIG. 12 is a plan view illustrating the irradiation line 25 according to the method for producing a metal ingot of the present embodiment. FIG. 13 is an explanatory drawing illustrating a molten metal flow that is formed at the surface of the molten metal 5*c* when an electron beam is radiated along the irradiation line 25 illustrated in FIG. 12. Note that, the plan view in FIG. 12 corresponds to the hearth 30 of the electron-beam melting furnace 1 illustrated in FIG. 3. Note that, although in the following description a case in which the electron-beam melting furnace 1 with a short hearth that is illustrated in FIG. 3 is used is described, the present invention is not limited to this example, and can also be applied to the electron-beam melting furnace 1A with a long hearth that is illustrated in FIG. 1.

In the method for producing a metal ingot according to the present embodiment, the two end portions e1 and e2 are positioned in the vicinity of the side wall 37 of the hearth 30, and the irradiation line 25 is set with respect to the surface of the molten metal 5*c* in the hearth 30 so as to block the lip portion 36. Specifically, as illustrated in FIG. 12, the irradiation line 25 is in a straight line shape that is substantially parallel to the width direction of the hearth 30 between the two end portions e1 and e2. The two end portions e1 and e2 of the irradiation line 25 are positioned in the vicinity of the side wall 37D in which the lip portion 36 is provided. The irradiation line 25 illustrated in FIG. 12 is made approximately the same length as the opening width of the lip portion 36. The irradiation line 25 is disposed in the downstream region S3 between the upstream region S2 that includes the supply lines 26, and the side wall 37D.

An electron beam is radiated onto the surface of the molten metal 5*c* along the irradiation line 25 shaped as described above. By this means, Marangoni convection is generated by a temperature gradient at the surface of the molten metal 5*c*, and as illustrated in FIG. 13, in the outer layer of the molten metal 5*c*, forms an outer layer flow (the molten metal flow 61) of the molten metal 5*c* from the irradiation line 25 toward the upstream side. A case will now be considered in which, when the raw material 5 is dripped along the supply lines 26 into the molten metal 5*c* in the hearth 30, the temperature of the melted metal (raw material supplying temperature T1) that is dripped along the supply lines 26 is higher than the temperature T0 of the molten metal which is already accumulated in the hearth 30. In this case, the regions in the vicinity of the supply lines 26 at which the melted raw material 5 (melted metal) is dripped are high temperature regions in which the temperature is higher than the temperature of the molten metal 5*c* in other regions. Therefore, as illustrated in FIG. 13, the molten metal 5*c* in the regions in the vicinity of the supply lines 26 flows from the supply lines 26 toward the central part in the width direction (X direction) of the hearth 30, and a molten metal flow 62 is formed in the outer layer of the molten metal 5*c*.

Note that, although not illustrated in FIG. 13, the molten metal 5*c* in the regions in the vicinity of the supply lines 26 also flows from the supply lines 26 toward the side walls 37A and 37B in the width direction (X direction) of the hearth 30 as illustrated in FIG. 5, and a molten metal flow (the molten metal flow 63 in FIG. 5) is formed in the outer layer of the molten metal 5*c*. The LDIs 8 contained in the melted metal that was dripped onto the supply lines 26 ride on the molten metal flow (the molten metal flow 63 in FIG. 5) and flow toward the side walls 37A and 37B of the hearth 30, and adhere to the skull 7 formed on the inside faces of the side walls 37A and 37B and are thereby trapped.

The molten metal flows 62 that flow toward the central part of the hearth 30 from each of the pair of left and right supply lines 26 collide at the central part in the width direction of the hearth 30, thereby forming the molten metal flow 60 toward the lip portion 36 along the longitudinal direction (Y direction) of the hearth 30. As a result, the LDIs 8 floating in the molten metal 5*c* also ride on the molten metal flow 60 and flow toward the lip portion 36. To ensure that impurities such as the LDIs 8 do not flow out from the lip portion 36 to the mold 40, it is preferable that an outer layer flow of the molten metal 5*c* is formed that pushes the LDIs riding on the molten metal flow 60 and flowing toward the lip portion 36 back to the upstream side of the hearth 30 and thereby keeps the LDIs away from the lip portion 36.

Therefore, in the method for producing a metal ingot according to the present embodiment, as illustrated in FIG. 12 and FIG. 13, the two end portions e1 and e2 are positioned in the vicinity of the side wall 37D, and the irradiation line 25 that has a straight line shape is disposed on the surface of the molten metal 5*c* so as to block the lip portion 36. The molten metal temperature in the region in the vicinity of the irradiation line 25 becomes higher than the molten metal temperature in the heat-retention radiation region 23. Therefore, Marangoni convection occurs, and the molten metal flow 61 is formed in the upstream direction from the irradiation line 25. The molten metal flow 61 is a flow that pushes the LDIs 8 that have ridden on the molten metal flow 60 and flowed toward the lip portion 36 at the central part in the width direction of the hearth 30 back to the upstream side of the hearth 30. By means of the molten metal flow 61, the LDIs 8 that flowed toward the lip portion 36 are pushed back toward the upstream side at the irradiation line 25, and flow to the inside of the hearth 30. The LDIs 8 that were pushed back to the inside of the hearth 30 ride on a flow at the surface of the molten metal 5*c* and are dissolved while circulating through the hearth 30. Alternatively, after the LDIs 8 have moved toward the side walls 37A and 37B side of the hearth 30, the LDIs 8 adhere to the skull 7 formed on the side walls 37 of the hearth 30 and no longer move.

Thus, in the method for producing a metal ingot according to the present embodiment, an electron beam is radiated along the irradiation line 25 whose two end portions e1 and e2 are positioned in the vicinity of the side wall 37, and which is disposed so as to block the lip portion 36. By this means, the molten metal flow 61 toward upstream is formed from a high temperature region of the molten metal 5*c* in the vicinity of the irradiation line 25, and impurities such as LDIs that have flowed toward the lip portion 36 side are pushed back to the upstream side relative to the irradiation line 25. Accordingly, the impurities in question can be inhibited from flowing out from the hearth 30 to the mold 40. As a result, the occurrence of a situation in which impurities mix into an ingot can be suppressed.

[4.2. Disposition of Irradiation Line]

In the method for producing a metal ingot according to the present embodiment, the irradiation line 25 that has a straight line shape is disposed. By making the shape of the irradiation line 25 a straight line shape, the scanning distance of the electron beam can be shortened. As a result, the occurrence of a situation in which LDIs 8 in the molten metal 5*c* pass through the lip portion 36 and flow out from the hearth 30 to the mold 40 can be suppressed.

As illustrated in FIG. 12 and FIG. 13, in a case where the shape of the hearth 30 in a planar view is in a rectangular shape, it is desirable to dispose the irradiation line 25 along the side wall 37D. The side wall 37D is substantially parallel to the width direction (X direction) of the hearth 30. The molten metal flows 62 that flow toward the central part of the hearth 30 from each of the supply lines 26 collide at the central part in the width direction of the hearth 30, thereby forming the molten metal flow 60 toward the lip portion 36 along the longitudinal direction (Y direction) of the hearth 30. The molten metal flow 60 is substantially parallel to the longitudinal direction of the hearth 30. Accordingly, by disposing the irradiation line 25 along the side wall 37D of the hearth 30, a flow of the molten metal 5*c* toward the lip portion 36 (the molten metal flow 60) can be efficiently held back. Further, the molten metal flow 61 is formed toward the upstream from the irradiation line 25. By this means, the LDIs 8 that rode on the flow of the molten metal 5*c* and flowed toward the lip portion 36 can be pushed back so as to move away from the lip portion 36 by the molten metal flow 61 and can be caused to reside within the hearth 30.

It suffices that the irradiation line 25 is disposed at least in the downstream region S3 between the upstream region S1 that includes the supply lines 26, and the side wall 37D. In order to more reliably inhibit the outflow of impurities, as illustrated in FIG. 12 and FIG. 13, it is preferable that the irradiation line 25 is disposed at the inflow opening to the lip portion 36. At such time, the length of the irradiation line 25 is made at least equal to or greater than the opening width of the lip portion 36. Preferably, the length of the irradiation line 25 is made approximately the same length as the opening width of the lip portion 36. By this means, the scanning distance of an electron beam radiated along the irradiation line 25 can be made shortest. As a result, even in a case where the scanning speed of the electron beam decreases, there is little weakening of the molten metal flow 61 formed by radiation of the electron beam along the irradiation line 25. Accordingly, since the LDIs 8 are reliably pushed back to the inner side of the hearth 30 before the LDIs 8 can flow into the lip portion 36, the LDIs 8 do not flow out from the hearth 30.

Figure 14:
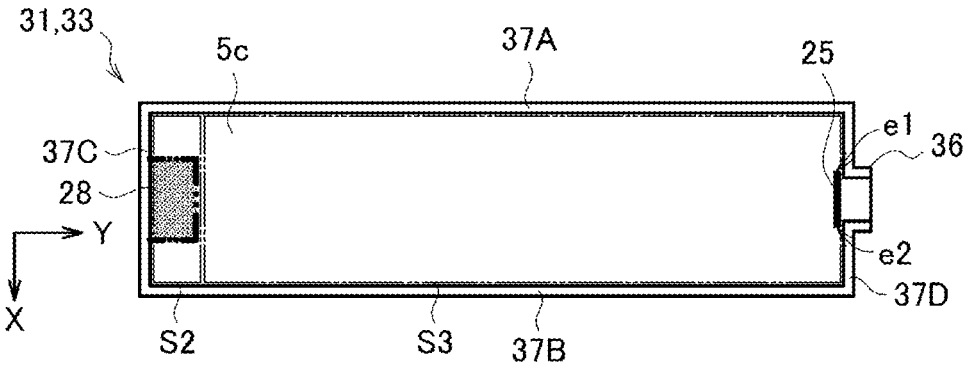
FIG. 14 is a plan view illustrating an example of an irradiation line according to the fourth embodiment of the present invention.
Figure 15:
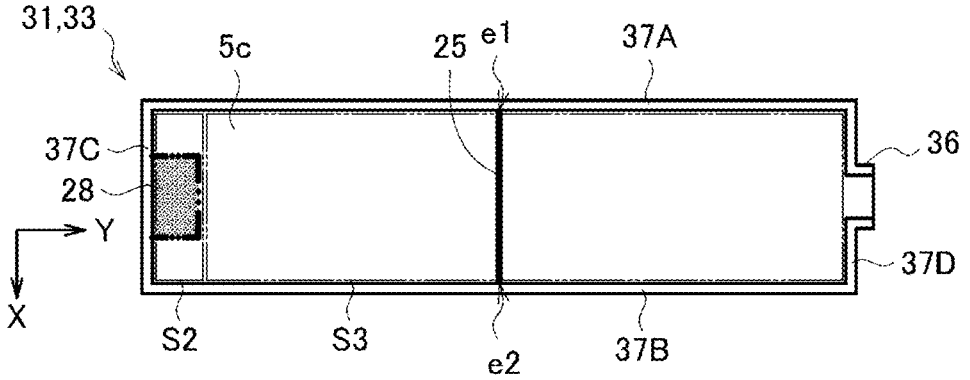
FIG. 15 is a plan view illustrating an example of an irradiation line according to the fourth embodiment of the present invention.

The disposition of the irradiation line 25 in the method for producing a metal ingot according to the present embodiment is also applicable to a long hearth, and not only to a short hearth as illustrated in FIG. 12 and FIG. 13. An example of a case in which the irradiation line 25 having the shape of a straight line is disposed in a long hearth that includes a melting hearth 31 and a refining hearth 33 (hereunder, referred to as "long hearths 31 and 33") is illustrated in FIG. 14 and FIG. 15. Note that, in FIG. 14 and FIG. 15, for convenience, the melting hearth 31 and the refining hearth 33 are illustrated in a manner in which the melting hearth 31 and the refining hearth 33 are modelled as a single hearth. For example, as illustrated in FIG. 14, similarly to FIG. 12 and FIG. 13, the irradiation line 25 that is in a straight line shape having a length that is approximately the same as the opening width of the lip portion 36 is disposed at the inflow opening to the lip portion 36. The two end portions e1 and e2 of the irradiation line 25 are positioned at the side wall 37D, and the irradiation line 25 is disposed so as to block the lip portion 36. By this means, similarly to FIG. 12 and FIG. 13, the LDIs 8 that flow toward the lip portion 36 together with the molten metal 5*c* are held back at the irradiation line 25, and pushed back to the upstream side. Consequently, the LDIs 8 reside inside the long hearths 31 and 33, and the LDIs 8 can be reliably inhibited from flowing out from the long hearths 31 and 33 to the mold 40.

Further, in the case of the long hearths 31 and 33 also, it is favorable to dispose the irradiation line 25 in the downstream region S3 between the upstream region S2 including a raw material supply region 28 into which the raw material 5 is dripped, and the side wall 37D. As illustrated in FIG. 14 and FIG. 15, in the long hearths 31 and 33, the raw material supply region 28 into which the raw material 5 is dripped is normally at the most upstream position in the longitudinal direction (negative side in the Y direction) of the long hearths 31 and 33. In other words, the raw material supply region 28 is in the vicinity of the side wall 37C that is on the opposite side to the lip portion 36 in the longitudinal direction of the long hearths 31 and 33. Accordingly, for example, as illustrated in FIG. 15, the irradiation line 25 may be disposed at the center in the longitudinal direction of the long hearths 31 and 33. The position at the center in the longitudinal direction of the long hearths 31 and 33 is a position in the downstream region S3 that is further on the downstream side relative to the upstream region S2 which includes the raw material supply region 28. At such time, the two end portions e1 and e2 of the irradiation line 25 are positioned in the vicinity of the side walls 37A and 37B. By this means, the LDIs 8 can be inhibited from passing through the irradiation line 25 and flowing out to the lip portion 36.

Note that, the actual radiation position at which the electron beam is irradiated with respect to the irradiation line 25 need not be strictly on the irradiation line 25. It suffices that the actual radiation position at which the electron beam is radiated is approximately on the irradiation line 25 that is set as the target, and a problem does not arise as long as the actual radiation path of the electron beam is within a control deviation range from the irradiation line 25 that is set as the target. Further, the phrase "end portions e1 and e2 are positioned in the vicinity of the side wall 37" means that the end portions e1 and e2 are positioned at the inside face of the side wall 37 or in a region in which a separation distance x from the inside face of the side wall 37 is not more than 5 mm. The end portions e1 and e2 of the irradiation line 25 are set in the region in question, and an electron beam is radiated along the irradiation line 25, and the formation of the skull 7 on the inside face of the side walls 37 of the long hearths 31 and 33 does not constitute a problem, and the electron beam may be radiated onto the skull 7.

Further, with regard to the electron beams radiated from the respective electron guns, similarly to the first embodiment, radiation conditions such as the heat transfer amount, scanning speed and heat flux distribution of the electron beam are constrained by the specifications of the equipment that radiates the electron beam. Accordingly, when setting the radiation conditions of the electron beam it is preferable to make the heat transfer amount of the electron beam as large as possible, the scanning speed as fast as possible, and the heat flux distribution as narrow as possible (make the aperture of the electron beam as small as possible) within the range of the equipment specifications.

[4.3. Promotion of Dissolving of LDIs]

In the method for producing a metal ingot according to the present embodiment, by blocking the lip portion 36 by means of the irradiation line 25, the LDIs 8 are held back inside the hearth 30, and the LDIs 8 are dissolved while circulating within the hearth. By this means, the occurrence of a situation in which the LDIs 8 flow out from the hearth 30 to the mold 40 is suppressed. Thus, until the LDIs 8 dissolve, there is a possibility that the LDIs 8 may flow out from the hearth 30 to the mold 40. Therefore, to reduce the possibility of the LDIs 8 flowing out from the hearth 30 to the mold 40, dissolving of the LDIs 8 that are present in the hearth 30 is promoted. For this purpose, an electron beam for promoting LDI dissolving (corresponds to "second electron beam" of the present invention) may be radiated onto the surface of the molten metal 5*c* in the hearth 30.

The electron beam for promoting LDI dissolving, for example, may be radiated onto a stagnation position at which the flow of the molten metal 5*c* is stagnant. The LDIs 8 are liable to stagnate at a stagnation position in the flow of the molten metal 5*c*. Thus, the LDIs 8 inside the hearth can be dissolved more quickly by radiating the electron beam for promoting LDI dissolving at a position at which the LDIs stagnate. Note that it is not necessary to continuously radiate the electron beam for promoting LDI dissolving, and it suffices to appropriately radiate the electron beam for promoting LDI dissolving at a stagnation position in the flow of the molten metal 5*c* at which the LDIs 8 stagnate. Further, with respect to the electron gun for radiating the electron beam for promoting LDI dissolving, an electron gun for promoting LDI dissolving (not illustrated in the drawings) may be used, or alternatively electron guns for other purposes such as the electron guns 20A and 20B for melting raw material or the electron guns 20C and 20D for maintaining the temperature of the molten metal (see FIG. 3) may also be used for promoting LDI dissolving. A stagnation position in the flow of the molten metal 5*c* may be identified in advance by a simulation or the like. A stagnation position can be identified by performing a simulation based on the position and shape of the irradiation line 25, and the heat transfer amount and scanning speed of the electron beam and the like that are set as described above.

[4.4. Modification]

A modification of the fourth embodiment will now be described. Examples have been described above in which, with respect to the surface of the molten metal 5*c* in the hearth 30, the irradiation line 25 having a straight line shape in which the two end portions e1 and e2 are positioned in the vicinity of the side walls 37 is disposed so as to block the lip portion 36 as illustrated in FIG. 12 and in FIG. 13. However, the present invention is not limited to the foregoing examples. Even if the shape of the irradiation line 25 is different from the shape in the example illustrated in FIG. 12 or FIG. 13, the flow path of the molten metal to the lip portion 36 that allows the molten metal 5*c* in the hearth 30 to flow out to the mold 40 can be blocked, and the LDIs 8 can be pushed back to the inside of the hearth 30.

Figure 16:
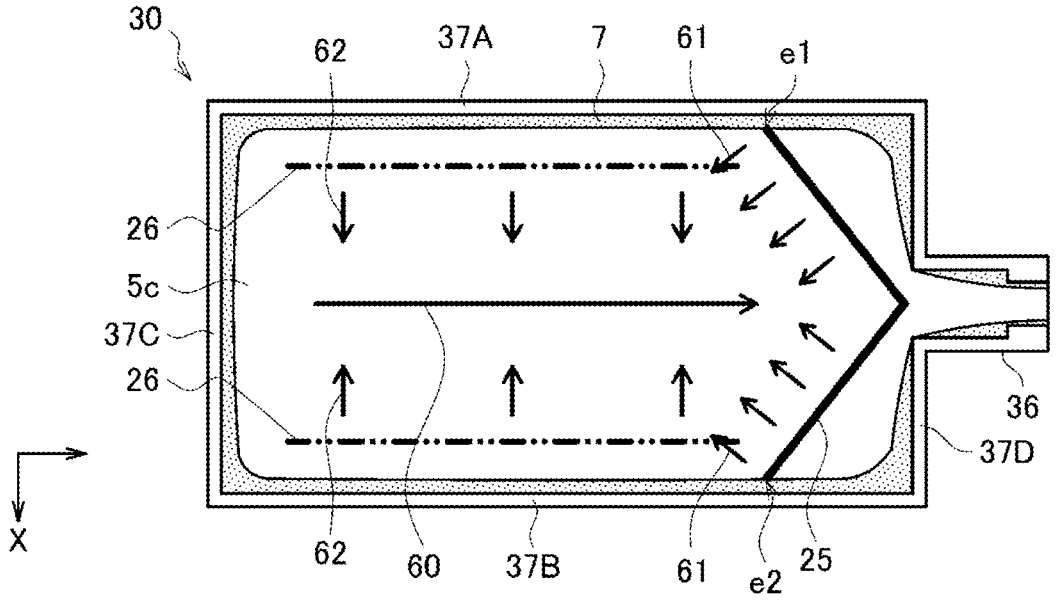
FIG. 16 is a plan view illustrating a V-shaped radiation path that is a modification of the irradiation line according to the fourth embodiment of the present invention.

For example, the irradiation line 25 may be in a convex shape that projects from the upstream of the hearth 30 toward the lip portion 36 on the downstream. Specifically, as illustrated in FIG. 16, the irradiation line 25 may be in a V-shape whose two end portions e1 and e2 are positioned in the vicinity of the side walls 37A and 37B and which projects toward the lip portion 36. By this means, because the lip portion 36 is blocked, the LDIs 8 in the molten metal 5*c* can be inhibited from flowing out to the lip portion 36. Further, by radiating an electron beam along the irradiation line 25, a flow of the molten metal 5*c* can be formed toward upstream from the irradiation line 25. As a result, the LDIs 8 can be pushed back to the inner side of the hearth 30.

Figure 17:
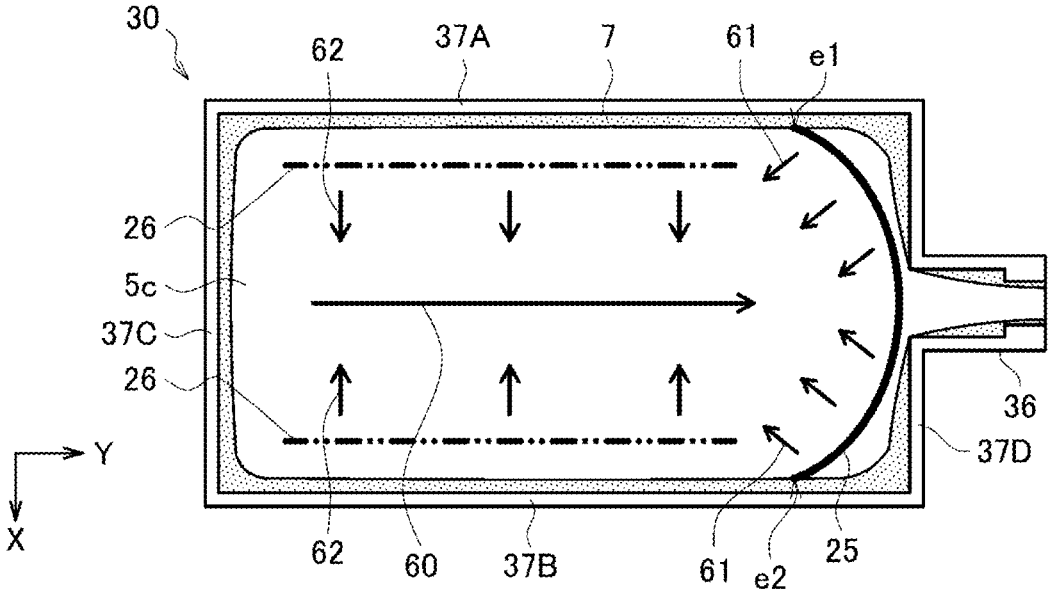
FIG. 17 is a plan view illustrating a circular-arc-shaped radiation path that is a modification of the irradiation line according to the fourth embodiment of the present invention.

Alternatively, as illustrated in FIG. 17, the irradiation line 25 may be in a circular arc shape whose two end portions e1 and e2 are positioned in the vicinity of the side walls 37A and 37B and which projects toward the lip portion 36. In this case also, because the lip portion 36 is blocked, the LDIs 8 in the molten metal 5*c* can be inhibited from flowing out to the lip portion 36. Further, by radiating an electron beam along the irradiation line 25, a flow of the molten metal 5*c* can be formed toward upstream from the irradiation line 25. As a result, the LDIs 8 can be pushed back to the inner side of the hearth 30.

Figure 18:
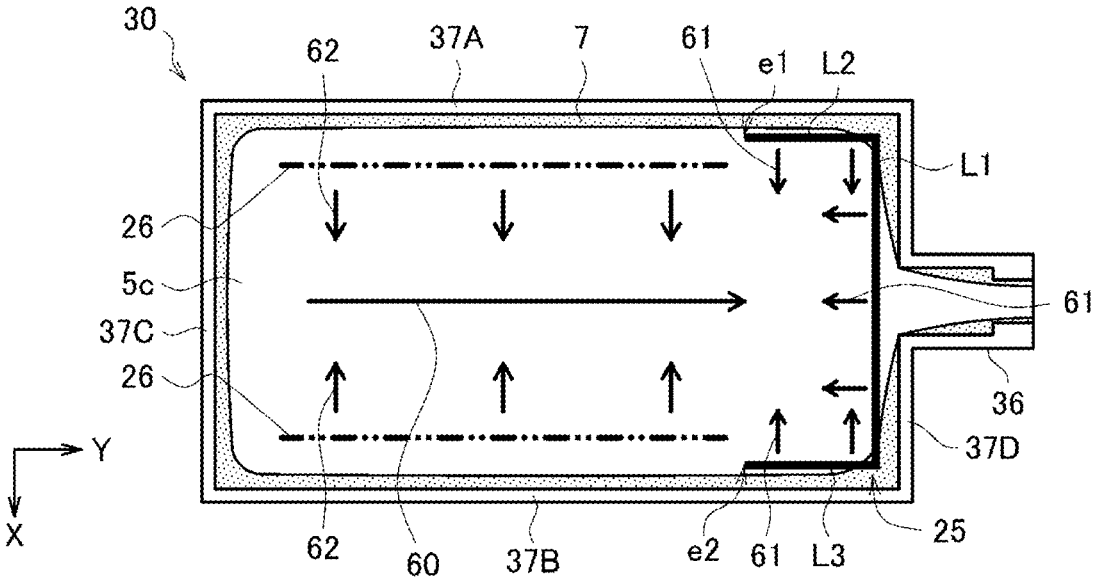
FIG. 18 is a plan view illustrating a U-shaped irradiation line that is a modification of the irradiation line according to the fourth embodiment of the present invention.

In addition, the irradiation line 25 may be in a U-shape that is in a convex shape from the upstream of the hearth 30 toward the lip portion 36. For example, as illustrated in FIG. 18, the U-shaped irradiation line 25 includes a first straight line portion L1, a second straight line portion L2 and a third straight line portion L3. The first straight line portion L1 is disposed substantially parallel to the side wall 37D between the two end portions e1 and e2. The first straight line portion L1 is disposed so as to block the lip portion 36. The second straight line portion L2 and the third straight line portion L3 are disposed so as to extend substantially perpendicularly toward upstream from the two ends of the first straight line portion L1 along the pair of side walls 37A and 37B that face each other, respectively. The two end portions e1 and e2 of the irradiation line 25 are positioned in the vicinity of the side walls 37A and 37B of the hearth 30. By this means, because the lip portion 36 is blocked, the LDIs 8 in the molten metal 5*c* can be inhibited from flowing out to the lip portion 36. Further, by radiating an electron beam along the irradiation line 25, a flow of the molten metal 5*c* can be formed toward upstream from the irradiation line 25. As a result, the LDIs 8 can be pushed back to the inner side of the hearth 30.

Note that, in the U-shaped irradiation line 25, a corner at which the first straight line portion L1 and the second straight line portion L2 are connected and a corner at which the first straight line portion L1 and the third straight line portion L3 are connected may be right angles as illustrated in FIG. 18 or may be rounded.

In the modification also, the actual radiation position at which the electron beam is irradiated with respect to the irradiation line 25 need not be strictly on the irradiation line 25. It suffices that the actual radiation position at which the electron beam is radiated is approximately on the irradiation line 25 that is set as the target, and a problem does not arise as long as the actual radiation path of the electron beam is within a control deviation range from the irradiation line 25 that is set as the target. Further, the phrase "end portions e1 and e2 are positioned in the vicinity of the side wall 37" means that the end portions e1 and e2 are positioned at the inside face of the side wall 37 or in a region in which a separation distance x from the inside face of the side wall 37 is not more than 5 mm. The end portions e1 and e2 of the irradiation line 25 are set in the region in question, and an electron beam is radiated along the irradiation line 25, and the formation of the skull 7 on the inside face of the side walls 37 of the hearth 30 does not constitute a problem, and the electron beam may be radiated onto the skull 7.

Further, with respect to each irradiation line 25 illustrated in FIG. 16 to FIG. 18, an electron beam may be radiated along the irradiation line 25 using one electron gun, or electron beams may be radiated along the irradiation line 25 using a plurality of electron guns.

In addition, in a case where the irradiation line 25 is disposed as illustrated in FIG. 16 to FIG. 18, when an electron beam is radiated along the relevant irradiation line 25, a flow of the molten metal 5*c* is formed in a direction that is toward the upstream relative to the irradiation line 25 and is toward the center in the width direction (X direction) of the hearth 30. In other words, a flow of the molten metal 5*c* is formed toward the center from the side walls 37A and 37B on the upstream side relative to the irradiation line 25. At this time, the molten metal temperature in a region in the vicinity of the irradiation line 25 is higher than the molten metal temperature in the heat-retention radiation region 23. Accordingly, Marangoni convection occurs, and the molten metal flow 61 is formed toward the center from the side walls 37A and 37B of the hearth 30.

At this time, stagnation is liable to occur in the flow of the molten metal 5*c* at the center in the width direction of the hearth 30. Therefore, an electron beam for promoting LDI dissolving may be radiated at the stagnation position of the flow of the molten metal 5*c*. The LDIs 8 are liable to stagnate at the stagnation position of the molten metal flow. By radiating the electron beam for promoting LDI dissolving at a position at which LDIs stagnate in this manner, the LDIs 8 in the hearth can be dissolved more quickly.

[4.5. Summary]

A method for producing a metal ingot according to the present embodiment has been described above. According to the present embodiment, with respect to the surface of the molten metal 5*c* in the hearth 30, the two end portions e1 and e2 of the irradiation line 25 are positioned at the side walls 37 and the irradiation line 25 is disposed so as to block the lip portion 36. By this means, the molten metal flow path to the lip portion 36 which allows the molten metal inside the hearth 30 to flow out to the mold is blocked. As a result, the LDIs 8 are held back at the inflow opening to the lip portion 36. The LDIs 8 continue circulating through the inside of the hearth 30, and are dissolved while circulating. By this means, the LDIs 8 contained in the molten metal 5*c* can be prevented from flowing out from the lip portion 36 to the mold 40.

Further, by making the irradiation line 25 in the shape of a straight line, the scanning distance of the electron beam can be shortened. Therefore, even if the scanning speed of the electron beam decreases, there is little weakening of the flow of the molten metal 5*c* that is formed by radiating an electron beam along the irradiation line 25. Accordingly, since the LDIs 8 are reliably pushed back to the inner side of the hearth 30 before the LDIs 8 can flow into the lip portion 36, the LDIs 8 do not flow out from the hearth 30.

In addition, by making the irradiation line 25 a straight line shape, since it suffices for the electron gun(s) used to radiate an electron beam to be moved rectilinearly, the control of the electron gun(s) is easy, and the number of electron gun(s) that are used can be kept to a minimum.

Further, according to the method for producing a metal ingot of the present embodiment, since it is not necessary to change the shape of an existing hearth 30, the method can be easily implemented and special maintenance is also not required.

In the conventional methods for producing a titanium alloy, it is common to remove impurities by causing the molten metal to reside for a long time period in the hearth to thereby dissolve LDIs in the molten metal while also causing HDIs to adhere to a skull formed on the bottom face of the hearth. Consequently, conventionally, a long hearth has generally been used to thereby secure the residence time of the molten metal in the hearth. However, according to the method for producing a metal ingot of the present embodiment, since impurities can be appropriately removed even in a case where the residence time of molten metal in the hearth is comparatively short, it is possible to use a short hearth. Accordingly, by using a short hearth in the EB furnace 1, heating costs such as electricity expenses can be reduced, and the running cost of the EB furnace 1 can be decreased. In addition, by using a short hearth instead of a long hearth, the amount of the skull 7 that is generated in the hearth can be kept to a smaller amount compared to when using a long hearth. Therefore, the yield can be enhanced.

5. Disposition of Irradiation Line in Multi-Stage Hearth

Figure 19:
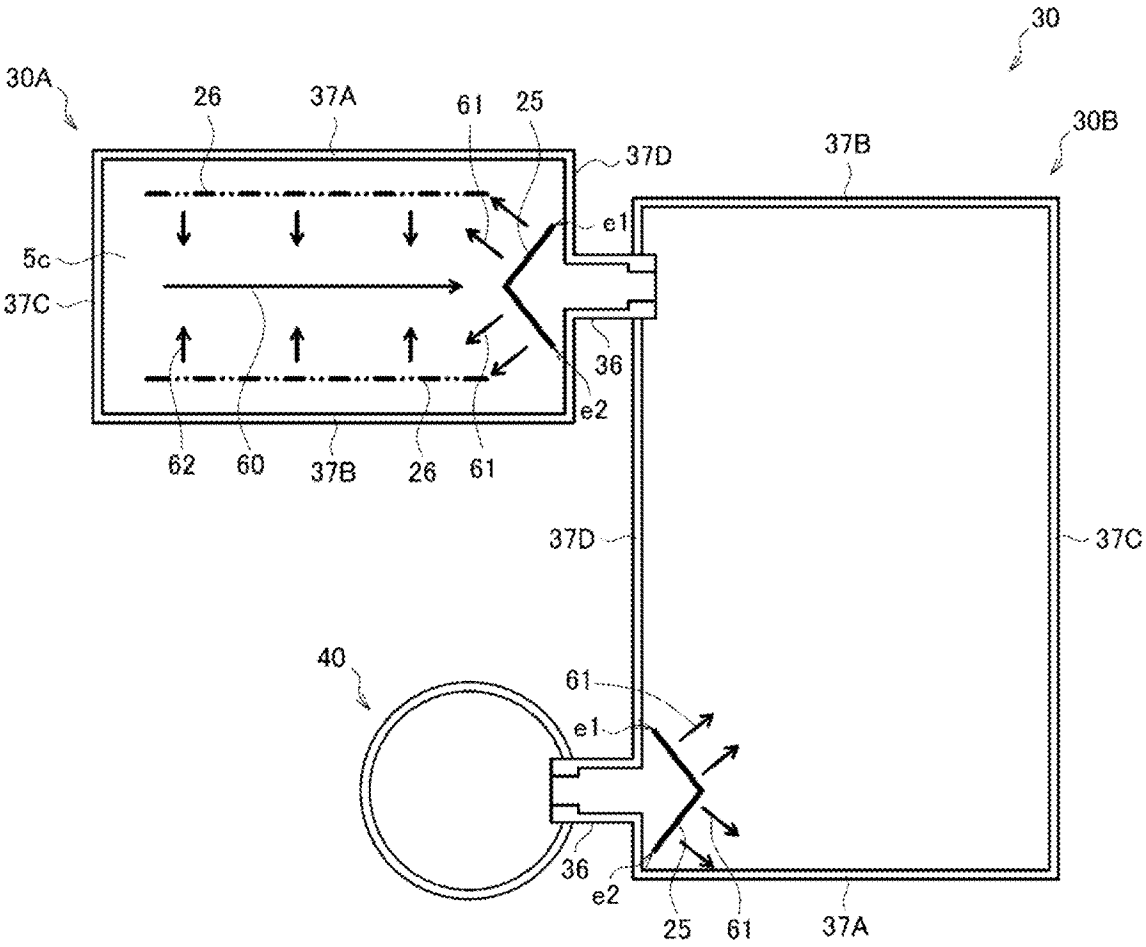
FIG. 19 is a schematic plan view illustrating one configuration example of a multi-stage hearth.

Although cases in which the methods for producing a metal ingot according to the foregoing embodiments are applied to the short hearth 30 illustrated in FIG. 3 or the long hearths 31 and 33 illustrated in FIG. 1 have been described above, the present invention is not limited to these examples. For example, a hearth to which the method for producing a metal ingot according to the present invention is applied may be a hearth with multiple stages in which a plurality of divided hearths are combined and arranged successively. For example, as illustrated in FIG. 19, a hearth 30 of two stages may be constituted by combining and arranging a first hearth 30A and a second hearth 30B in succession.

Similarly to the hearth 30 illustrated in FIG. 4, for example, the first hearth 30A (corresponds to "divided hearth" of the present invention) is an apparatus for refining a molten metal 5*c* of a raw material 5 that is dripped along supply lines 26 while accumulating the molten metal 5*c*, to thereby remove impurities contained in the molten metal 5*c*. The first hearth 30A is a rectangular hearth, and is constituted by four side walls 37A, 37B, 37C and 37D. A lip portion 36 is provided in the side wall 37D of the first hearth 30A. The molten metal 5*c* of the first hearth 30A that flows out from the lip portion 36 is accumulated in the second hearth 30B.

The second hearth 30B (corresponds to "divided hearth" of the present invention) is an apparatus for refining the molten metal 5*c* that flowed in from the first hearth 30A while accumulating the molten metal 5*c*, to thereby remove impurities contained in the molten metal 5*c*. The second hearth 30B is also a rectangular hearth, and is constituted by four side walls 37A, 37B, 37C and 37D. A lip portion 36 is provided in the side wall 37D of the second hearth 30B. The molten metal 5*c* of the second hearth 30B that flows out from the lip portion 36 flows out into a mold 40.

In this kind of hearth 30 with two stages that is constituted by two divided hearths, in each of the first hearth 30A and the second hearth 30B, two end portions e1 and e2 of the irradiation line 25 are positioned at the side wall 37, and the irradiation line 25 is disposed so as to block the lip portion 36. In each of the first hearth 30A and the second hearth 30B, the molten metal flow 61 is generated toward upstream from the irradiation line 25 by radiating an electron beam onto the surface of the molten metal 5*c* along the irradiation line 25. As a result, the flow of the molten metal 5*c* toward downstream in which the lip portion 36 is provided is pushed back to the upstream, and thus impurities such as LDIs can be inhibited from flowing out from the first hearth 30A to the second hearth 30B, and from flowing out from the second hearth 30B to the mold 40.

Note that, although the hearth with multiple stages that is illustrated in FIG. 19 is a hearth with two stages, the present invention is not limited to this example. The hearth with multiple stages may be a hearth with three or more stages in which three or more divided hearths are combined and arranged successively. In this case also, in each divided hearth, two end portions of an irradiation line are positioned in the vicinity of a side wall, and the irradiation line is disposed so as to block a lip portion. A molten metal flow is generated toward upstream from the irradiation line by radiating an electron beam onto the surface of the molten metal along the irradiation line. By this means, a flow of the molten metal toward downstream in which the lip portion is provided can be pushed back to the upstream, and thus impurities such as LDIs can be inhibited from flowing out into a hearth or a mold at a subsequent stage.

EXAMPLES

Next, examples of the present invention will be described. The following examples are merely concrete examples for verifying the effects of the present invention, and the present invention is not limited to the following examples.

(1) Examples of Line Radiation

First, referring to Table 1 and FIG. 20 to FIG. 43, examples will be described in which simulations were performed to verify an LDI removal effect obtained by line radiation according to the first to fourth embodiments of the present invention that are described above.

With respect to the present examples, in Examples 1 to 8 and 11 to 13 and Comparative Examples 1, 3 and 4, a molten metal flow inside the hearth 30 was simulated for a case where a titanium alloy was used as the raw material 5, and an electron beam was radiated along the irradiation line 25 with respect to the molten metal 5*c* of the titanium alloy that was accumulated inside the short hearth illustrated in FIG. 3. The temperature distribution of the molten metal 5*c* in the hearth 30, the behavior of LDIs, and the amount of the outflow of LDIs from the hearth 30 were ascertained. Further, in Examples 9 and 10 and Comparative Example 2, a molten metal flow inside the hearths 31 and 33 at a time when an electron beam was radiated along the irradiation line 25 with respect to the molten metal 5*c* of the titanium alloy that was accumulated inside the long hearth illustrated in FIG. 1 was simulated.

In Example 1, as illustrated in FIG. 4, the two end portions e1 and e2 of a V-shaped irradiation line 25 were positioned at the side wall 37D, and the V-shaped irradiation line 25 was disposed so as to cover the lip portion 36, and an electron beam was radiated along the irradiation line 25.

In Example 2, as illustrated in FIG. 7, the two end portions e1 and e2 of a circular arc-shaped irradiation line 25 were positioned at the side wall 37D, and the circular arc-shaped irradiation line 25 was disposed so as to cover the lip portion 36, and an electron beam was radiated along the irradiation line 25.

In Example 3, as illustrated in FIG. 10, the two end portions e1 and e2 of a T-shaped irradiation line 25 were positioned at the side wall 37D, and the T-shaped irradiation line 25 was disposed so as to cover the lip portion 36, and an electron beam was radiated along the irradiation line 25.

Figures 25, 26:
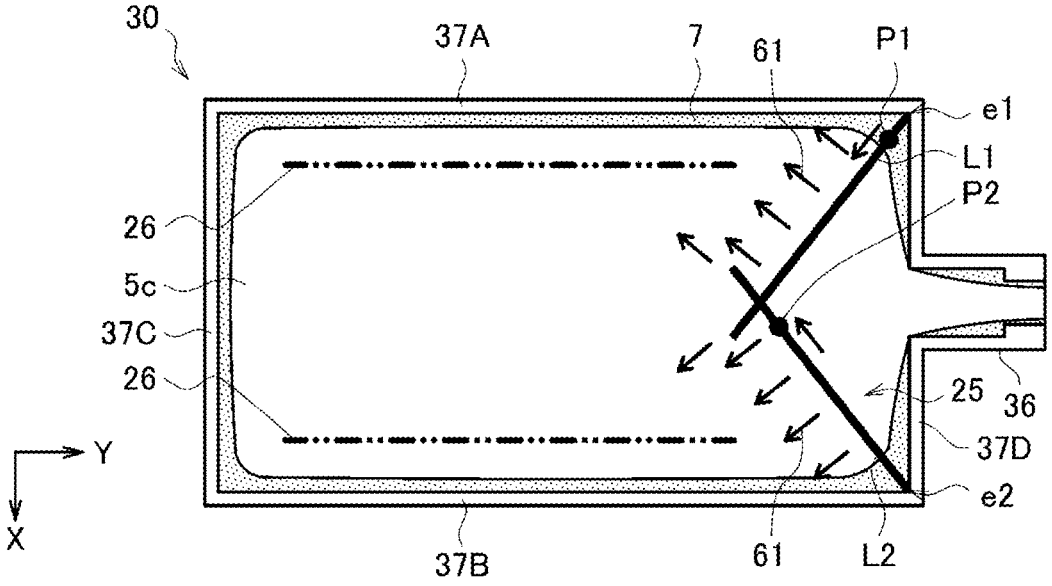
FIG. 25 is an explanatory drawing illustrating irradiation lines of Example 5.
FIG. 26 is an explanatory drawing illustrating a simulation result according to Example 5.

Examples 4 and 5 are examples of a case where electron beams are radiated onto the irradiation line 25 using two electron guns. In Example 4, as illustrated in FIG. 11, the two end portions e1 and e2 of a V-shaped irradiation line 25 were positioned at both ends of the side wall 37D, and the V-shaped irradiation line 25 was disposed so as to cover the lip portion 36, and electron beams were radiated along the irradiation line 25. In Example 5, as illustrated in FIG. 25, although the irradiation line 25 was disposed in a similar manner to FIG. 11 (Example 4), the scanning direction of the electron beams was changed. The heat transfer amount of the electron beam of the two electron guns used in each of Example 4 and Example 5 was 0.125 [MW], respectively.

Figure 27:
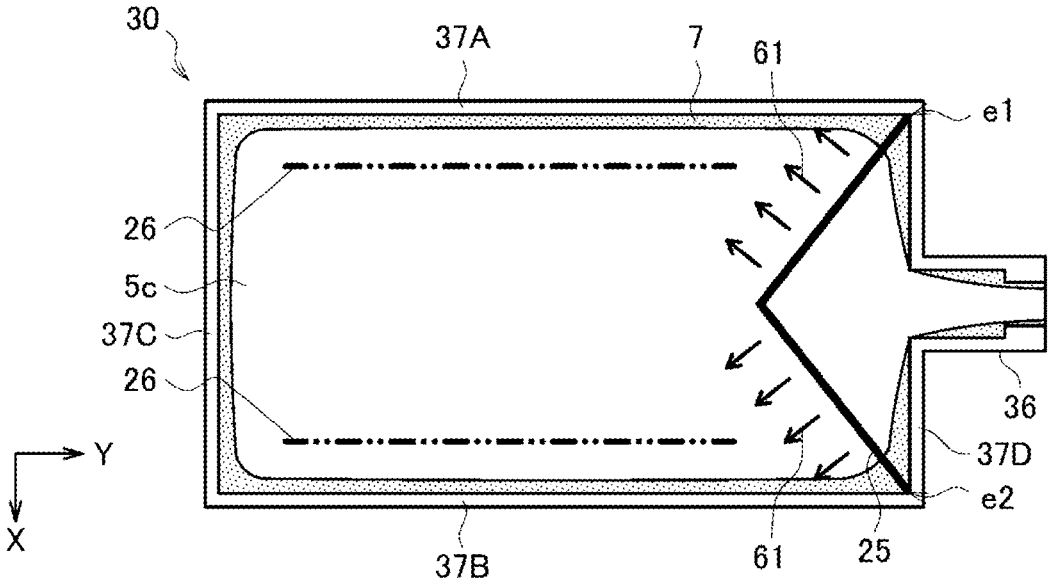
FIG. 27 is an explanatory drawing illustrating an irradiation line of Example 6.

In Example 6, as illustrated in FIG. 27, the two end portions e1 and e2 of a V-shaped irradiation line 25 were positioned at both ends of the side wall 37D, and the V-shaped irradiation line 25 was disposed so as to cover the lip portion 36, and an electron beam was radiated along the irradiation line 25.

Figure 29:
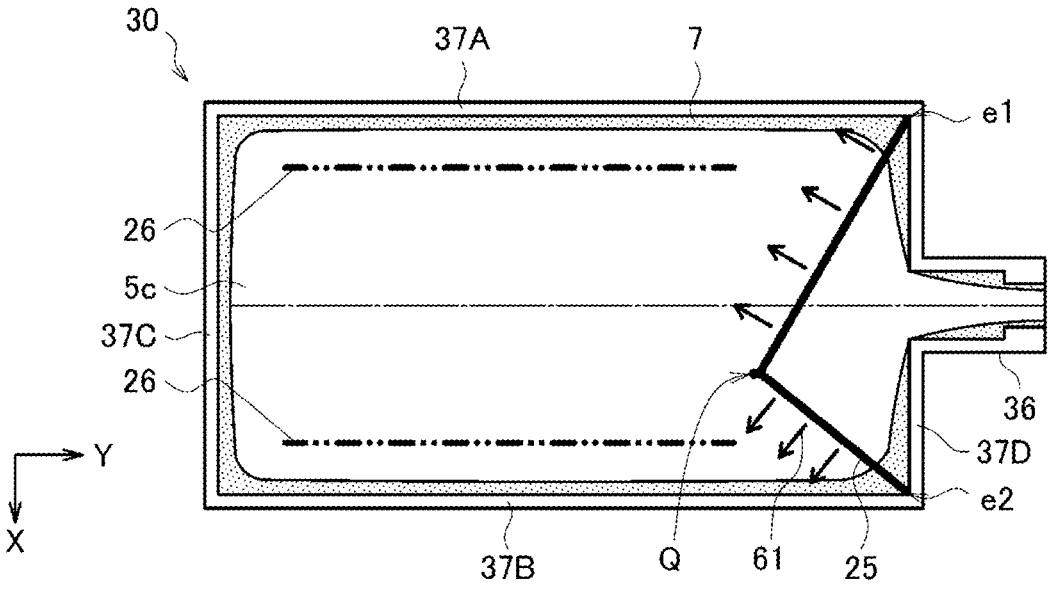
FIG. 29 is an explanatory drawing illustrating an irradiation line of Example 7.

In Example 7, as illustrated in FIG. 29, the two end portions e1 and e2 of a V-shaped irradiation line 25 were positioned at both ends of the side wall 37D, and the V-shaped irradiation line 25 was disposed so as to cover the lip portion 36, and an electron beam was radiated along the irradiation line 25. In Example 7, a vertex Q of the V-shape was disposed at a position that deviated from the center in the width direction of the hearth 30.

In Example 8, as illustrated in FIG. 12, the two end portions e1 and e2 of an irradiation line 25 having a straight line shape were positioned at the side wall 37D, and the straight line-shaped irradiation line 25 was disposed so as to cover the lip portion 36, and an electron beam was radiated along the irradiation line 25.

In Example 9, as illustrated in FIG. 14, in the long hearths 31 and 33, the two end portions e1 and e2 of an irradiation line 25 having a straight line shape were positioned at both ends of the side wall 37D, and the straight line-shaped irradiation line 25 was disposed so as to cover the lip portion 36, and an electron beam was radiated along the irradiation line 25.

In Example 10, as illustrated in FIG. 15, in the long hearths 31 and 33, the two end portions e1 and e2 of an irradiation line 25 having a straight line shape were positioned at both ends of the side wall 37D, and the straight line-shaped irradiation line 25 was disposed at the center in the longitudinal direction of the long hearths 31 and 33, and an electron beam was radiated along the irradiation line 25.

In Example 11, as illustrated in FIG. 16, the two end portions e1 and e2 of a V-shaped irradiation line 25 were positioned at the side walls 37A and 37B, and the V-shaped irradiation line 25 that projected toward the lip portion 36 was disposed so as to cover the lip portion 36, and an electron beam was radiated along the irradiation line 25.

In Example 12, as illustrated in FIG. 17, the two end portions e1 and e2 of a circular arc-shaped irradiation line 25 were positioned at the side walls 37A and 37B, and the circular arc-shaped irradiation line 25 that projected toward the lip portion 36 was disposed so as to cover the lip portion 36, and an electron beam was radiated along the irradiation line 25.

In Example 13, as illustrated in FIG. 18, the two end portions e1 and e2 of a U-shaped irradiation line 25 were positioned at the side walls 37A and 37B, and the U-shaped irradiation line 25 that projected toward the lip portion 36 was disposed so as to cover the lip portion 36, and an electron beam was radiated along the irradiation line 25.

On the other hand, as Comparative Example 1, a similar simulation was performed with respect to a case where an electron beam for heat retention was radiated onto the heat-retention radiation region 23 of the molten metal 5*c* in the hearth 30, in which line radiation along irradiation lines 25 and 25 was not performed.

Figure 38:
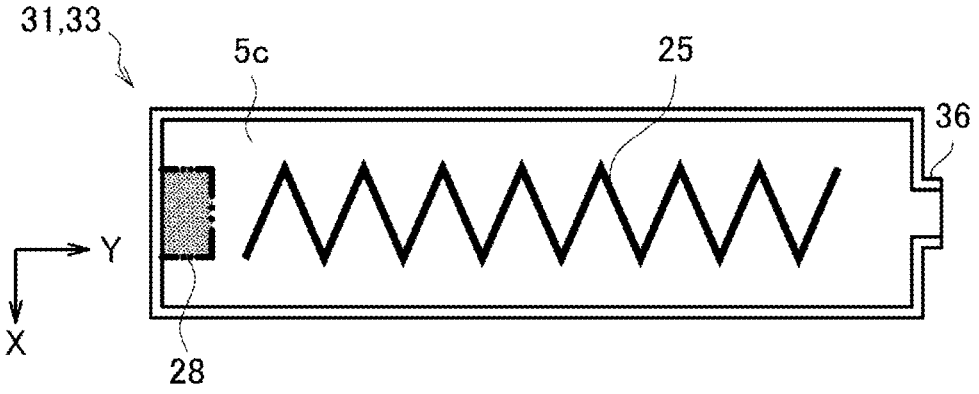
FIG. 38 is an explanatory drawing illustrating an irradiation line of Comparative Example 2.

In Comparative Example 2, a simulation was performed with respect to the method disclosed in Patent Document 1 that is described above. In other words, as illustrated in FIG. 38, a zig-zag-shaped irradiation line 25 was disposed on the surface of the molten metal 5*c* inside the long hearths 31 and 33, and an electron beam was radiated along the irradiation line 25.

Figure 40:
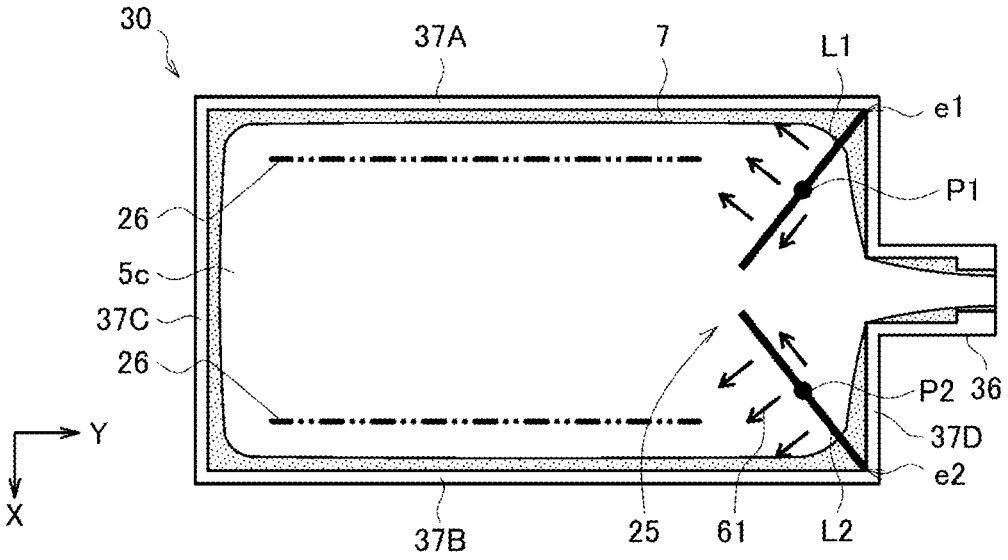
FIG. 40 is an explanatory drawing illustrating irradiation lines of Comparative Example 3.

In Comparative Example 3, as a comparison with Example 4, as illustrated in FIG. 40, electron beams were radiated along a V-shaped irradiation line 25 in which lines did not intersect at the vertex. Note that the heat transfer amount of each electron beam of the two electron guns used in Comparative Example 3 was 0.125 MW, respectively.

Figure 42:
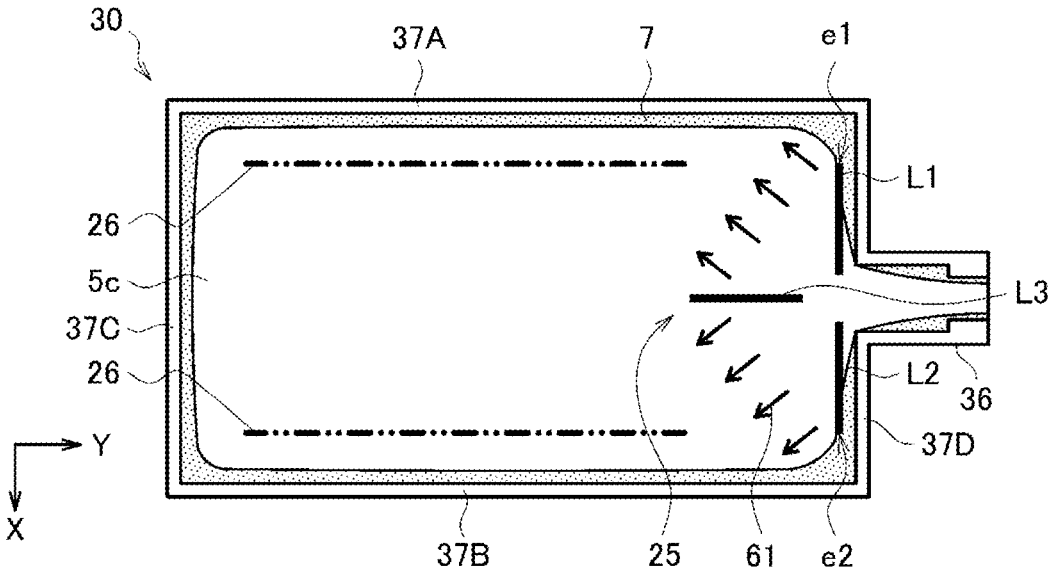
FIG. 42 is an explanatory drawing illustrating an irradiation line of Comparative Example 4.

In Comparative Example 4, as a comparison with Example 3, as illustrated in FIG. 42, electron beams were radiated along three straight lines of a T-shaped irradiation line 25 in which the three straight lines did not intersect. The irradiation line 25 illustrated in FIG. 42 was constituted by a first straight line portion L1 and a second straight line portion L2 along the side wall 37D in which the lip portion 36 was provided, and a third straight line portion L3 perpendicular to the side wall 37D. The first straight line portion L1, the second straight line portion L2 and the third straight line portion L3 did not contact each other. Note that, the heat transfer amount of the electron beams radiated along the first straight line portion L1 and the second straight line portion L2 was 0.05 MW, respectively, and the heat transfer amount of the electron beam radiated along the third straight line portion L3 was 0.15 MW. Further, the scanning speed of the electron beams radiated along the first straight line portion L1 and the second straight line portion L2 was 2.9 m/s, and the scanning speed of the electron beam radiated along the third straight line portion L3 was 3.6 m/s.

The simulation conditions of the present examples are shown in Table 1.

TABLE 1

| | Electron Beam Heat Transfer Amount [MW] | Electron Beam Scanning Speed [m/s] | Electron Beam Heat Flux Distribution (σ[m]) | Radiation Path Shape |
|---|---|---|---|---|
| Example 1 | 0.25 | 1.8 | 0.02 | V-shape |
| Example 2 | 0.35 | 1.7 | 0.02 | Circular Arc Shape |

TABLE 1-continued

| | Electron Beam Heat Transfer Amount [MW] | Electron Beam Scanning Speed [m/s] | Electron Beam Heat Flux Distribution (σ[m]) | Radiation Path Shape |
|---|---|---|---|---|
| Example 3 | d1: 0.09<br>d2: 0.15<br>d3: 0.09 | 2.94 | 0.013 | T-shape |
| Example 4 | 0.125 | 1.8 | 0.02 | V-shape |
| Example 5 | 0.125 | 1.8 | 0.02 | V-shape |
| Example 6 | 0.25 | 1.8 | 0.02 | V-shape |
| Example 7 | 0.25 | 1.8 | 0.02 | V-shape |
| Example 8 | 0.25 | 1.6 | 0.02 | Straight Line Shape |
| Example 9 | 0.25 | 1.6 | 0.02 | Straight Line Shape |
| Example 10 | 0.25 | 2.0 | 0.02 | Straight Line Shape |
| Example 11 | 0.30 | 1.8 | 0.02 | V-shape |
| Example 12 | 0.25 | 1.8 | 0.02 | Circular Arc Shape |
| Example 13 | 0.30 | 1.8 | 0.02 | U-shape |
| Comparative Example 1 | — | — | — | (No Radiation) |
| Comparative Example 2 | 0.25 | 1.9 | 0.02 | Zig-zag |
| Comparative Example 3 | 0.125 | 1.8 | 0.02 | V-shape |
| Comparative Example 4 | L1: 0.05<br>L2: 0.05<br>L3: 0.15 | L1: 2.9<br>L2: 2.9<br>L3: 3.6 | 0.02 | T-shape |

For each simulation, a transient calculation was performed because the flow and the temperature of the molten metal 5*c* change from moment to moment depending on scanning of an electron beam. The simulation was performed based on the assumption that the LDIs were titanium nitride, the grain size of the titanium nitride was 3.5 mm, and the density of the titanium nitride was 10% less than the molten metal 5*c*.

The simulation results for Examples 1 to 13 and Comparative Examples 1 to 4 are described hereunder. FIGS. 20 to 24, 26, 28, and 30 to 36 show the simulation results for Examples 1 to 13, respectively, and FIGS. 37, 39, 41 and 43 show the simulation results for Comparative Examples 1 to 4, respectively.

FIGS. 20, 22 to 24, 26, 28 and 30 to 36 and FIGS. 37, 39, 41 and 43 show the temperature distribution at the surface of the molten metal 5*c* inside the hearth and the behavior of LDIs that flow on the surface of the molten metal 5*c*, at a time when the radiation position of an electron beam for line radiation that is radiated along the irradiation line 25 is at a representative position. In the temperature distribution charts on the left side of the aforementioned FIGS. 20, 22 to 24, 26, 28 and 30 to 36 and FIGS. 37, 39, 41 and 43, a region at which the temperature is high that is marked with a round circle indicates a radiation position of an electron beam with respect to the irradiation line 25 at that time point, two upper and lower belt-like portions with a high temperature indicate the two supply lines 26, and a low temperature portion in the vicinity of an inside face of the hearth indicates a portion at which the skull 7 is formed. Further, in the flow line diagrams on the right side in FIGS. 20, 22 to 24, 26, 28 and 30 to 36 and FIGS. 37, 39, 41 and 43, flow lines that are drawn in a non-linear shape indicate the flow trajectory of LDIs.

Example 1

Figure 20:
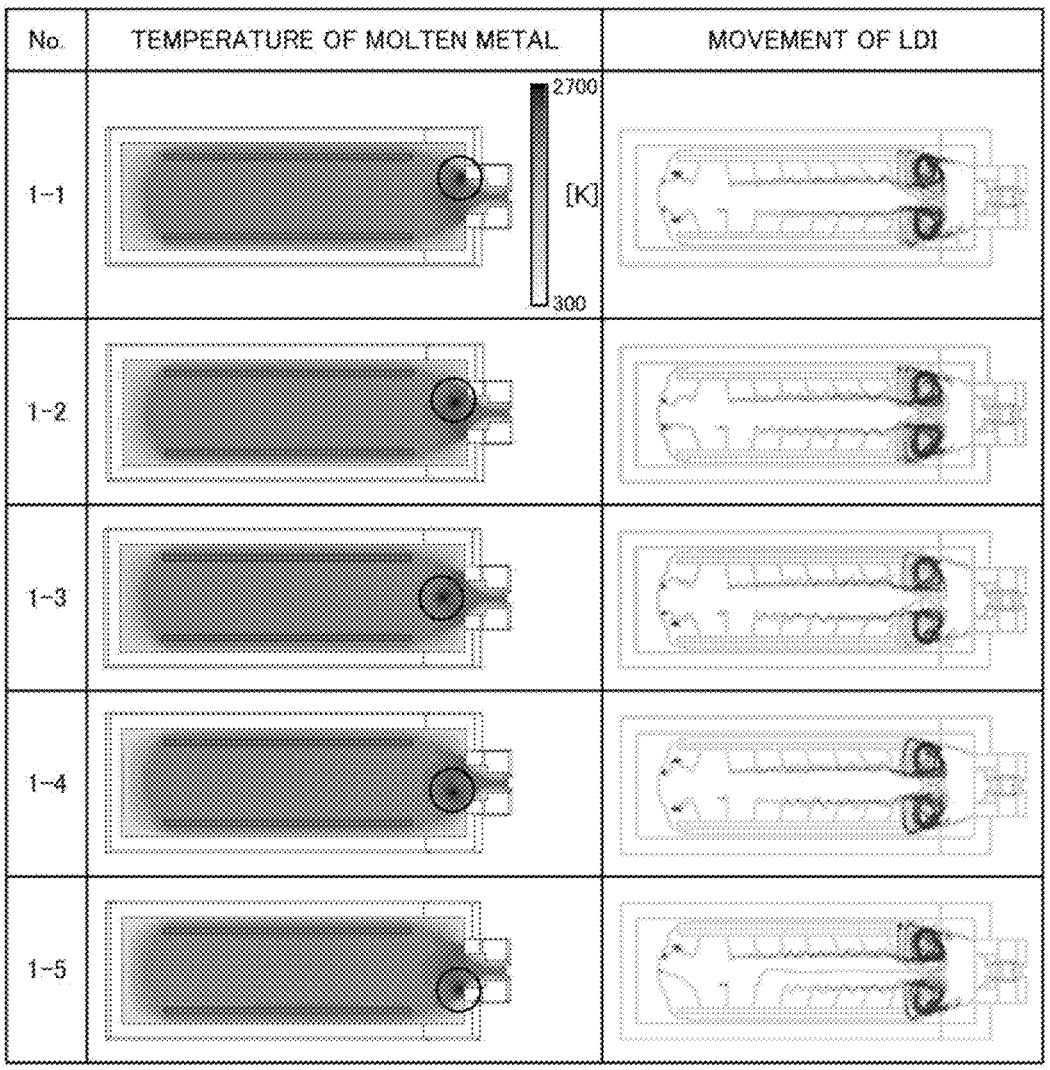
FIG. 20 is an explanatory drawing illustrating a simulation result according to Example 1.
Figure 21:
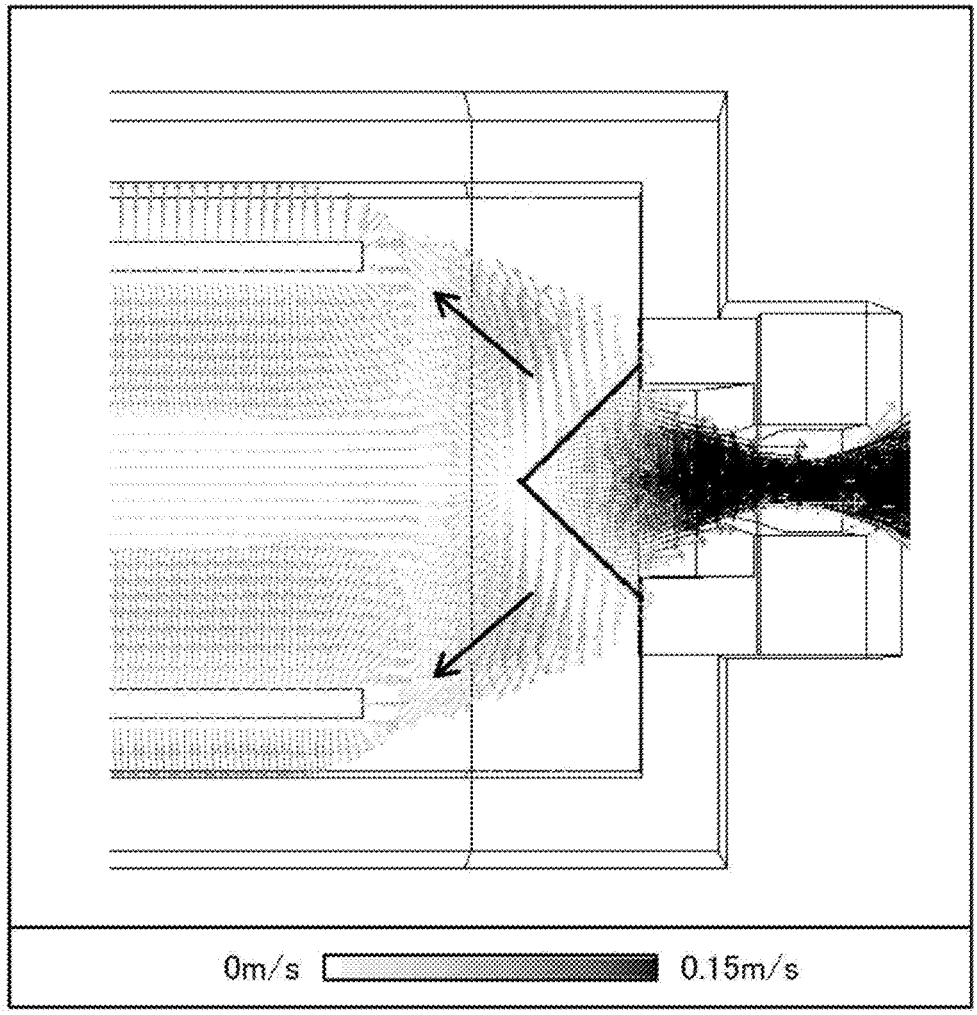
FIG. 21 is a flow line diagram illustrating the flowage of molten metal according to Example 1.

In Example 1, as illustrated in FIG. 20, a high temperature region was formed along the irradiation line 25 blocking the lip portion 36, and the molten metal flow 61 was formed toward the upstream from the irradiation line 25. Therefore, as illustrated in FIG. 20, all of the LDIs that flowed from the supply lines toward the lip portion 36 rode on the molten metal flow 61 and flowed toward the side walls 37A and 37B, and there was no flow line that passed through the lip portion 36 and extended to the mold 40 side. It was thus found that the LDIs inside the hearth 30 were pushed back to the upstream side, and did not flow out from the lip portion 36 to the mold 40. FIG. 21 illustrates arrows that represent the flow direction and strength of a flow of the molten metal 5*c* at respective sites in the vicinity of the irradiation line 25 in Example 1. Based on FIG. 21 also, it was found that a strong flow of the molten metal 5*c* with a large flow velocity was formed from the irradiation line 25 in a direction that was toward upstream and toward the side walls 37A and 37B.

Example 2

Figure 22:
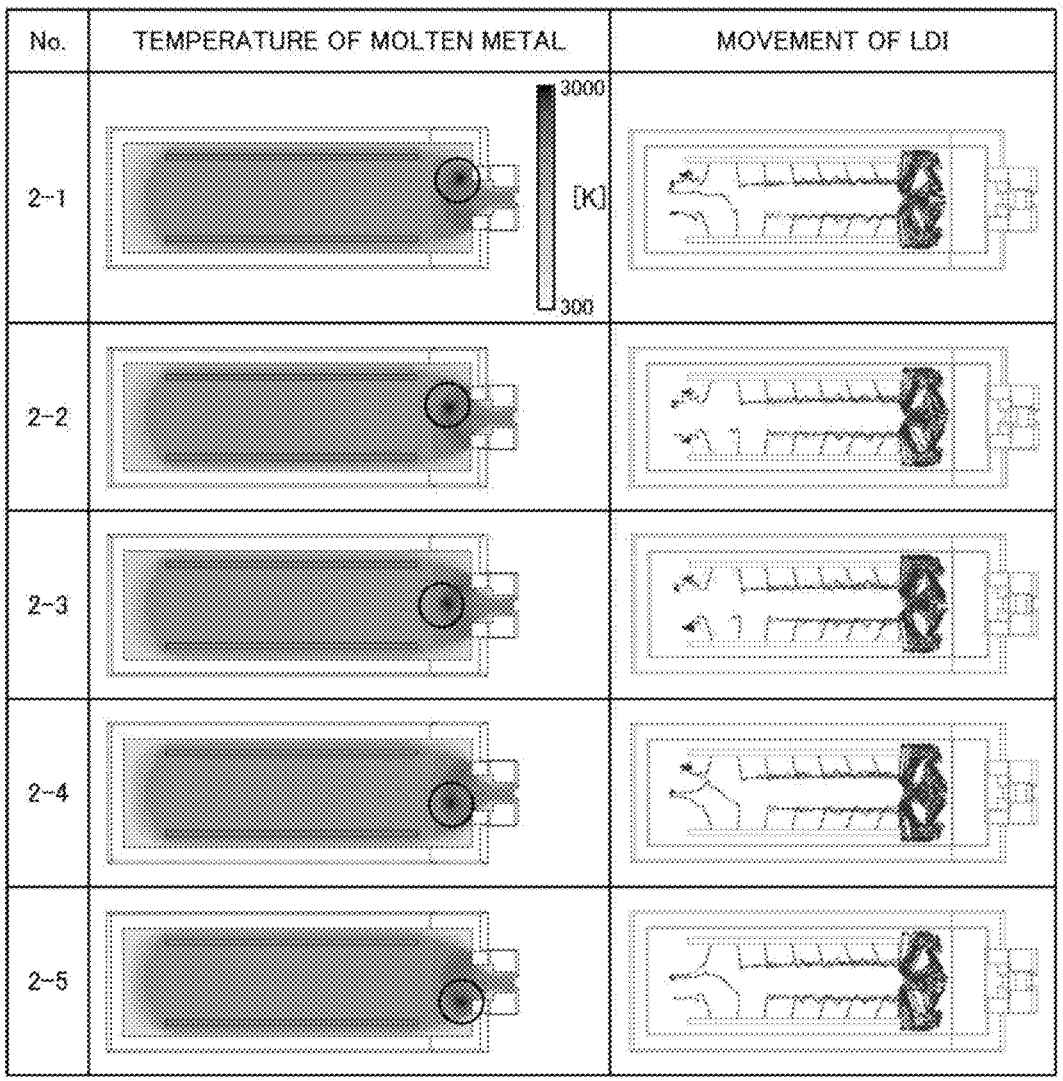
FIG. 22 is an explanatory drawing illustrating a simulation result according to Example 2.

As illustrated in FIG. 22, in Example 2 also, similarly to Example 1, a high temperature region was formed along the irradiation line 25 blocking the lip portion 36, and the molten metal flow 61 was formed toward the upstream from the irradiation line 25. Therefore, all of the LDIs that flowed from the supply lines toward the lip portion 36 rode on the molten metal flow 61 and flowed toward the side walls 37A and 37B, and there was no flow line that passed through the lip portion 36 and extended to the mold 40 side. It was thus found that the LDIs inside the hearth 30 were pushed back to the upstream side, and did not flow out from the lip portion 36 to the mold 40.

Example 3

Figure 23:
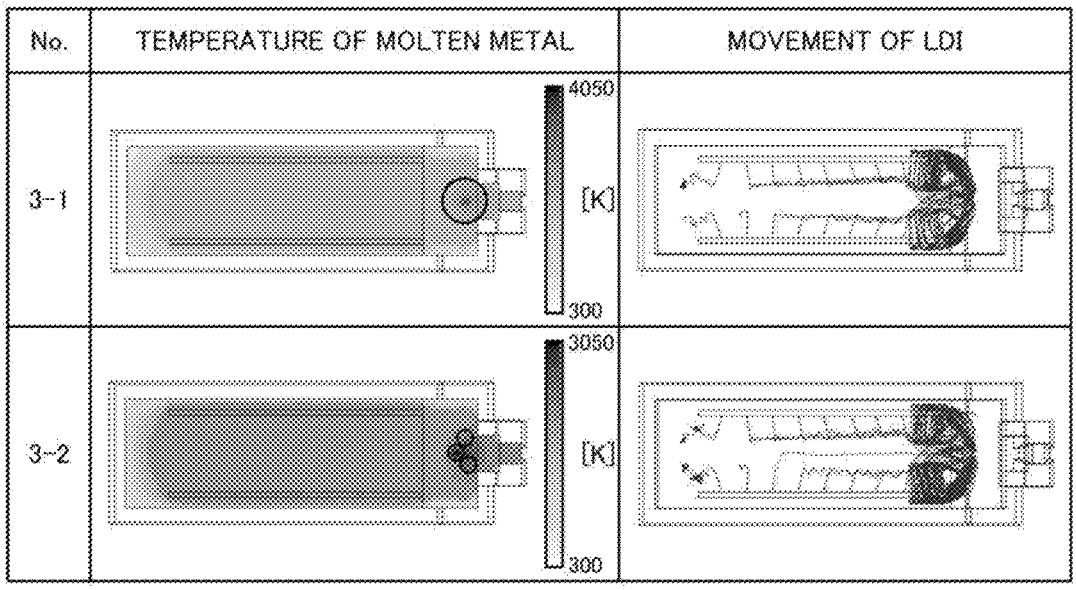
FIG. 23 is an explanatory drawing illustrating a simulation result according to Example 3.

In Example 3 also, similarly to Examples 1 and 2, as illustrated in FIG. 23, a high temperature region was formed along the irradiation line 25 blocking the lip portion 36, and the molten metal flow 61 was formed toward the upstream from the irradiation line 25. Therefore, all of the LDIs that flowed from the supply lines toward the lip portion 36 rode on the molten metal flow 61 and flowed toward the side walls 37A and 37B, and there was no flow line that passed through the lip portion 36 and extended to the mold 40 side. It was thus found that the LDIs inside the hearth 30 were pushed back to the upstream side, and did not flow out from the lip portion 36 to the mold 40.

Examples 4 and 5

Figure 24:
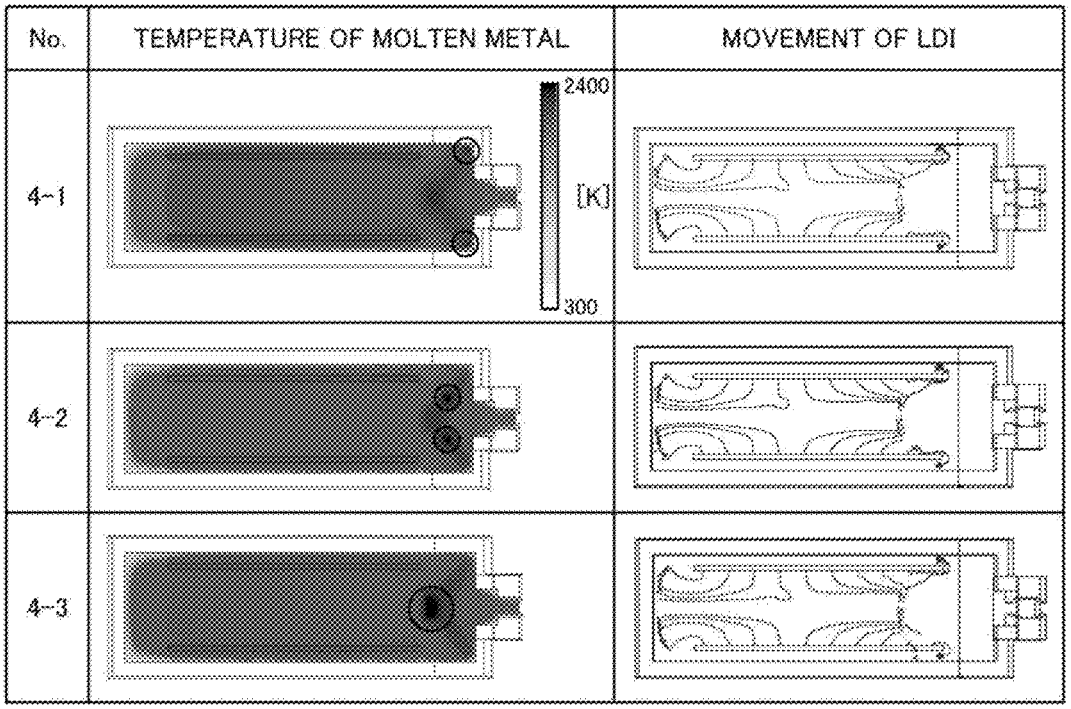
FIG. 24 is an explanatory drawing illustrating a simulation result according to Example 4.

In Examples 4 and 5, electron beams were radiated along the irradiation line 25 using two electron guns. In Example 4, two electron guns radiated electron beams along the irradiation line 25 so that the electron beams were positioned at the vertex of a V-shape at the same timing. Further, in Example 5, two electron guns radiated electron beams along the irradiation line 25 so that when the electron beam from one of the electron guns was positioned at the vertex of a V-shape, the electron beam from the other electron gun was positioned at a central part of the irradiation line. FIG. 24 shows the simulation result of Example 4, and FIG. 26 shows the simulation result of Example 5.

In the case of both Example 4 and Example 5, as illustrated in FIG. 24 and FIG. 26, similarly to Examples 1 to 3, a high temperature region was formed along the irradiation line 25 blocking the lip portion 36, and the molten metal flow 61 was formed toward the upstream from the irradiation line 25. Therefore, all of the LDIs that flowed from the supply lines toward the lip portion 36 rode on the molten metal flow 61 and flowed toward the side walls 37A and 37B, and there was no flow line that passed through the lip portion 36 and extended to the mold 40 side. It was thus found that the LDIs inside the hearth 30 were pushed back to the upstream side, and did not flow out from the lip portion 36 to the mold 40.

Examples 6 and 7

Figure 28:
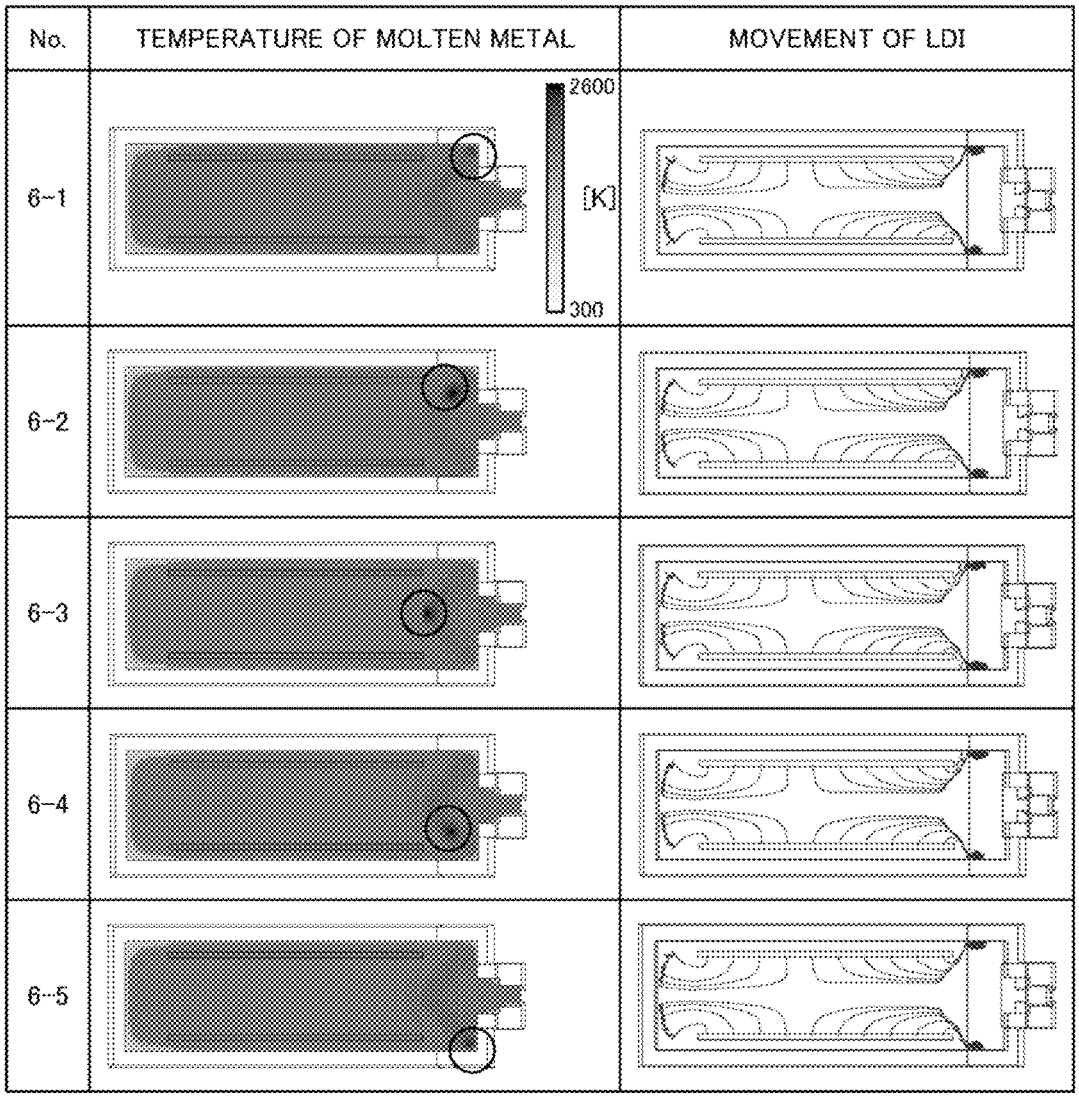
FIG. 28 is an explanatory drawing illustrating a simulation result according to Example 6.
Figure 30:
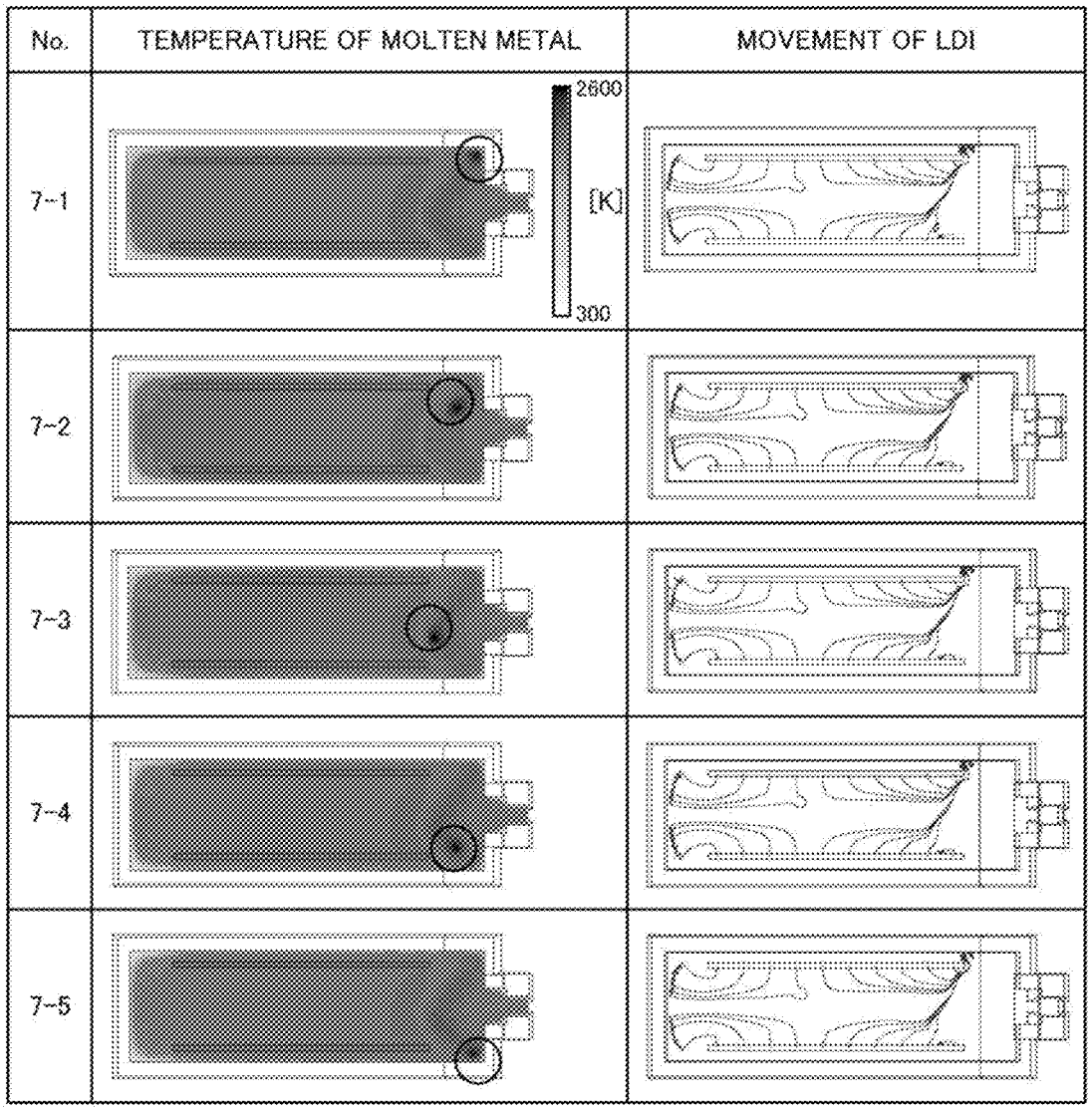
FIG. 30 is an explanatory drawing illustrating a simulation result according to Example 7.

In Examples 6 and 7, although a V-shaped irradiation line 25 was disposed similarly to Example 1, the V-shape was different from Example 1. However, in Examples 6 and 7 also, similarly to Examples 1 to 5, as illustrated in FIG. 28 and FIG. 30, a high temperature region was formed along the irradiation line 25 blocking the lip portion 36, and the molten metal flow 61 was formed toward the upstream from the irradiation line 25. Therefore, all of the LDIs that flowed from the supply lines toward the lip portion 36 rode on the molten metal flow 61 and flowed toward the side walls 37A and 37B, and there was no flow line that passed through the lip portion 36 and extended to the mold 40 side. It was thus found that the LDIs inside the hearth 30 were pushed back to the upstream side, and did not flow out from the lip portion 36 to the mold 40.

Examples 8 to 10

Figure 31:
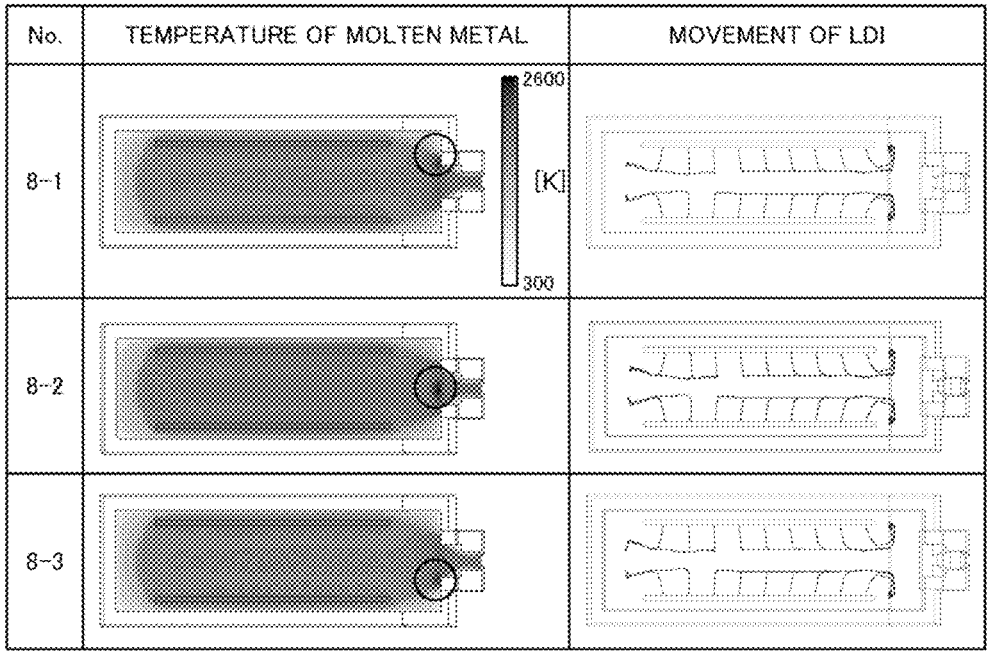
FIG. 31 is an explanatory drawing illustrating a simulation result according to Example 8.
Figure 32:
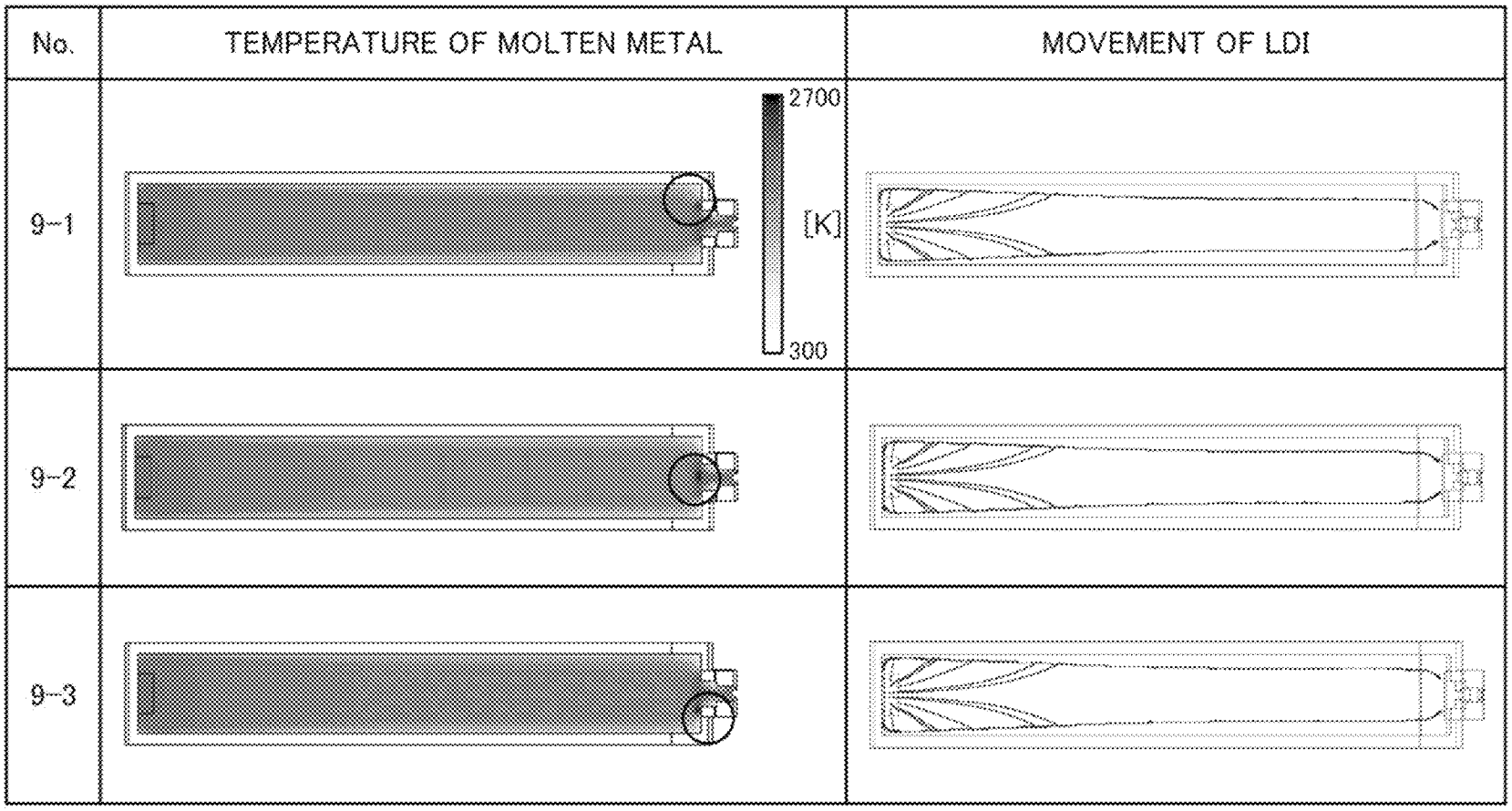
FIG. 32 is an explanatory drawing illustrating a simulation result according to Example 9.
Figure 33:
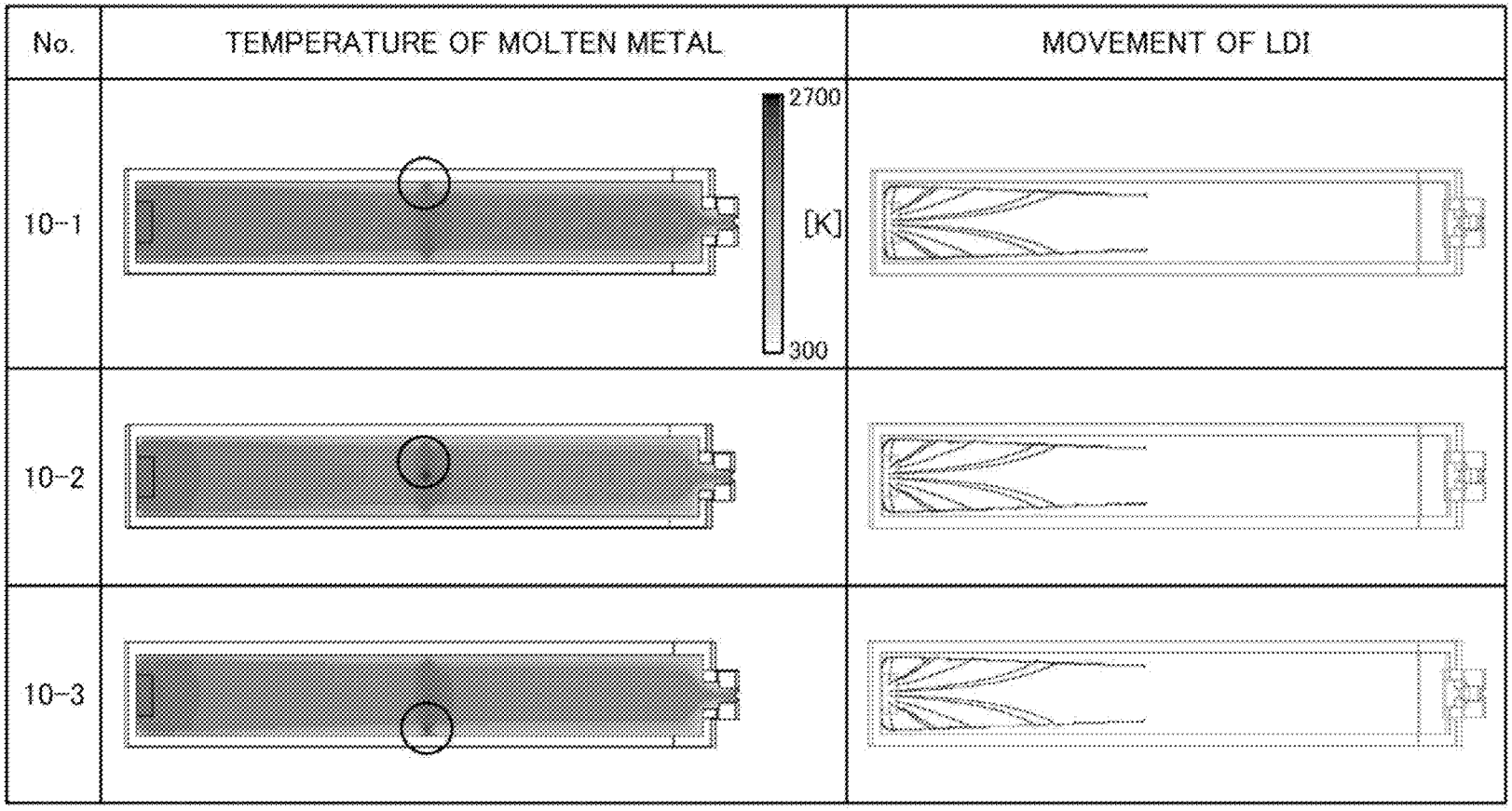
FIG. 33 is an explanatory drawing illustrating a simulation result according to Example 10.

In Examples 8 to 10, the irradiation line 25 that had a straight line shape was disposed. FIG. 31 shows the simulation result of Example 8, FIG. 32 shows the simulation result of Example 9, and FIG. 33 shows the simulation result of Example 10. The manner in which the rectilinear irradiation line 25 was disposed or the hearth that was used differed between Examples 8 to 10. However, in Examples 8 to 10 also, similarly to Examples 1 to 7, as illustrated in FIG. 31 to FIG. 33, a high temperature region was formed along the irradiation line 25 blocking the lip portion 36, and the molten metal flow 61 was formed toward the upstream from the irradiation line 25. Therefore, all of the LDIs that flowed from the supply lines toward the lip portion 36 rode on the molten metal flow 61 and flowed toward the side walls 37A and 37B, and there was no flow line that passed through the lip portion 36 and extended to the mold 40 side. It was thus found that the LDIs inside the hearth 30 were pushed back to the upstream side, and did not flow out from the lip portion 36 to the mold 40. Note that, based on FIG. 31 to FIG. 33, it was found that there are stagnation positions at which LDIs stagnate in the vicinity of the end portions of the irradiation line 25. Thereafter, these LDIs ride on a molten metal flow in the hearth and circulate through the inside of the hearth. However, even if the LDIs arrive at the irradiation line 25 once more, after the LDIs stagnate at the same positions, the LDIs circulate through the inside of the hearth once again. The LDIs dissolve while circulating through the inside of the hearth. Alternatively, an electron beam for promoting LDI dissolving can also be radiated at the stagnation positions to promote dissolving of the LDIs.

Examples 11 to 13

Figure 34:
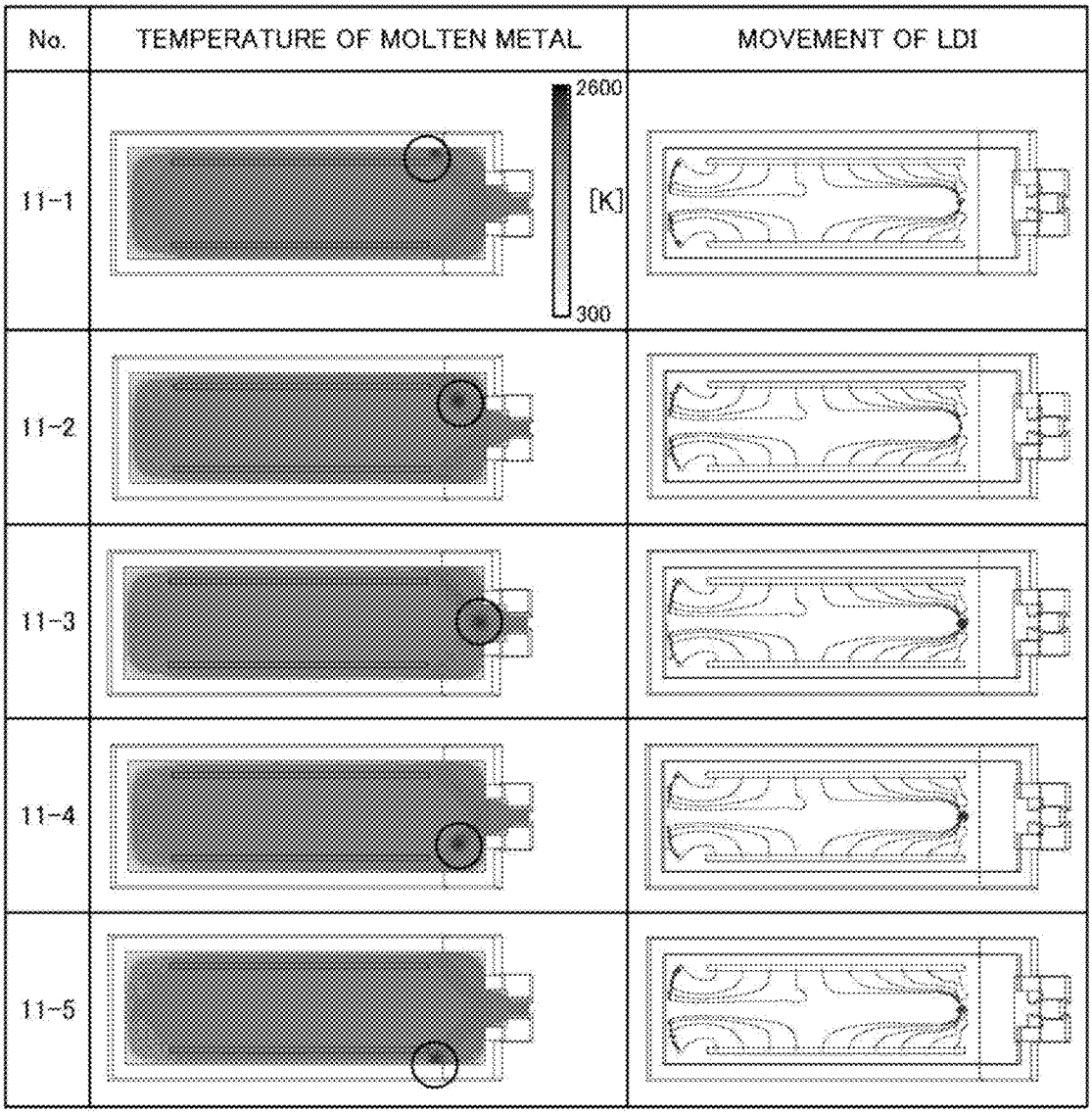
FIG. 34 is an explanatory drawing illustrating a simulation result according to Example 11.
Figure 35:
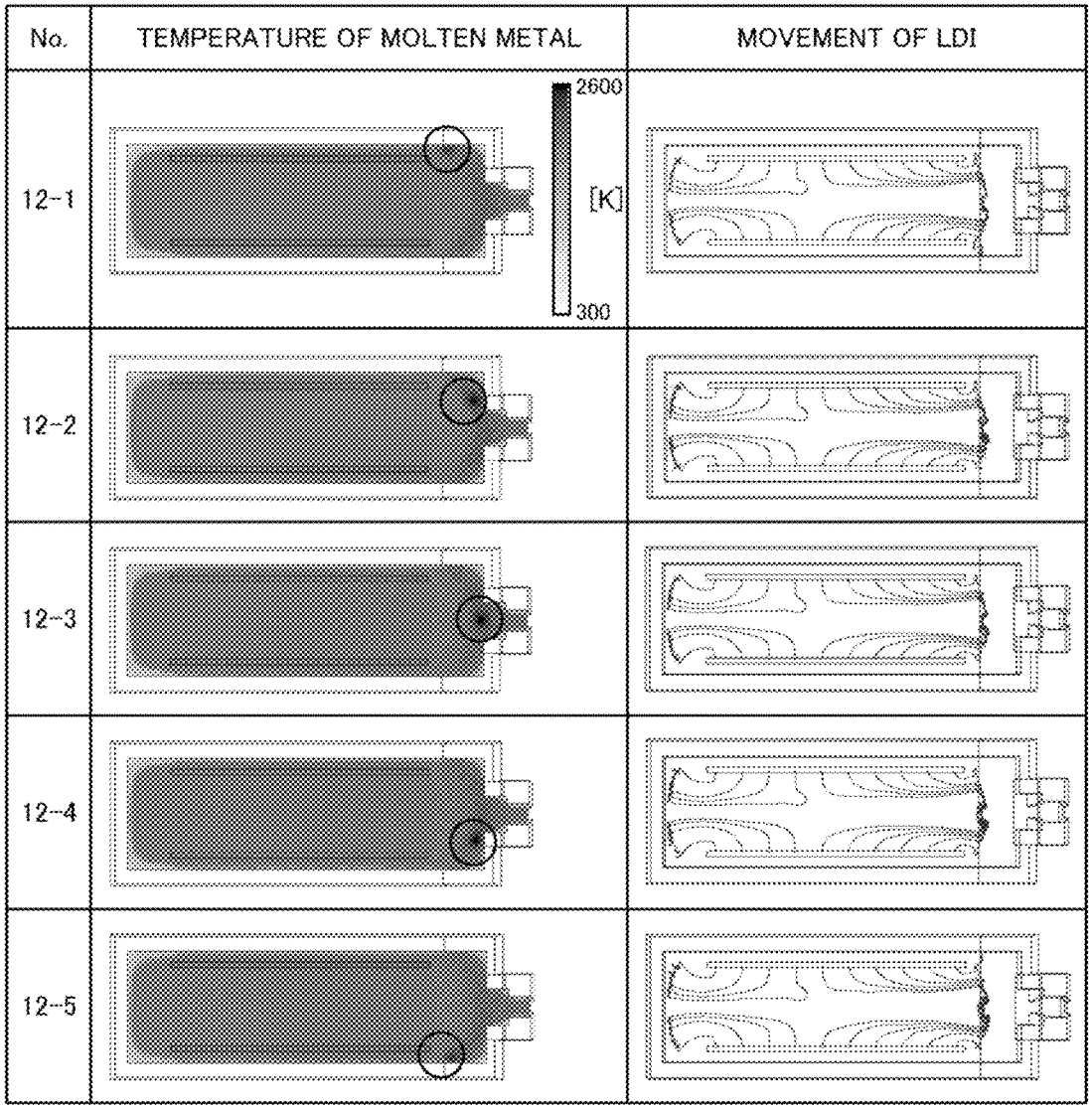
FIG. 35 is an explanatory drawing illustrating a simulation result according to Example 12.
Figure 36:
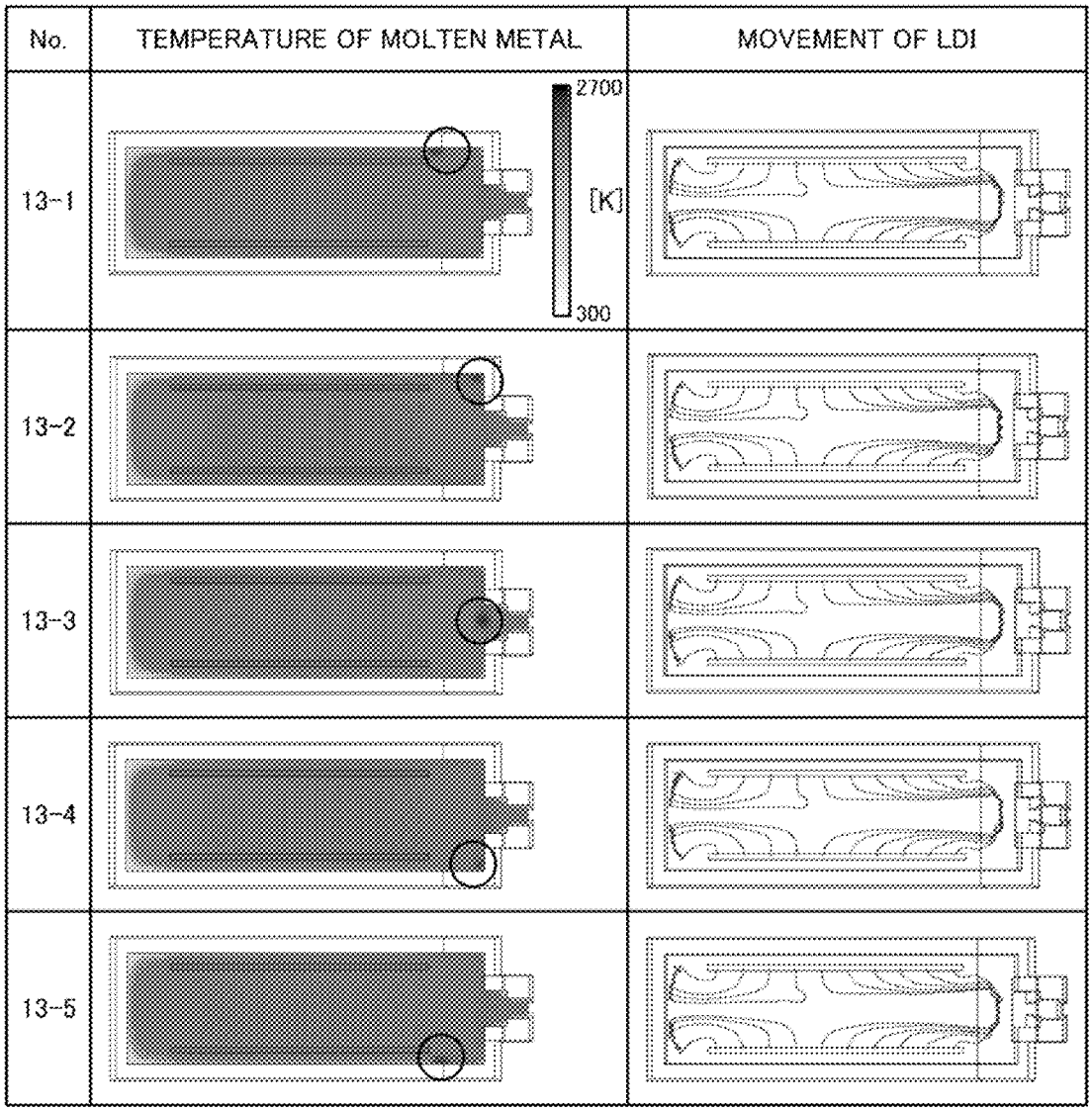
FIG. 36 is an explanatory drawing illustrating a simulation result according to Example 13.

In Examples 11 to 13, the irradiation line 25 that had a convex shape projecting toward the lip portion 36 from the upstream was disposed. FIG. 34 shows the simulation result of Example 11, FIG. 35 shows the simulation result of Example 12, and FIG. 36 shows the simulation result of Example 13. The convex shape of the irradiation line 25 differed between Examples 11 to 13. However, in Examples 11 to 13 also, similarly to Examples 1 to 10, as illustrated in FIG. 34 to FIG. 36, a high temperature region was formed along the irradiation line 25 blocking the lip portion 36, and the molten metal flow 61 was formed toward the upstream from the irradiation line 25. Therefore, all of the LDIs that flowed from the supply lines toward the lip portion 36 rode on the molten metal flow 61 and flowed toward the upstream, and there was no flow line that passed through the lip portion 36 and extended to the mold 40 side. It was thus found that the LDIs inside the hearth 30 were pushed back to the upstream side, and did not flow out from the lip portion 36 to the mold 40.

Note that, based on FIG. 34 to FIG. 36, it was found that, similarly to Examples 8 to 10, between the irradiation line 25 and the supply lines 26, there are stagnation positions at which LDIs stagnate at the center in the width direction of the hearth 30. Thereafter, these LDIs ride on a molten metal flow in the hearth and circulate through the inside of the hearth. However, even if the LDIs arrive at the irradiation line 25 once more, after the LDIs stagnate at the same positions, the LDIs circulate through the inside of the hearth once again. The LDIs dissolve while circulating through the inside of the hearth. Alternatively, an electron beam for promoting LDI dissolving can also be radiated at the stagnation position to promote dissolving of the LDIs. Further, based on the simulation results of Examples 8 to 13, it was found that the stagnation positions at which LDIs are liable to stagnate can be adjusted by changing the disposition and shape of the irradiation line 25.

Note that, in Example 1 to Example 13, the respective electron beams were radiated so that the irradiation line 25 blocked the lip portion 36. However, it is possible to appropriately change the disposition of the irradiation line 25 as long as the heat transfer amount, scanning speed and heat flux distribution of the electron beam are appropriately set, the end portions e1 and e2 of the irradiation line 25 are positioned at the side wall 37 of the hearth 30, and the electron beam is radiated so as to block a flow path between the upstream region S2 including the supply lines 26 and the lip portion 36. In such a case also, it is clear that the LDIs will exhibit behavior that is similar to the behavior illustrated in the aforementioned Examples 1 to 13.

Comparative Example 1

Figure 37:
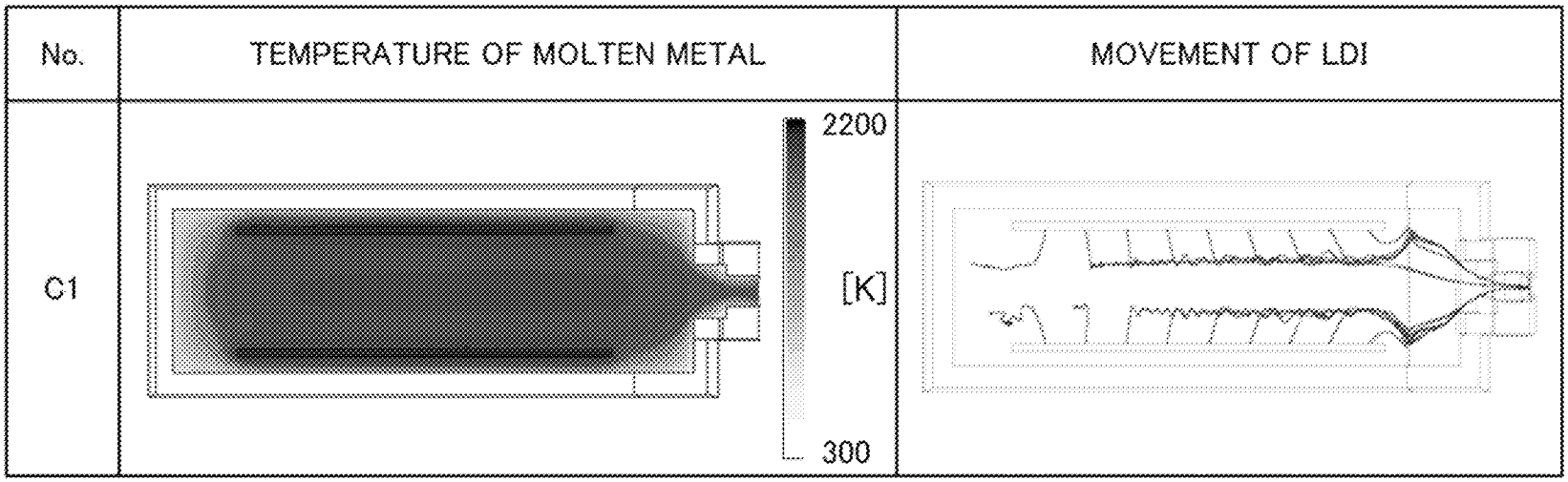
FIG. 37 is an explanatory drawing illustrating a simulation result according to Comparative Example 1.

In Comparative Example 1, an electron beam was not radiated along the irradiation line 25. Therefore, as illustrated in FIG. 37, LDIs flowed freely from the high temperature regions of the supply lines 26 toward the central part of the hearth 30, rode on the molten metal flow 60 at the central part of the hearth 30, and a large amount of LDIs passed through the lip portion 36 and flowed out into the mold.

Comparative Example 2

Comparative Example 2 is a simulation result with respect to the method described in the aforementioned Patent Document 1. In other words, as illustrated in FIG. 38, an electron beam was scanned in a zig-zag shape in the opposite direction to the direction of a molten metal flow toward the mold at the surface of the molten metal 5*c* inside the hearths 31 and 33. As illustrated in FIG. 38, the irradiation line 25 was in a zig-zag shape along the longitudinal direction of the hearths 31 and 33. The raw material 5 was introduced from a raw material supply region 28 on the upstream side in the longitudinal direction of the hearth (that is, the opposite side from the lip portion). For convenience, the melting hearth 31 and the refining hearth 33 are modelled as a single hearth.

Figure 39:
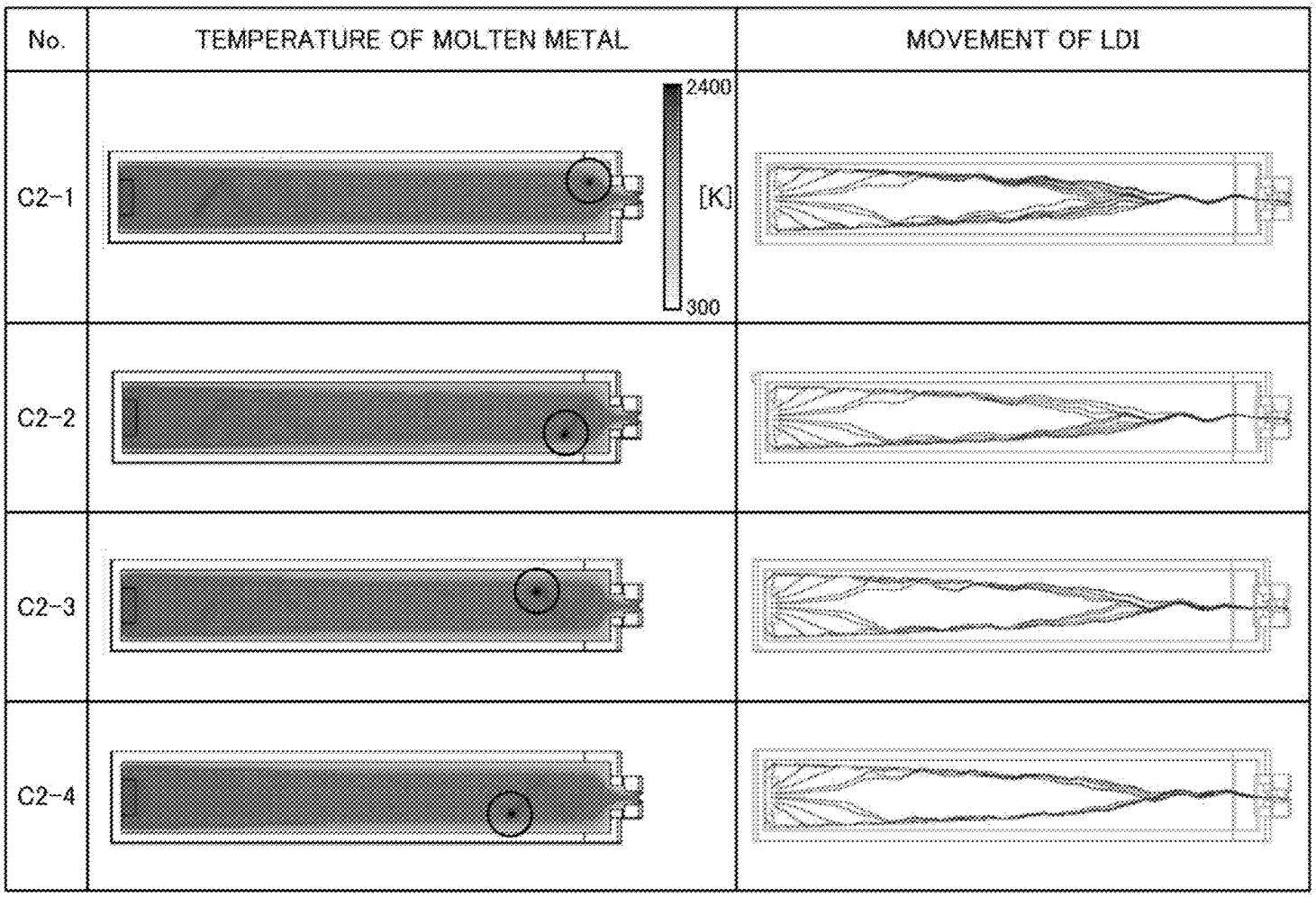
FIG. 39 is an explanatory drawing illustrating a simulation result according to Comparative Example 2.

In Comparative Example 2, as illustrated in FIG. 39, as LDIs moved from the raw material supply region 28 toward the lip portion 36, the LDIs gradually gathered at the lip portion 36 and flowed out into the mold 40. Although in Comparative Example 2 a simulation was performed for a case in which a long hearth was used, the LDIs passed over the irradiation line 25, and it can be easily surmised that the LDIs would also flow out toward the mold in a case in which a short hearth is used.

Comparative Example 3

Figure 41:
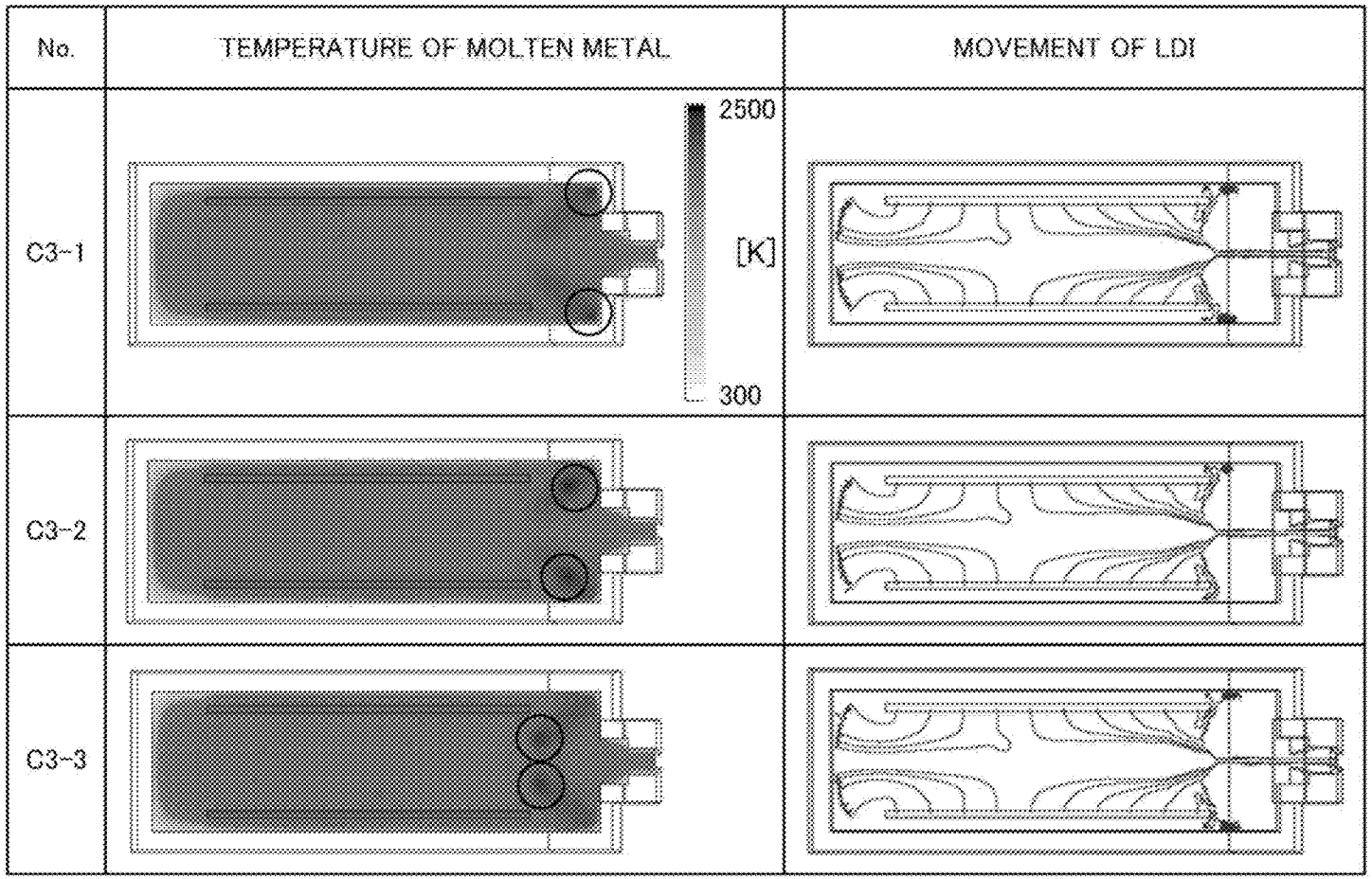
FIG. 41 is an explanatory drawing illustrating a simulation result according to Comparative Example 3.

In Comparative Example 3, as illustrated in FIG. 40, because a first straight line portion and a second straight line portion did not intersect, there was a place at which an electron beam was not radiated in the vicinity of the center line of the hearth 30. Therefore, as illustrated in FIG. 41, LDIs passed through the place at which an electron beam was not radiated, and flowed out through the lip portion 36 into the mold 40.

Comparative Example 4

Figure 43:
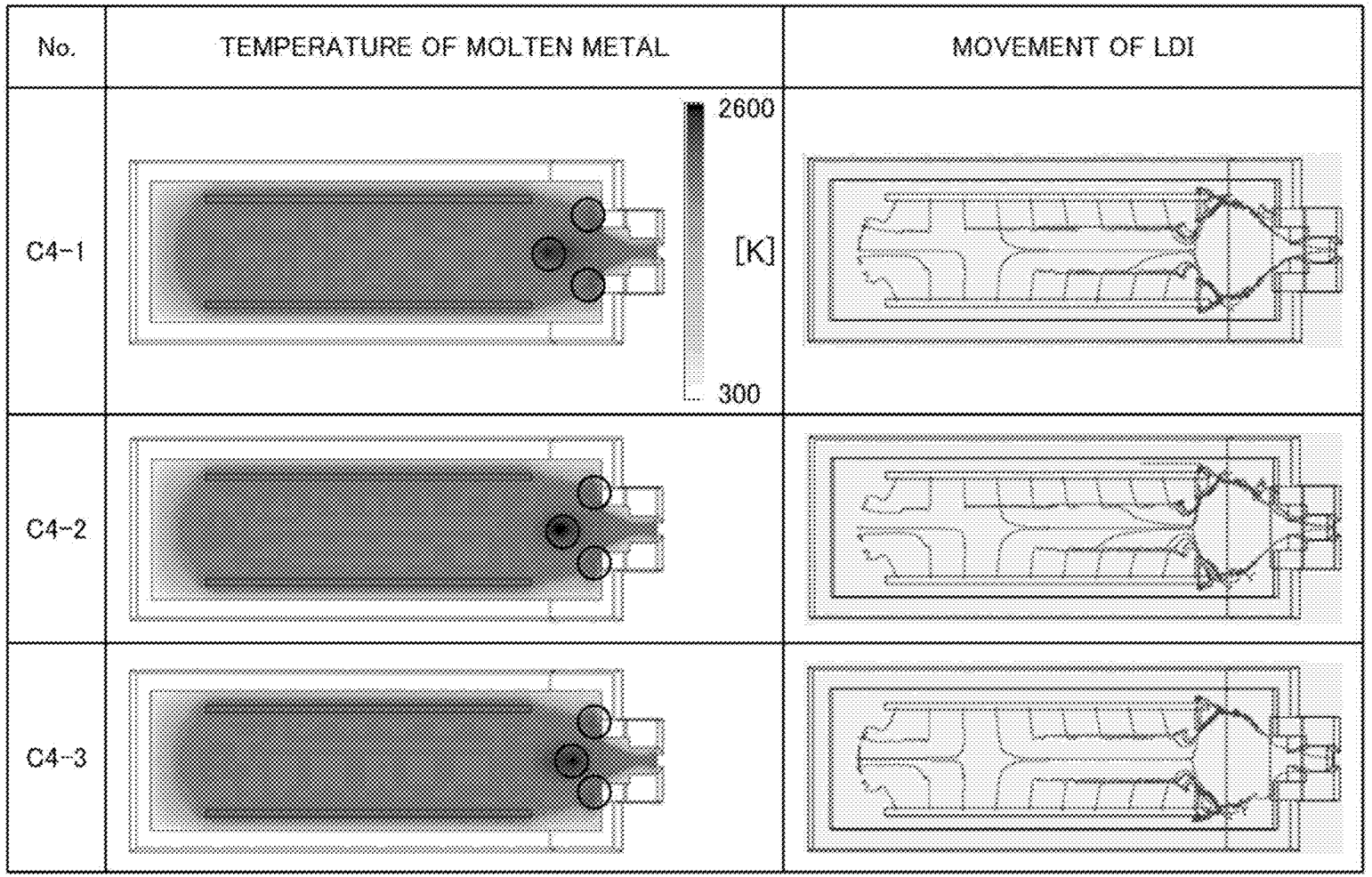
FIG. 43 is an explanatory drawing illustrating a simulation result according to Comparative Example 4.

In Comparative Example 4, as illustrated in FIG. 42, because a first straight line portion L1, a second straight line portion L2 and a third straight line portion L3 did not intersect, there was a place at which an electron beam was not radiated in the vicinity of an inflow opening to the lip portion 36 of the hearth 30. Therefore, as illustrated in FIG. 43, LDIs passed through the place at which an electron beam was not radiated, and flowed out through the lip portion 36 into the mold 40.

The simulation results of Examples 1 to 13 and Comparative Examples 1 to 4 have been described above. Based on these simulation results it can be said that it was verified that by radiating an electron beam in a concentrated manner along the irradiation line 25 as illustrated in Examples 1 to 13, a molten metal flow is formed toward upstream from the irradiation line 25, and LDIs can be inhibited from passing through the lip portion 36 and flowing out toward the mold.

(2) Example Relating to Behavior of Molten Metal Flow

In the present example, the behavior of a molten metal flow was determined with respect to the V-shaped irradiation line 25 according to the first embodiment and the irradiation line 25 according to the second embodiment. In this case, Example 1 (V-shaped irradiation line 25) and Example 3 (T-shaped irradiation line 25) of the aforementioned examples were compared. For each simulation, a transient calculation was performed because the flow and the temperature of the molten metal change from moment to moment depending on scanning of an electron beam. In the present example, the electron guns used in Examples 1 and 3 were set as shown in Table 2 below. With respect to Example 3, three electron guns were used, and a T-shaped irradiation line 25 was formed so that a ratio ($h_2/b_2$) between an irradiation line length ($b_2$) and an irradiation line height ($h_2$) was ⅖.

TABLE 2

| | Electron Beam Heat Transfer Amount [MW] | Electron Beam Scanning Speed [m/s] | Electron Beam Heat Flux Distribution (σ[m]) | Radiation Path Shape |
|---|---|---|---|---|
| Example 1 | 0.25 | 3.7 | 0.02 | V-shape |
| Example 3 | d1: 0.05<br>d2: 0.15<br>d3: 0.05 | d1: 2.9<br>d2: 3.6<br>d3: 2.9 | 0.02 | T-shape |

Figure 44:
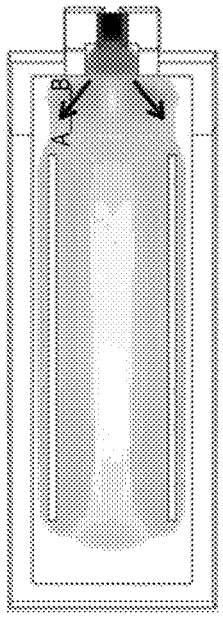
FIG. 44 is an explanatory drawing illustrating a verification result of an example relating to the behavior of a molten metal flow.
Figure 44:
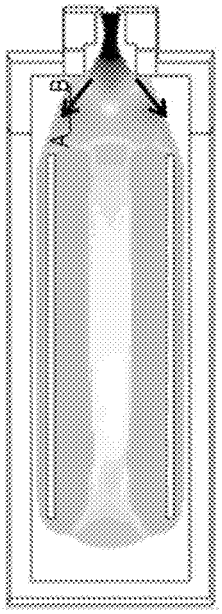

FIG. 44 shows the flow velocity distribution of the molten metal surface and the maximum flow velocity of the molten metal surface, and also shows a ratio of the total flow rate of the molten metal flow toward the side wall 37A across a line segment AB from the vicinity of the lip portion 36. Note that the ratio of the total flow rate is a ratio of a value represented by the product of the average flow velocity of the molten metal flow and the length of the line segment AB.

When the flow velocity distributions of the molten metal surface for Examples 1 and 3 are compared, it is found that although the velocity of the molten metal flow toward the side wall 37A from the vicinity of the lip portion 36 is high in both Example 1 and Example 3, as illustrated in FIG. 44, the flow velocity is higher in Example 3 than in Example 1. The maximum flow velocity was 0.13 m/s in Example 3, while in Example 1 the maximum flow velocity was 0.11 m/s. Further, the ratio of the total flow rate of the molten metal flow that passed through the line segment AB parallel to the side wall 37 of the hearth that is illustrated in the flow velocity distribution of the molten metal surface in FIG. 44 was also a higher value in Example 3 than in Example 1.

Thus, it was found that in comparison to Example 1 in which a surface flow of molten metal toward one side wall was formed by the occurrence of a single Marangoni convection, a molten metal surface flow of a higher velocity was formed in Example 3 in which the surface flow was formed by the occurrence of two Marangoni convections.

(3) Example of Electron Beam for Promoting LDI Dissolving

Next, with respect to the aforementioned Example 8, a simulation was performed for a case where an electron beam for promoting LDI dissolving was used. In the present simulation also, a transient calculation was performed because the flow and the temperature of the molten metal 5*c* change from moment to moment depending on scanning of an electron beam. The simulation was performed based on the assumption that the LDIs were titanium nitride, the grain size of the titanium nitride was 5 mm, and the density of the titanium nitride was 10% less than the molten metal 5*c*.

In the present example, firstly, using one electron gun for preventing an outflow of LDIs, as illustrated in FIG. 12, the irradiation line 25 having a straight-line shape whose two end portions e1 and e2 were positioned at the side wall 37D in which the lip portion 36 was provided was disposed so as to block the lip portion 36. The heat transfer amount of the electron beam for preventing an outflow of LDIs was set to 0.25 MW, the scanning speed was set to 1.6 m/s, and the standard deviation of the heat flux distribution was 0.02 m. Further, electron beams were radiated onto stagnation positions of the molten metal flow using two electron guns for promoting LDI dissolving inside the hearth 30 that were different from the electron gun for preventing an outflow of LDIs. At this time, the radiation time period of the electron beam by each electron gun for preventing an outflow of LDIs was set to 1 second, and the radiation position of the relevant electron beam was fixed at a stagnation position of the molten metal flow. The heat transfer amount of each electron beam for promoting LDI dissolving was set to 0.25 MW, and the standard deviation of the heat flux distribution was 0.02 m.

Figure 45:
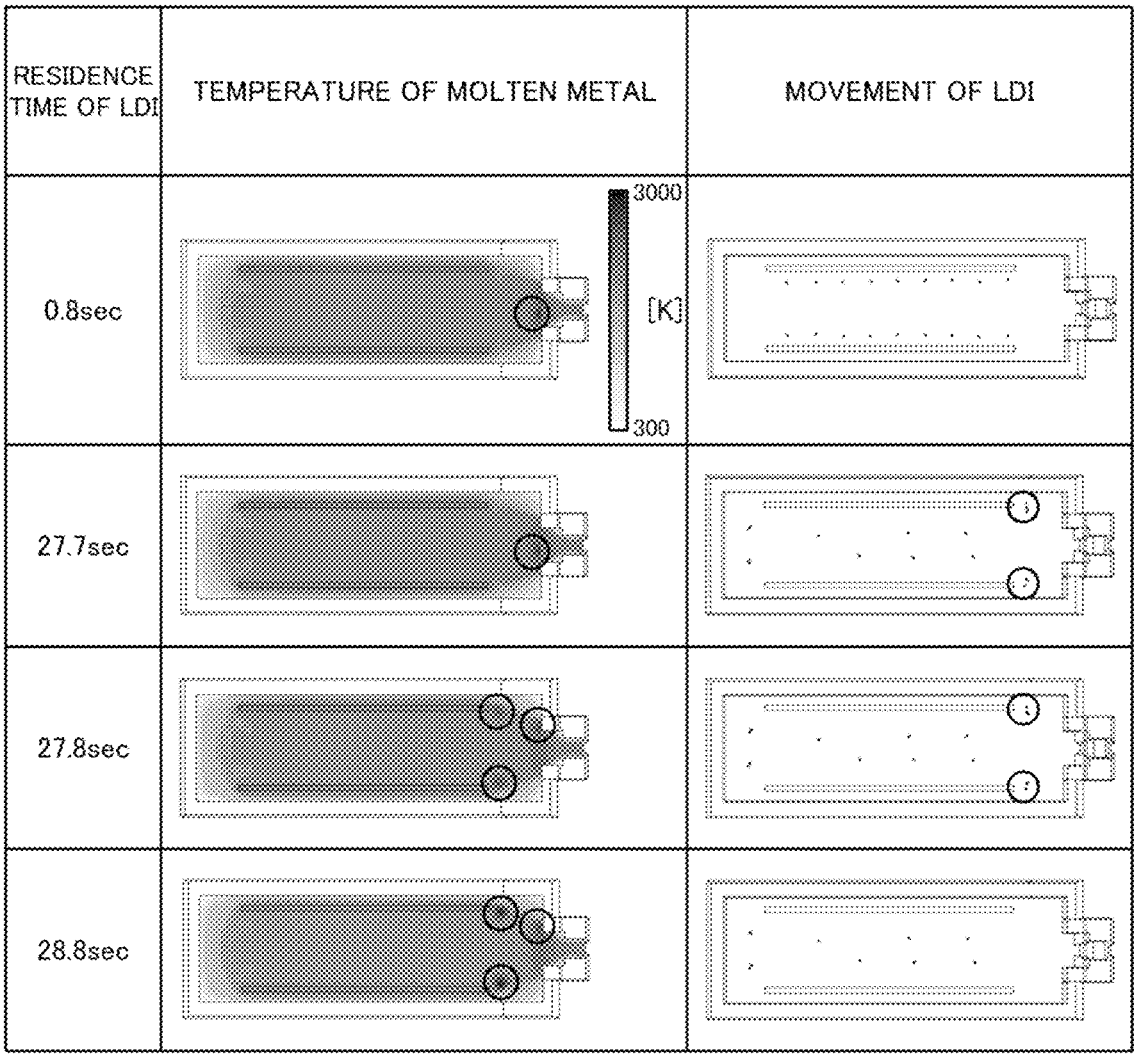
FIG. 45 is an explanatory drawing illustrating a verification result of an example of an electron beam for promoting LDI dissolving.

The simulation result is shown in FIG. 45. FIG. 45 shows temperature distribution charts and the behavior of LDIs with respect to the molten metal surface inside the hearth 30 for four time periods from a time that the LDIs began to reside in the molten metal 5*c*. In the temperature distribution charts on the left side in FIG. 45, a region at which the temperature is high that is marked with a round circle in the vicinity of the lip portion 36 indicates a radiation position of an electron beam with respect to the irradiation line 25 at that time point, and regions of the supply lines 26 at which the temperature is high that are marked with a round circle in the vicinity of an end portion of the lip portion 36 indicate radiation positions of electron beams for promoting LDI dissolving at the relevant time point. Further, two upper and lower belt-like portions with a high temperature indicate the two supply lines 26, and a low temperature portion in the vicinity of an inside face of the hearth indicates a portion at which the skull 7 is formed. In addition, on the right side in FIG. 45, the positions of LDIs during the respective time periods are shown.

As illustrated in FIG. 45, LDIs that were in the vicinity of the supply lines 26 after 0.8 seconds from a time that the LDIs began to reside in the molten metal moved through the inside of the hearth 30 with the passage of time. After 27.7 seconds had passed from the time that the LDIs began to reside in the molten metal, multiple LDIs resided at positions (stagnation positions of the molten metal flow) indicated by round circles in diagrams showing the behavior of the LDIs. After 27.8 seconds had passed from the time that the LDIs began to reside in the molten metal, electron beams were radiated for 1 second toward these groups of built-up LDIs using two electron guns for promoting LDI dissolving. As a result, the LDI dissolved after 28.8 seconds had passed from the time that the LDIs began to reside the molten metal. Thus, it was shown that by identifying stagnation positions in the molten metal flow and radiating electron beams at the relevant stagnation positions in the molten metal flow, it is possible to dissolve LDIs with certainty at an early stage.

Whilst preferred embodiments of the present invention have been described in detail above with reference to the accompanying drawings, the present invention is not limited to the above examples. It is clear that a person having common knowledge in the field of the art to which the present invention pertains will be able to contrive various examples of changes and modifications within the category of the technical idea described in the appended claims, and it should be understood that they also naturally belong to the technical scope of the present invention.

In the foregoing, examples of producing an ingot 50 of titanium using the hearth 30 and the mold 40 in which the metal raw material 5 that is the object of melting by the method for producing a metal ingot according to the present embodiments is, for example, a raw material of titanium or a titanium alloy have been mainly described. However, the method for producing a metal ingot of the present invention is also applicable to cases where various metal raw materials other than a titanium raw material are melted and an ingot of the relevant metal raw material is produced. In particular, the method for producing a metal ingot of the present invention is also applicable to a case of producing an ingot of a high-melting-point active metal with which it is possible to produce an ingot using an electron gun capable of controlling a radiation position of an electron beam and an electron-beam melting furnace having a hearth that accumulates a molten metal of a metal raw material, specifically, a case of producing an ingot of a metal raw material such as, apart from titanium, tantalum, niobium, vanadium, molybdenum or zirconium. In other words, the present invention can be applied particularly effectively to a case of producing an ingot containing the respective elements mentioned here in a total amount of 50% by mass or more.

Further, the shape of a hearth to which the method for producing a metal ingot according to the present embodiment is applied is not limited to a rectangular shape. For example, the method for producing a metal ingot according to the present embodiment is also applicable to a hearth having a shape other than a rectangular shape, in which side walls of the hearth are in a curved shape such as elliptical shape or an oval shape.

REFERENCE SIGNS LIST

1 Electron-beam melting furnace (EB furnace)
5 Metal raw material
5*c* Molten metal
7 Skull
8 LDI
10A, 10B Raw material supplying portion
20A, 20B Electron gun for melting raw material
20C, 20D Electron gun for maintaining temperature of molten metal
20E Electron gun for line radiation
23 Heat-retention radiation region
25 Irradiation line
26 Supply line
30 Refining hearth
36 Lip portion
37A, 37B, 37C Side wall in which lip portion is not provided
37D First side wall
40 Mold
50 Ingot
61, 62, 63 Molten metal flow

The invention claimed is:

1. A method for producing a metal ingot by using an electron-beam melting furnace having an electron gun capable of controlling a radiation position of an electron beam, and a hearth that accumulates a molten metal of a metal raw material, the metal ingot containing 50% by mass or more in total of at least one metallic element selected from titanium, tantalum, niobium, vanadium, molybdenum and zirconium, said method comprising:

radiating a first electron beam onto a surface of the molten metal along an irradiation line, wherein:

among a plurality of side walls of the hearth that accumulate the molten metal of the metal raw material, a first side wall is a side wall provided with a lip portion for causing the molten metal in the hearth to flow out into a mold;

the irradiation line is disposed in a downstream region between an upstream region in which the metal raw material is supplied onto the surface of the molten metal and the first side wall, such that the irradiation line blocks the lip portion, and two end portions of the irradiation line are positioned at an inside face of any of the plurality of side walls of the hearth, or in a region in which a separation distance from an inside face of any of the plurality of side walls of the hearth is 5 mm or less;

the irradiation line has a convex shape that projects from the lip portion side toward the upstream, and is in a V-shape, or a circular arc shape having a diameter that is equal to or larger than an opening width of the lip portion;

a radiation position of the first electron beam runs between the two end portions of the irradiation line, such that the irradiation line on the surface of the molten metal is repeatedly scanned with said first electron beam emitted from the electron gun; and the radiation of the first electron beam along the irradiation line increases a surface temperature (T2) of the molten metal at the irradiation line above an average surface temperature (T0) of the entire surface of the molten metal in the hearth, and forms, in an outer layer of the molten metal, a molten metal flow toward upstream that is a direction toward an opposite side to the first side wall from the irradiation line, wherein radiation conditions are set such that the molten metal flow can be formed and constantly maintained.

2. The method for producing a metal ingot according to claim 1, wherein the molten metal flow is a flow from the irradiation line that arrives at a side wall that extends substantially perpendicularly toward the upstream from the first side wall among the side walls of the hearth.

3. The method for producing a metal ingot according to claim 1, wherein a plurality of the first electron beams are radiated along the irradiation line using a plurality of electron guns, so that radiation paths of the first electron beams intersect or overlap on the surface of the molten metal.

4. The method for producing a metal ingot according to claim 1, wherein:

the hearth comprises one refining hearth only; and the metal raw material is melted at a raw material supplying portion, the melted metal raw material is caused to drip from the raw material supplying portion into the hearth, and the metal raw material in the molten metal is refined within the refining hearth.

5. The method for producing a metal ingot according to claim 1, wherein:

said hearth has multiple stages, and includes a plurality of divided hearths combined and successively disposed; and in each of the divided hearths:

the first electron beam is radiated onto the surface of the molten metal along the irradiation line, and the irradiation line is disposed such that the irradiation line blocks a lip portion of each of the divided hearths in the downstream region, and two end portions of the irradiation line in each of the divided hearths are positioned in a region in which a separation distance from an inside face of a side wall of each of the divided hearths is 5 mm or less.

6. The method for producing a metal ingot according to claim 1, wherein the metal raw material contains 50% by mass or more of a titanium element.

* * * * *